US011874048B2

(12) United States Patent
Kim et al.

(10) Patent No.: US 11,874,048 B2
(45) Date of Patent: Jan. 16, 2024

(54) ICE MAKER AND REFRIGERATOR

(71) Applicant: LG Electronics Inc., Seoul (KR)

(72) Inventors: Yonghyun Kim, Seoul (KR); Jinil Hong, Seoul (KR); Hyunji Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/685,410

(22) Filed: Nov. 15, 2019

(65) Prior Publication Data

US 2020/0158409 A1 May 21, 2020

(30) Foreign Application Priority Data

Nov. 16, 2018 (KR) ..... 10-2018-0142116
Mar. 22, 2019 (KR) ..... 10-2019-0033198
Jul. 22, 2019 (KR) ..... 10-2019-0088299

(51) Int. Cl.
*F25C 5/08* (2006.01)
*F25C 5/20* (2018.01)
(Continued)

(52) U.S. Cl.
CPC ..... *F25C 5/08* (2013.01); *F25C 1/18* (2013.01); *F25C 1/24* (2013.01); *F25C 1/243* (2013.01);
(Continued)

(58) Field of Classification Search
CPC ..... F25C 5/08; F25C 5/22; F25C 5/02; F25C 5/04; F25C 1/06; F25C 1/18; F25C 1/24
See application file for complete search history.

(56) References Cited

U.S. PATENT DOCUMENTS 3,864,933 A * 2/1975 Bright ..... F25C 1/04 62/344
5,408,844 A * 4/1995 Stokes ..... F25C 5/08 249/79
(Continued)

FOREIGN PATENT DOCUMENTS

CN 102878743 1/2013
CN 103582790 2/2014
(Continued)

OTHER PUBLICATIONS

Extended European Search Report in European Application No. 19209366.4, dated Mar. 27, 2020, 8 pages.
(Continued)

*Primary Examiner* — Jonathan Bradford
(74) *Attorney, Agent, or Firm* — Fish & Richardson P.C.

(57) ABSTRACT

An ice maker includes an upper tray defining an upper chamber that is a portion of an ice chamber, a lower tray rotatable relative to the upper tray and defining a lower chamber that is another portion of the ice chamber, wherein the lower chamber is disposed under the upper chamber, an upper heater disposed around the upper tray, for providing heat to the upper chamber, and a lower heater disposed around the lower tray, for providing heat to the lower chamber, wherein in an ice making position, a distance from a horizontal central line passing a contact surface of the upper tray and the lower tray to the upper heater is shorter than a distance from the horizontal central line to the lower heater.

25 Claims, 33 Drawing Sheets

(51) Int. Cl.

| | |
|---|---|
| ***F25C 5/02*** | (2006.01) |
| ***F25C 5/04*** | (2006.01) |
| ***F25C 1/24*** | (2018.01) |
| ***F25C 1/18*** | (2006.01) |
| ***F25C 1/243*** | (2018.01) |

(52) U.S. Cl.
CPC ..... *F25C 5/02* (2013.01); *F25C 5/04* (2013.01); *F25C 5/22* (2018.01)

(56) References Cited

U.S. PATENT DOCUMENTS

| | | | | |
|---|---|---|---|---|
| 9,568,229 | B2 | 2/2017 | Toma | |
| 10,119,740 | B2 | 11/2018 | Yang | |
| 2006/0254300 | A1 | 11/2006 | Rugeris | |
| 2009/0049858 | A1* | 2/2009 | Lee | F25C 5/08 62/349 |
| 2013/0014535 | A1* | 1/2013 | Son | F25C 1/10 62/351 |
| 2013/0014536 | A1* | 1/2013 | Son | F25C 1/25 62/351 |
| 2013/0081412 | A1* | 4/2013 | Son | F25C 5/04 62/73 |
| 2014/0165619 | A1 | 6/2014 | Culley | |
| 2015/0316306 | A1* | 11/2015 | Ji | F25C 1/04 62/340 |
| 2016/0003514 | A1* | 1/2016 | Ji | F25C 5/08 62/351 |
| 2017/0122644 | A1* | 5/2017 | Je | F25C 5/08 62/351 |
| 2018/0231294 | A1* | 8/2018 | Song | F25C 1/04 62/340 |
| 2019/0264970 | A1* | 8/2019 | Tarr | F25C 5/04 62/73 |

FOREIGN PATENT DOCUMENTS

| | | |
|---|---|---|
| CN | 205448438 | 8/2016 |
| CN | 106642867 | 5/2017 |
| CN | 206583156 | 10/2017 |
| CN | 107367120 | 11/2017 |
| JP | H01196478 | 8/1989 |
| JP | H024185 | 1/1990 |
| JP | H09-269172 | 10/1997 |
| JP | 2006519973 | 8/2006 |
| KR | 20120064026 | 6/2012 |
| KR | 20130009332 | 1/2013 |
| KR | 20170052235 | 5/2017 |
| KR | 10-1850918 | 5/2018 |
| KR | 101850918 | 5/2018 |
| KR | 20180093666 | 8/2018 |

OTHER PUBLICATIONS

PCT International Search Report in International Application No. PCT/KR2019/015522, dated Feb. 25, 2020, 12 pages.
CN Office Action in Chinese Appln. No. 201911119381.4, dated Apr. 23, 2021, 15 pages (with English translation).
Extended European Search Report in European Appln. No. 21161511.7, dated Oct. 11, 2021, 11 pages.

* cited by examiner

ICE MAKER AND REFRIGERATOR

CROSS-REFERENCE TO RELATED APPLICATIONS

This application claims the benefit of priority to Korean Application No. 10-2018-0142116, filed on Nov. 16, 2018, Korean Application No. 10-2019-0033198, filed on Mar. 22, 2019, and Korean Application No. 10-2019-0088299, filed on Jul. 22, 2019. The disclosures of the prior applications are incorporated by reference in their entirety.

BACKGROUND

The present disclosure relates to an ice maker and a refrigerator.

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is accommodated in a tray to make ice.

Also, the ice maker is constructed to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

Prior art document 1, Korean Patent No. 10-1850918 provides an ice maker.

The ice maker of the prior art document 1 comprises an upper tray having a plurality of hemispherical upper cells arranged thereon and including a pair of link guide portions extending upward from both sides, a lower tray having a plurality of hemispherical lower cells arranged thereon and rotatably connected to the upper tray, and an ice separation heater for heating the upper tray.

In the prior document 1, since the ice separation heater is formed in a U-type shape and is placed on a top surface of the upper tray, heat may not be uniformly provided to the upper cells which the upper tray forms.

Since the ice separation heater contacts the upper tray at a higher position than the upper cells, the time required to transfer the heat of the ice separation heater to a surface of the upper cell may be increased. Therefore, there are disadvantage that it takes a long time to operate the ice separation heater, and accordingly, power consumption is increased.

In addition, since the ice separation heater contacts the upper tray at a higher position than the upper cell, there is a small amount of heat transmitted to a boundary between the upper tray and the lower tray. Therefore, since the boundary between the upper tray and the lower tray is not separated well, the lower tray may not be smoothly rotated for ice separation.

In addition, since the ice separation heater exists to be exposed outwards in a state that the ice separation heater is placed on the top surface of the upper tray, the heat of the ice separation heater is not concentrated on the upper tray and is emitted outside of the upper tray, thereby lowering heating efficiency.

In addition, in the prior art document 1, since the ice is frozen from each of the upper cell and the lower cell, bubbles are present in the completed ice, thereby creating opaque ice.

Prior art document 2, Japanese Laid-open Patent publication No. Hei 9-269172 discloses an ice making device.

The ice making device of the prior art document 2 includes an ice making dish, and a heater for heating a bottom of water supplied to the ice making dish.

The ice making dish includes a plurality of ice blocks, and the heater contacts one side and a bottom surface of the ice making block.

In the ice making process, the heat of the heater is transferred to one aspect and the bottom surface of the ice making block. A surface of water proceeds to coagulate, and convection in the water occurs, thereby creating transparent ice.

However, in the prior art document 2, since the ice making dish has a structure of being surrounded by an insulation component in a state that the ice making dish contacts the heater, it is difficult to apply a scheme using the heater of the prior art document 2 to the prior art document 1 having a type of rotating the upper tray.

Even if the heater of the prior art document 2 contacts the upper tray of the prior art document 1, the upper heater may be exposed outwards, and also, the heater is apprehended to interfere with a lower ejecting pin in a rotation process of the lower tray.

SUMMARY

The present embodiment provides an ice maker capable of rapidly providing heat of an upper heater to an upper chamber, and also transferring the heat to a boundary of an upper tray and a lower tray.

The present embodiment provides an ice maker capable of uniformly providing the heat of the upper heater for ice separation to upper chambers.

The present embodiment provides an ice maker of allowing bubbles caused by freezing ice from an upper side to be locally gathered at a lowermost side, thereby making ice transparent as a whole.

The present embodiment provides an ice maker of preventing lower heater for making transparent ice from interfering with a lower ejector in an ice separation process.

The present embodiment provides an ice maker capable of uniformly providing the heat of the upper heater to the lower chambers.

The present embodiment provides an ice maker of enabling the upper heater to be stably maintained in a fixed state.

The present embodiment provides an ice maker capable of reducing a tension of a wire by extending a length of the wire connected to the heater and preventing a disconnection.

The present embodiment provides an ice maker capable of preventing the disconnection of the wire by rotation of a lower assembly although the length of the wire is extended by adding a hook for guiding the wire.

The present embodiment provides a refrigerator comprising the above-described ice maker.

An ice maker according to one aspect may comprise: an upper tray and a lower tray defining an upper chamber; and an upper heater for providing heat to the upper tray, and a lower heater for providing heat to the lower tray.

In the present invention, on the basis of a height of the ice chamber, a distance from a horizontal central line of the ice chamber to the upper heater may be shorter than a distance from the horizontal central line of the ice chamber to the lower heater.

The horizontal central line means a line passing through a contact surface of the upper tray and the lower tray.

The upper tray may define an upper chamber that is a portion of the ice chamber, and the lower tray may define a lower chamber that is another portion of the ice chamber. The lower chamber may be disposed under the upper chamber.

The upper tray may further comprise an upper opening communicating with the upper chamber and disposed in an upper side of the upper chamber.

The upper heater is disposed closer to the horizontal central line of the ice chamber than the upper opening so that the heat of the upper heater is smoothly transferred to a boundary of the upper tray and the lower tray. As an example, the horizontal central line is a line passing through a contact surface of the upper tray and the lower tray.

The upper heater is disposed in the same height as the height of a bisector of bisecting a distance between the upper opening and the horizontal central line or is higher than the bisector.

The upper heater may comprise an upper round portion surrounding the upper chamber, and a lower round portion surrounding the lower chamber.

A radius of curvature of the upper round portion of the upper heater may be greater than a radius of curvature of the lower round portion of the lower heater.

In this embodiment, the upper tray may include a plurality of upper chambers disposed in a line, and the lower tray may include a plurality of lower chambers disposed in a line.

For uniformly heating the plurality of upper chambers, the upper heater may be disposed to surround each of the plurality of upper chambers.

The lower round portion of the lower heater may be disposed to surround a vertical central line at a position of being spaced apart from the vertical central line of the ice chamber to prevent an interference of the lower ejector and the lower heater.

The vertical central line means a line vertical to the horizontal central line.

For uniformly heating the plurality of lower chambers, the lower heater may be disposed to surround each of the plurality of lower chambers.

The upper heater and the lower heater may be wire-type heaters.

The ice maker may further comprise an upper case contacted by the upper tray, and including a heater coupling part coupled to the upper heater.

The heater coupling part may be accommodated in an accommodation part in a state that the upper heater is coupled to the heater coupling part.

The heater coupling part may comprise a heater accommodation groove into which the upper heater is accommodated.

A diameter of the upper heater may be greater than a recessed depth of the heater accommodation groove to protrude outside of the heater accommodation groove.

When the heater coupling part coupled to the upper heater is accommodated in the accommodation part, the heater may contact a bottom of the accommodation part.

The heater accommodation groove may include a plurality of rounded portions arranged to surround each of the upper chambers. Two rounded portions that are adjacent to each other may be connected by a linear portion.

The heater coupling part may include an inner wall and an outer wall for forming the heater accommodation groove, and the upper heater may be disposed between the inner wall and the outer wall.

At least one of the inner wall and the outer wall may include a separation prevention protrusion for preventing the upper heater from being separated.

The separation prevention protrusion may protrude from one to the other among the inner wall and the outer wall. A protrusion length of the separation prevention protrusion may be less than half an interval between the inner wall and the outer wall so that the upper heater can be smoothly accommodated in the heater accommodation groove.

The separation prevention protrusions may be disposed in each of the rounded portions of the heater accommodation grooves in order to efficiently prevent a separation of the upper heater curved in a horizontal direction.

A line of straightly connecting two separated points of the upper round portion or both ends of the upper round portion may pass through the upper chamber.

An opening for disposing a portion of the accommodated upper heater may be provided in the heater accommodation groove.

The ice maker according to another aspect may comprise: an upper tray defining an upper chamber that is a portion of an ice chamber; a lower tray rotatable relative to the upper tray and defining a lower chamber that is another portion of the ice chamber, wherein the lower chamber is disposed under the upper chamber; an upper heater disposed around the upper tray, for providing heat to the upper chamber; and a lower heater disposed around the lower tray, for providing heat to the lower chamber.

Based on the height of the ice chamber, a distance from a horizontal central line of the ice chamber to the upper heater may be shorter than a distance from the horizontal central line of the ice chamber to the lower heater.

The upper heater may comprise an upper round portion surrounding the upper chamber, and the lower heater may comprise a lower round portion surrounding the lower chamber.

Each of the upper round portion and the lower round portion of the upper heater may be disposed to vertically overlap the ice chamber.

A radius of curvature of the upper round portion of the upper heater may be greater than a radius of curvature of the lower round portion.

The lower round portion of the lower heater may be spaced apart from a vertical central line of the ice chamber and may be disposed to surround the vertical central line.

A distance between two points disposed in opposite sides based on the vertical central line of the ice chamber in the lower round portion of the lower heater may be smaller than a diameter of the ice chamber A distance between two points disposed in the opposite sides based on the vertical central line in the upper round portion of the upper heater may be greater than a distance between two points disposed in the opposite sides based on the vertical central line in the lower round portion of the lower heater.

The upper tray may further comprise an upper opening communicating with the upper chamber and disposed in an upper side of the upper chamber. The upper heater is disposed closer to the horizontal central line of the ice chamber than the upper opening. The horizontal central line is a line passing through a contact surface of the upper tray and the lower tray.

The upper heater may be disposed in the same height as the height of a bisector of bisecting a distance between the upper opening and the horizontal central line or may be higher than the bisector.

The upper tray may include a plurality of upper chambers disposed in a line, and the lower tray may include a plurality of lower chambers disposed in a line. The upper heater may be disposed to surround each of the plurality of upper chambers, and the lower heater may be disposed to surround each of the plurality of lower chambers.

The upper heater may comprise upper round portions surrounding each of the plurality of upper chambers, and a linear portion connecting two upper round portions adjacent to each other.

The upper round portions may include a first upper round portion surrounding an upper chamber disposed in an outermost portion in the plurality of the upper chambers.

Both sides of the first upper round portion may be connected by a pair of upper linear portions, and a distance between the pair of upper linear portions may less than double in a radius of curvature of the first upper round portion.

A distance between the pair of upper linear portions may be equal to or greater than the radius of curvature of the first upper round portion.

The lower heater may comprise lower round portions surrounding each of the plurality of lower chambers, and a linear portion connecting two lower round portions adjacent to each other.

The lower round portions may comprise a first rounded portion surrounding a lower chamber arranged in an outermost portion in the plurality of lower chambers.

Both sides of the first upper round portion may be connected by a pair of linear portions, and a distance between the pair of linear portions may less than double in a radius of curvature of the first upper round portion.

A distance between the pair of linear portions may be equal to or greater than the radius of curvature of the first upper round portion.

A refrigerator according to another aspect may comprise: a cabinet provided with a storage space; a door opening or closing the storage space; and an ice maker for making ice by cold air of the storage space.

The ice maker comprises: an upper tray defining a portion of an ice chamber having a spherical shape; a lower tray defining another portion of the ice chamber; an upper heater for providing heat to the upper tray; and a lower heater for providing heat to the lower tray.

At least a portion of each of the upper heater and the lower heater may be disposed to vertically overlap the ice chamber. The upper tray may comprise an upper opening. A line of bisecting a distance between the upper opening and the horizontal central line of the ice chamber may be named a bisector.

The upper heater may be disposed between the bisector and the upper opening.

The ice maker according to another aspect may comprise an upper assembly including an upper tray with an upper chamber recessed upwards so as to define an upper side of an ice chamber in which water is fully entered to make ice, and a lower assembly including a lower tray with a lower chamber recessed downwards so as to define a lower side of an ice chamber.

The lower assembly may include may comprise a lower support supporting a lower side of the lower tray and including a heater coupling part.

The ice maker may include a heater coupled to the heater coupling part of the lower support, and capable of providing heat to a plurality of lower chambers to make the made ice transparent.

The heater may be operated in an ice making process. When the heater is operated, the ice may be gradually made in the upper chamber.

The lower assembly may comprise an upper support contacting one side of the upper tray. The upper support may comprise a wire guiding hook extending downwards, for guiding a wire connected to the heater.

The upper support may comprise a plurality of chamber accommodation parts for accommodating the plurality of lower chambers. The heater coupling part may comprise heater accommodation grooves recessed in the plurality of chamber accommodation parts.

A diameter of the heater may be greater than a recessed depth of the heater accommodation groove. Therefore, the heater may contact the lower tray.

The heater accommodation groove may comprise a plurality of rounded portions disposed to surround each of the lower chambers, and a linear portion connected to the plurality of rounded portions.

The heater is a wire-type heater, and when the heater is accommodated in a plurality of rounded portions of the heater accommodation groove, the heater may be curved in a shape corresponding to the plurality of rounded portions.

The heater coupling part may comprise an inner wall and an outer wall for forming the heater accommodation groove. The heater may be accommodated between the inner wall and the outer wall, and at least one of the inner wall and the outer wall may include a separation prevention protrusion for preventing the upper heater from being separated.

The separation prevention protrusion may protrude from one to the other among the inner wall and the outer wall. A protrusion length of the separation prevention protrusion may be less than half an interval between the inner wall and the outer wall.

A penetration opening may be provided in the heater accommodation groove so that a portion of the accommodated heater is positioned therein.

In this embodiment, the lower tray body may include a heater contact part protruding such that the heater is contacted. A bottom surface of the heater contact part is a plane, and the bottom surface may be contacted by the heater.

The heater may be lower than an intermediate point of a height of the lower chamber in a state that the heater contacts the lower tray.

The lower support may comprise a first guide groove extending from one lower chamber among the plurality of lower chambers and accommodating the heater, and a second guide groove extending in a direction of intersecting at the first guide home and guiding a wire connected to the heater.

The lower support may be rotatable on the basis of a rotational central axis, and the second guide groove may extend in a direction of aligning the rotational central axis.

A power input terminal and a power output terminal of the heater may be disposed in the first guide groove. The power input terminal and the power output terminal may be connected to a first connector. The first connector may be connected to a second connector connected to the wire.

The first connector and the second connector may be disposed in the second guide groove.

The plurality of lower chambers may be disposed in a line, and the one lower chamber and the other lower chamber disposed farthest among the plurality of lower chambers may further comprise a detour accommodation groove extending from the heater accommodation groove.

The wire guiding hook may comprise a curving part formed to be curved one or more times and a support part extending to a bottom surface of the upper support for supporting the curving part.

The wire may be withdrawn outside of the lower support through a withdrawing slot included in an end of the second guide groove by reciprocating the second guide groove.

A refrigerator according to another aspect may comprise a cabinet provided in a freezer; a housing provided in the freezer; and an ice maker installed in the housing.

DETAILED DESCRIPTION OF THE EMBODIMENTS

Figure 1:
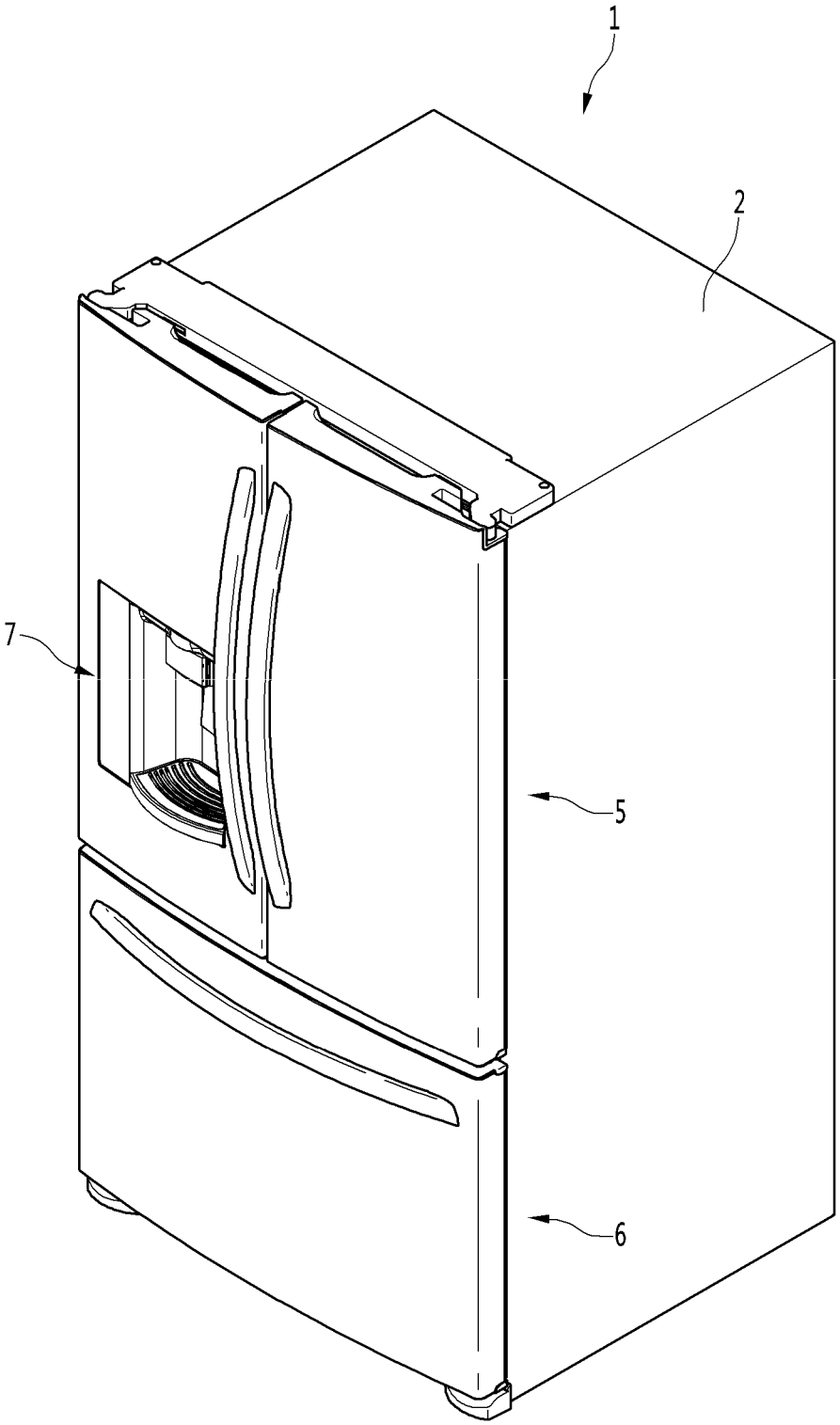
FIG. 1 is a perspective view of a refrigerator according to one embodiment of the present disclosure.
Figure 2:
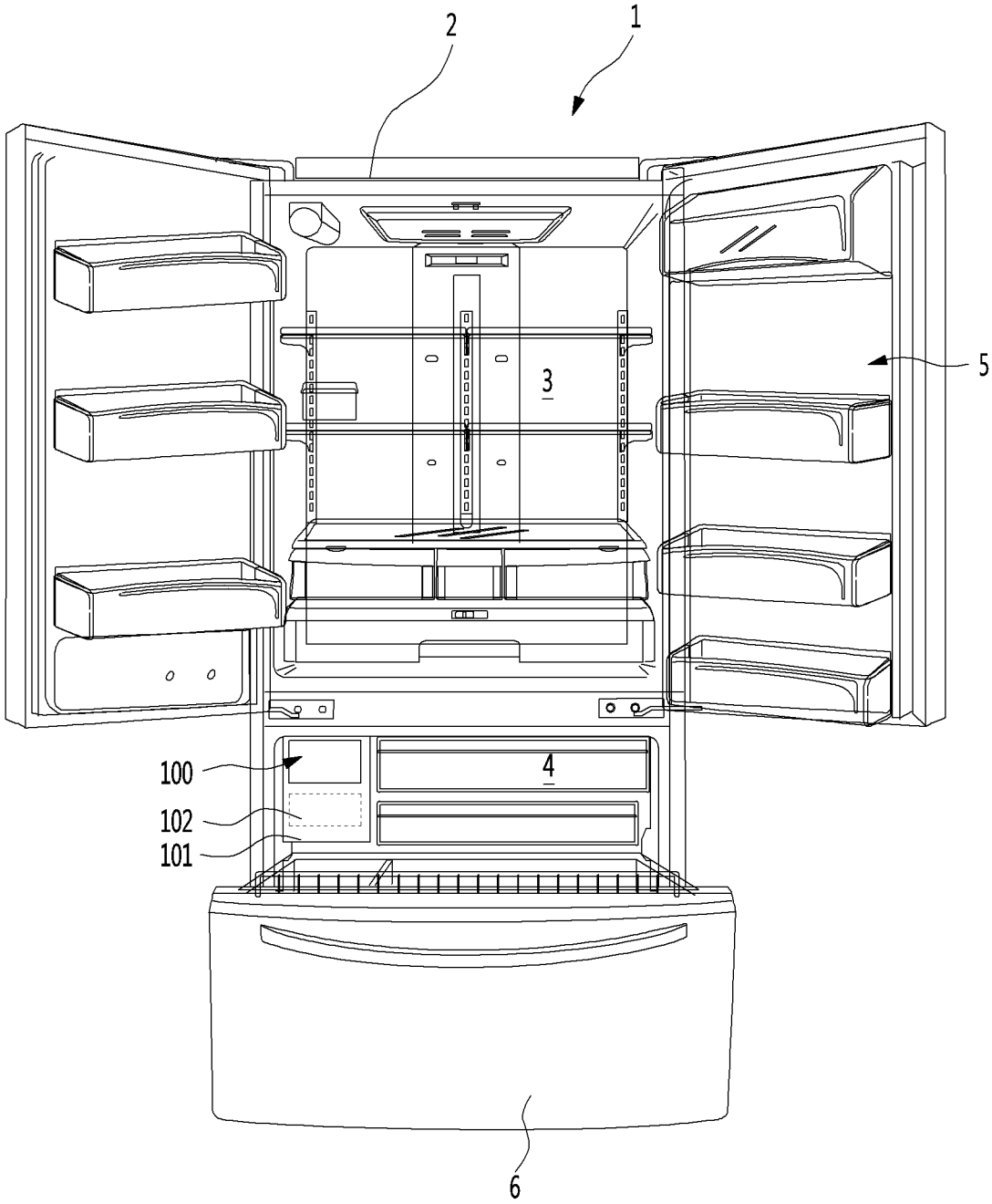
FIG. 2 is a view showing a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the ice is stored after being transferred from the ice maker 100 may be further provided below the ice maker 100.

The ice maker 100 and the ice bin 102 may be mounted in the freezing compartment 4 in a state of being respectively mounted in separate housings 101.

A user may open the refrigerating compartment door 6 to approach the ice bin 102, thereby obtaining the ice.

In another example, a dispenser for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser by a transfer unit. Thus, the user may obtain the ice from the dispenser.

Hereinafter, the ice maker will be described in detail with reference to the accompanying drawings.

Figure 3:
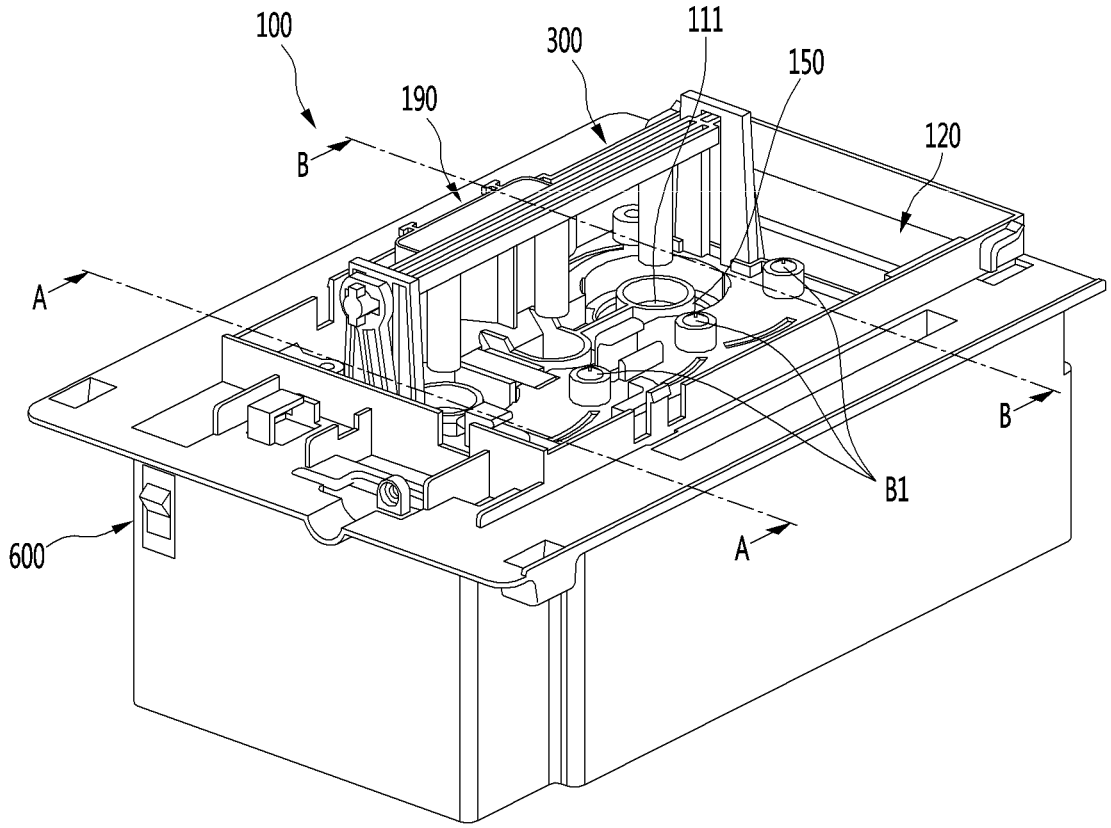
FIG. 3 and FIG. 4 is a perspective view of an ice maker according to one embodiment of the present disclosure.
Figure 4:
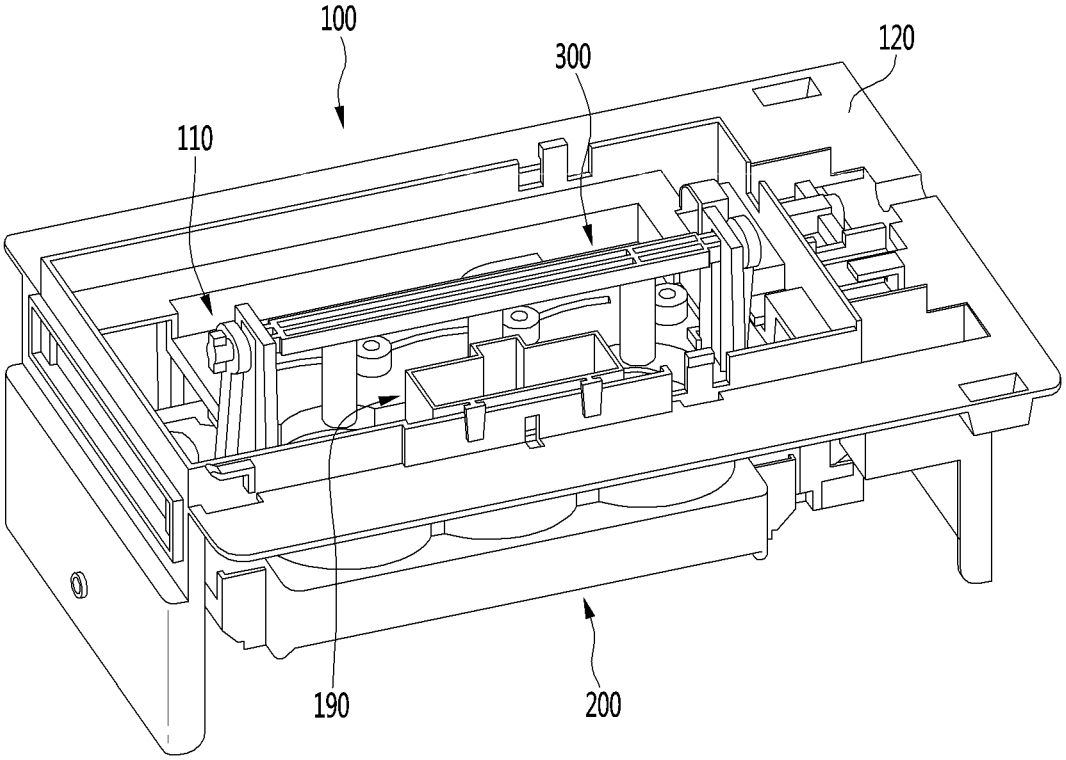
Figure 5:
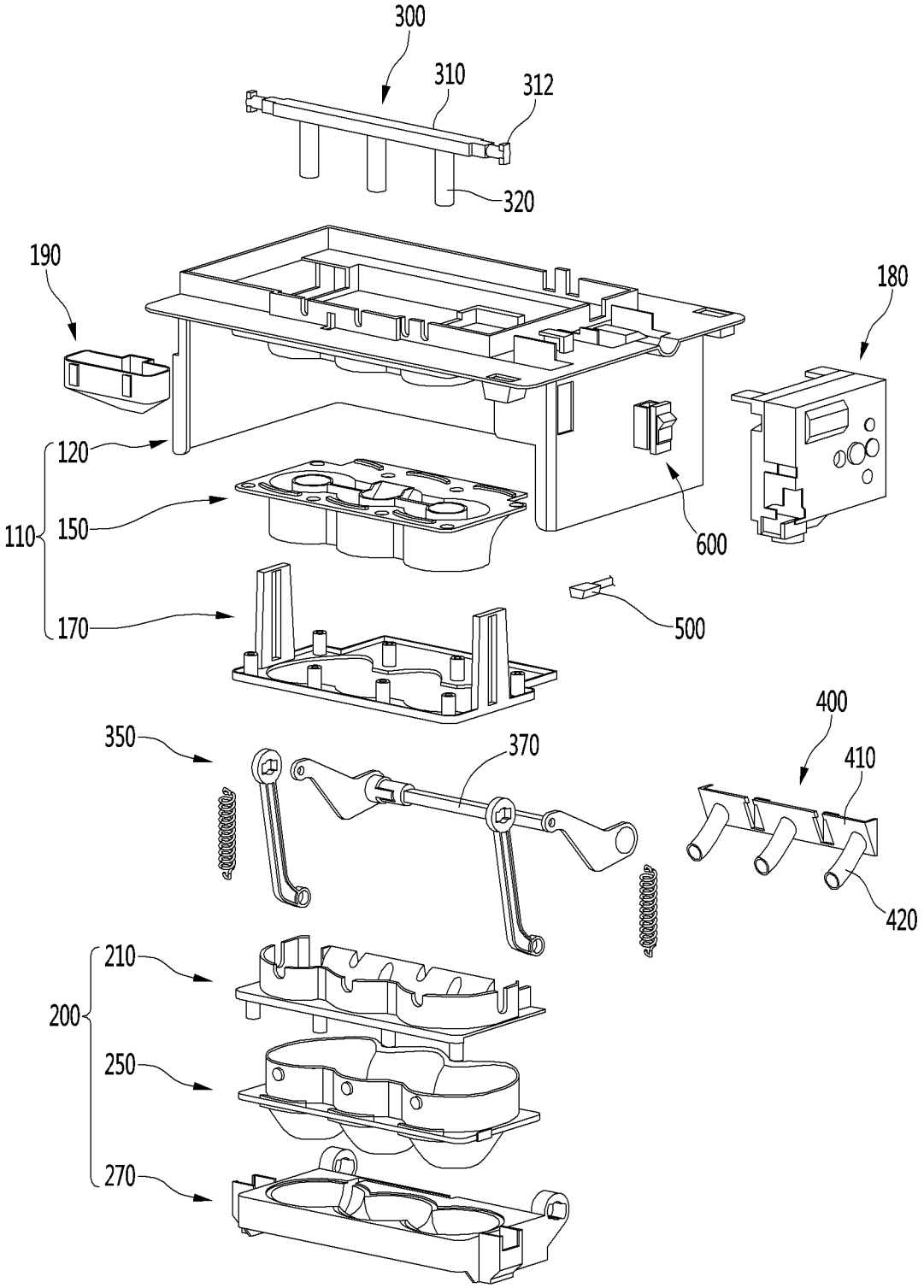
FIG. 5 is an exploded perspective view of an ice maker according to one embodiment of the present disclosure.

FIGS. 3 and 4 are perspective views of the ice maker according to an embodiment, and FIG. 5 is an exploded perspective view of the ice maker according to an embodiment.

Referring to FIGS. 3 to 5, the ice maker 100 may include an upper assembly 110 and a lower assembly 200.

The lower assembly 200 may rotate with respect to the upper assembly 110. For example, the lower assembly 200 may be connected to be rotatable with respect to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape.

As used herein, a term "spherical or hemisphere form" not only includes a geometrically complete sphere or hemisphere form but also a geometrically complete sphere-like or geometrically complete hemisphere-like form.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and a plurality of upper ejecting pins 320 extending in a direction crossing the ejector body 310.

The upper ejecting pins 320 may be provided in the same number of ice chambers 111.

A separation prevention protrusion 312 for preventing a connection unit 350 from being separated in the state of being coupled to the connection unit 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and a plurality of lower ejecting pins 420 protruding from the ejector body 410. The lower ejecting pins 420 may be provided in the same number of ice chambers 111.

While the lower assembly 200 rotates to transfer the ice, rotation force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejector 300 may descend by the connection unit 350 to allow the upper ejector pin 320 to press the ice.

On the other hand, when the lower assembly 200 rotates in the other direction, the upper ejector 300 may ascend by the connection unit 350 to return to its original position.

Hereinafter, the upper assembly 110 and the lower assembly 200 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper support 170 fixing a position of the upper tray 150.

The upper support 170 may restrict downward movement of the upper tray 150.

The upper assembly 110 may further include an upper case 120 fixing a position of the upper tray 150.

The upper tray 150 may be disposed below the upper case 120.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

For example, the water supply part 190 may be fixed to the upper case 120.

The ice maker 100 may further include a temperature sensor 500 detecting a temperature of the ice chamber 111.

In one example, the temperature sensor 500 detects the temperature of the upper tray 150 thus to indirectly detect the temperature of the water or the temperature of the ice in the ice chamber 111.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250.

The lower assembly 200 may further include a lower case 210 of which at least a portion covers an upper side of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice.

That is, when the switch 600 is turned on, water may be supplied to the ice maker 100. Then, an ice making process of making ice by using cold air and an ice separating process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

<Upper Case>

Figure 6:
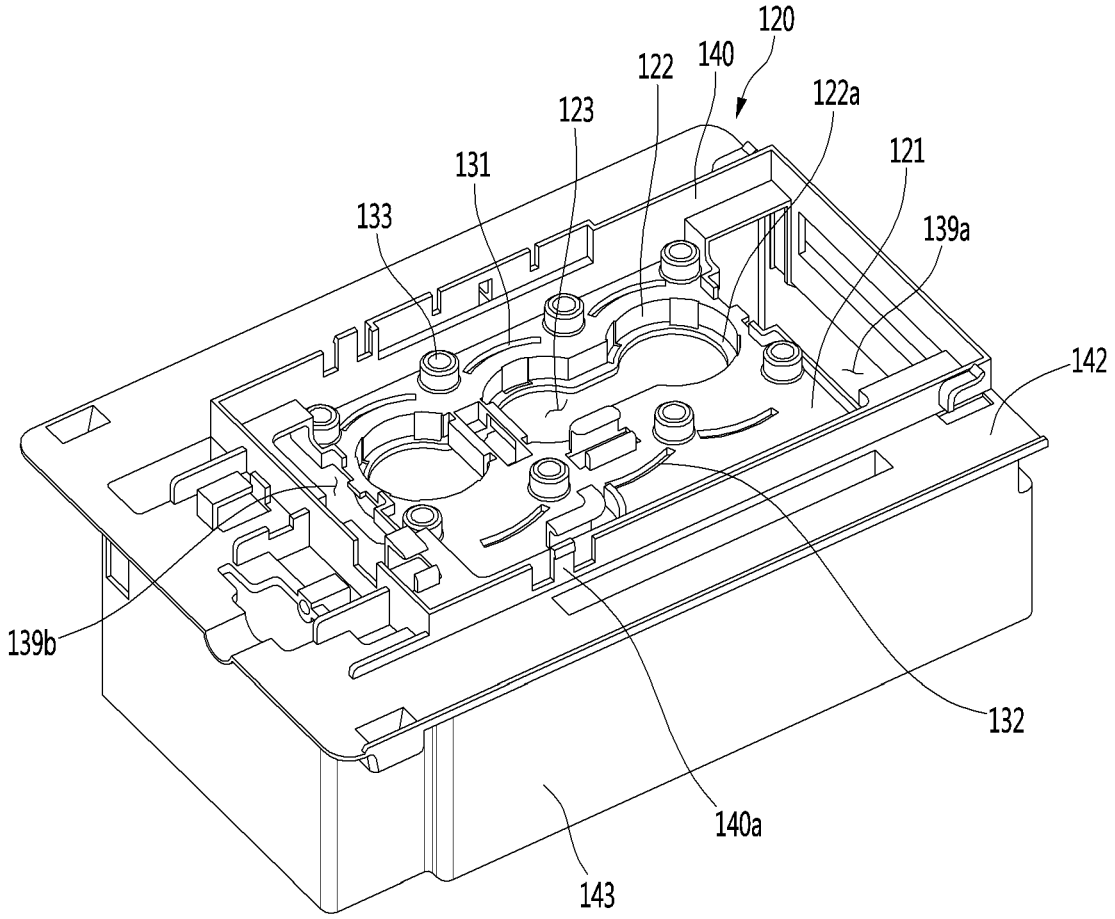
FIG. 6 is a top perspective view of an upper case according to one embodiment of the present disclosure.
Figure 7:
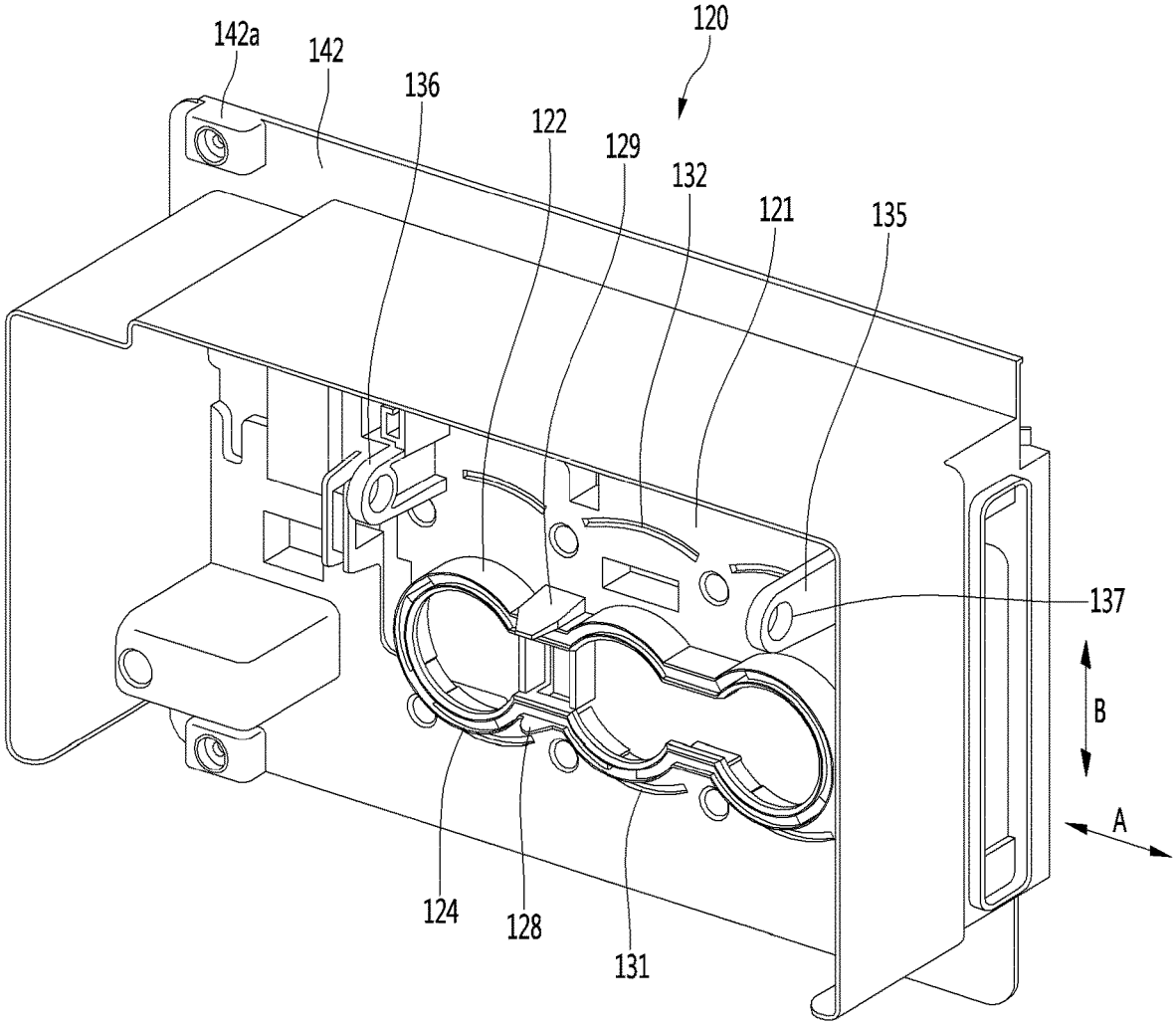
FIG. 7 is a bottom perspective view of an upper case according to one embodiment of the present disclosure.

FIG. 6 is a top perspective view of the upper case according to an embodiment, and FIG. 7 is a bottom perspective view of the upper case according to an embodiment.

Referring to FIGS. 6 and 7, the upper case 120 may be fixed to a housing 101 within the freezing compartment 4 in a state in which the upper tray 150 is fixed.

The upper case 120 may include an upper plate for fixing the upper tray 150.

The upper tray 150 may be fixed to the upper plate 121 in a state in which a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a recess 122 that is recessed downward. The opening 123 may be defined in a bottom surface 122*a* of the recess 122.

Thus, the upper tray 150 passing through the opening 123 may be disposed in a space defined by the recess 122.

A heater coupling part 124 for coupling an upper heater (see reference numeral 148 of FIG. 13) that heats the upper tray 150 so as to transfer the ice may be provided in the upper case 120.

For example, the heater coupling part 124 may be provided on the upper plate 121. The heater coupling part 124 may be disposed below the recess 122.

The upper case 120 may further include a plurality of installation ribs 128 and 129 for installing the temperature sensor 500.

The pair of installation ribs 128 and 129 may be disposed to be spaced apart from each other in a direction of an arrow B of FIG. 7. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

The opening 123 may be defined between the first upper slot 131 and the second upper slot 132.

The first upper slot 131 and the second upper slot 132 may be spaced apart from each other in a direction of an arrow B of FIG. 7.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 133 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, the distance between the first upper slot 131 and the opening 123 may be greater than that between the second upper slot 132 and the opening 123.

Also, when viewed from the opening 123 toward each of the upper slots 131, a shape that is convexly rounded from each of the slots 131 toward the outside of the opening 123 may be provided.

The upper plate 121 may further include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supports 135 and 136 allowing the lower assembly 200 to rotate.

The plurality of hinge supports 135 and 136 may be disposed to be spaced apart from each other in the direction of the arrow A with respect to FIG. 7. Also, a first hinge hole 137 may be defined in each of the hinge supports 135 and 136.

For example, the plurality of hinge supports 135 and 136 may extend downward from the upper plate 121.

The upper case 120 may further include a vertical extension part 140 vertically extending along a circumference of the upper plate 121. The vertical extension part 140 may extend upward from the upper plate 121.

The vertical extension part 140 may include one or more coupling hooks 140*a*. The upper case 120 may be hook-coupled to the housing 101 by the coupling hooks 140*a*.

The water supply part 190 may be coupled to the vertical extension part 140.

The upper case 120 may further include a horizontal extension part 142 horizontally extending to the outside of the vertical extension part 140.

A screw coupling part 142*a* protruding outward to screw-couple the upper case 120 to the housing 101 may be provided on the horizontal extension part 142.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside.

Although the upper case is coupled to the separate housing 101 within the freezing compartment 4 as described above, the embodiment is not limited thereto. For example, the upper case 120 may be directly coupled to a wall defining the freezing compartment 4.

<Upper Tray>

Figure 8:
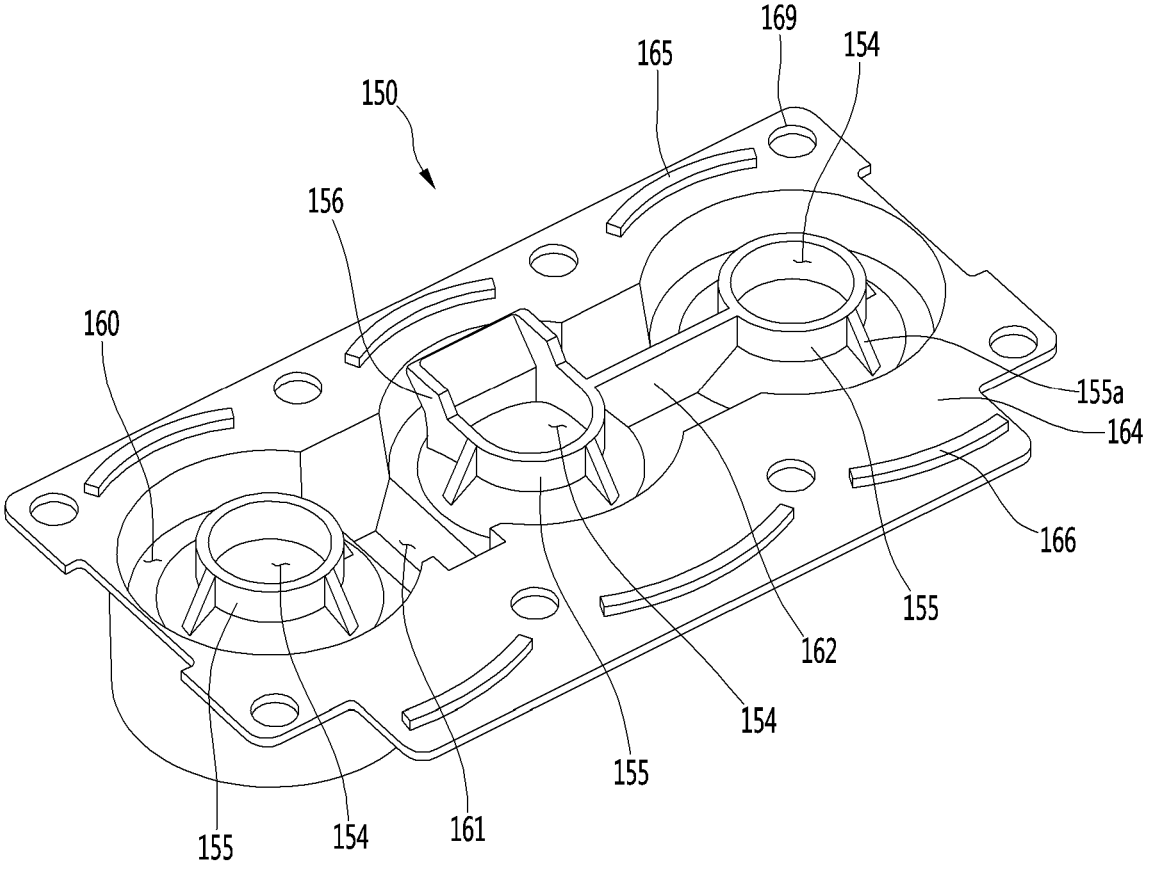
FIG. 8 is a top perspective view of an upper tray according to one embodiment of the present disclosure.
Figure 9:
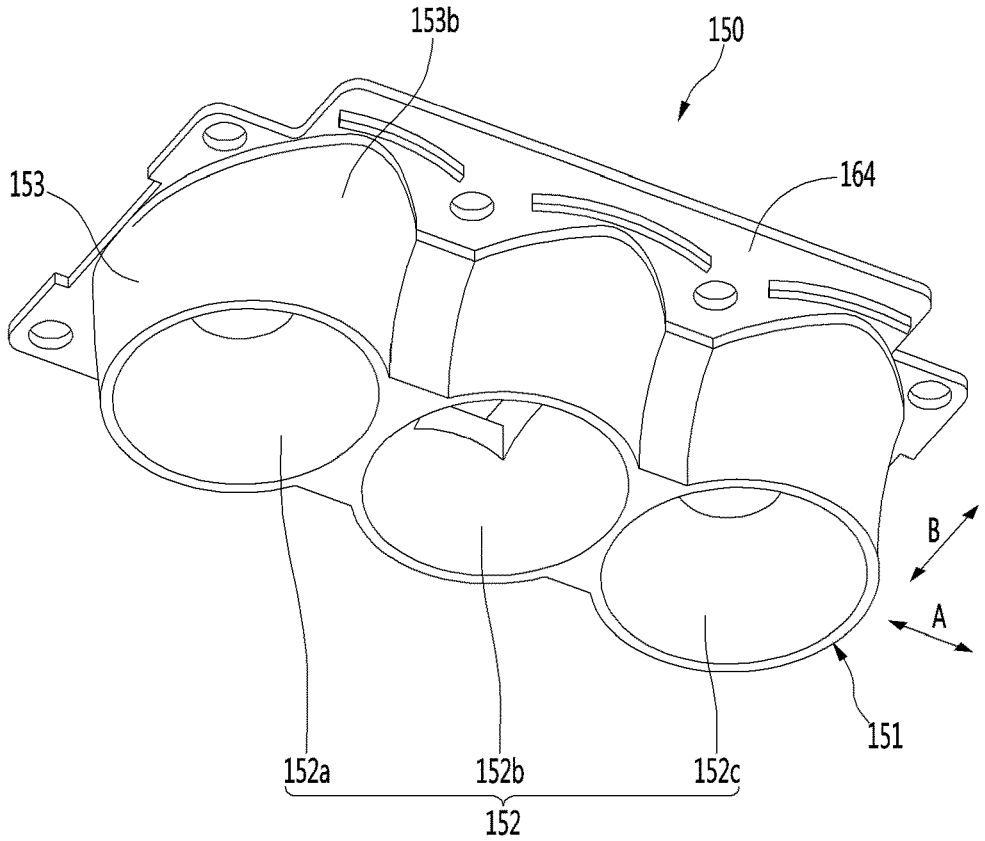
FIG. 9 is a bottom perspective view of an upper tray according to one embodiment of the present disclosure.
Figure 10:
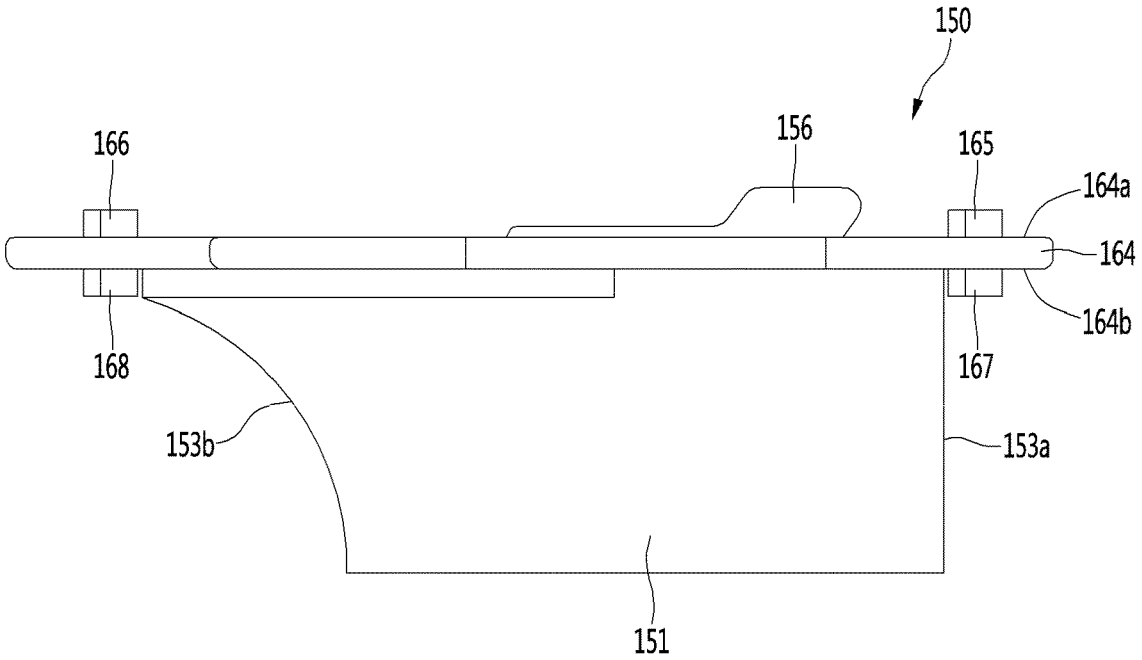
FIG. 10 is a side elevation view of an upper tray according to one embodiment of the present disclosure.

FIG. 8 is a top perspective view of the upper tray according to an embodiment, FIG. 9 is a bottom perspective view of the upper tray according to an embodiment, and FIG. 10 is a side view of the upper tray according to an embodiment.

Referring to FIGS. 8 to 10, the upper tray 150 may be made of a non-metal material and a flexible material that is capable of being restored to its original shape after being deformed by an external force.

For example, the upper tray 150 may be made of a silicone material. Like this embodiment, when the upper tray 150 is made of the silicone material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicone material, the upper tray 150 may be prevented from being melted or thermally deformed by heat provided from an upper heater that will be described later.

The upper tray 150 may include an upper tray body 151 defining an upper chamber 152 that is a portion of the ice chamber 111.

The upper tray body 151 may be define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 9. The direction of the arrow A of FIG. 9 may be the same direction as the direction of the arrow A of FIG. 7.

The upper chamber 152 may have a hemispherical shape. That is, an upper portion of the spherical ice may be made by the upper chamber 152.

An upper opening 154 may be defined in an upper side of the upper tray body 151. The upper opening 154 may be communicated with the upper chamber 152.

For example, three upper openings 154 may be defined in the upper tray body 151.

Cold air may be guided into the ice chamber 111 through the upper opening 154. Further, water may be supplied into the ice chamber 111 through the upper opening 154.

In the ice separating process, the upper ejector 300 may be inserted into the upper chamber 152 through the upper opening 154.

While the upper ejector 300 is inserted through the upper opening 154, an inlet wall 155 may be provided on the upper tray 150 to minimize deformation of the upper opening 154 in the upper tray 150.

The inlet wall 155 may be disposed along a circumference of the upper opening 154 and extend upward from the upper tray body 151.

The inlet wall 155 may have a cylindrical shape. Thus, the upper ejector 30 may pass through the upper opening 154 via an inner space of the inlet wall 155.

One or more first connection ribs 155*a* may be provided along a circumference of the inlet wall 155 to prevent the inlet wall 155 from being deformed while the upper ejector 300 is inserted into the upper opening 154.

The first connection rib 155*a* may connect the inlet wall 155 to the upper tray body 151. For example, the first connection rib 155*a* may be integrated with the circumference of the inlet wall 155 and an outer face of the upper tray body 151.

Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b*.

The water supply guide 156 may be inclined upward from the inlet wall 155 in a direction which is away from the second upper chamber 152*b*.

The upper tray 150 may further include a first accommodation part 160. The heater coupling part 124 of the upper case 120 may be accommodated in the first accommodation part 160.

An upper heater (see reference numeral 148 of FIG. 14) may be provided in the heater coupling part 124. Thus, it may be understood that the upper heater (see reference numeral 148 of FIG. 14) is accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward.

The first accommodation part 160 may be lower than the upper opening 154.

The upper tray 150 may further include a second accommodation part 161 (or referred to as a sensor accommodation part) in which the temperature sensor 500 is accommodated.

For example, the second accommodation part 161 may be provided in the upper tray body 151. Although not limited, the second accommodation part 161 may be provided by recessing a bottom surface of the first accommodation part 160 downward.

Also, the second accommodation part 161 may be disposed between the two upper chambers adjacent to each other. For example, the second accommodation part 161 may be disposed between the first upper chamber 152*a* and the second upper chamber 152*b*.

Thus, an interference between the upper heater (see reference numeral 148 of FIG. 14) accommodated in the first accommodation part 160 and the temperature sensor 500 may be prevented.

In the state in which the temperature sensor 500 is accommodated in the second accommodation part 161, the temperature sensor 500 may contact an outer face of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151.

The horizontal extension part 164 may contact the upper case 120 and the upper support 170.

For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120.

At least a portion of the horizontal extension part 164 may be disposed between the upper case 120 and the upper support 170.

The horizontal extension part 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the upper opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension part 164.

The first upper protrusion 165 and the second upper protrusion 166 may be spaced apart from each other in the direction of the arrow B of FIG. 9. The direction of the arrow B of FIG. 9 may be the same direction as the direction of the arrow B of FIG. 7.

Although not limited, the plurality of first upper protrusions 165 may be arranged to be spaced apart from each other in the direction of the arrow A.

The plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be constructed so that the upper tray 150 and the upper case 120 are coupled to each other, and also, the horizontal extension part is prevented from being deformed during the ice making process or the ice separating process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension parts 264 from being deformed.

For example, the deformation in the horizontal direction of the horizontal extension part 264 may be minimized to prevent the horizontal extension part 264 from being plastic-deformed. If when the horizontal extension part 264 is plastic-deformed, since the upper tray body is not positioned at the correct position during the ice making, the shape of the ice may not close to the spherical shape.

The horizontal extension part 164 may further include a plurality of lower protrusions 167 and 168. The plurality of lower protrusions 167 and 168 may be inserted into a lower slot of the upper support 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude downward from the bottom surface 164*b* of the horizontal extension part 164.

The first lower protrusion 167 may be disposed at an opposite to the first upper protrusion 165 with respect to the horizontal extension part 164. The second lower protrusion 168 may be disposed at an opposite side of the second upper protrusion 166 with respect to the horizontal extension part 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension part 164, the deformation in the horizontal direction of the horizontal extension part 164 may be effectively prevented.

A through-hole 169 through which the coupling boss of the upper support 170, which will be described later, may be provided in the horizontal extension part 164.

For example, a plurality of through-holes 169 may be provided in the horizontal extension part 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

<Upper Support>

Figure 11:
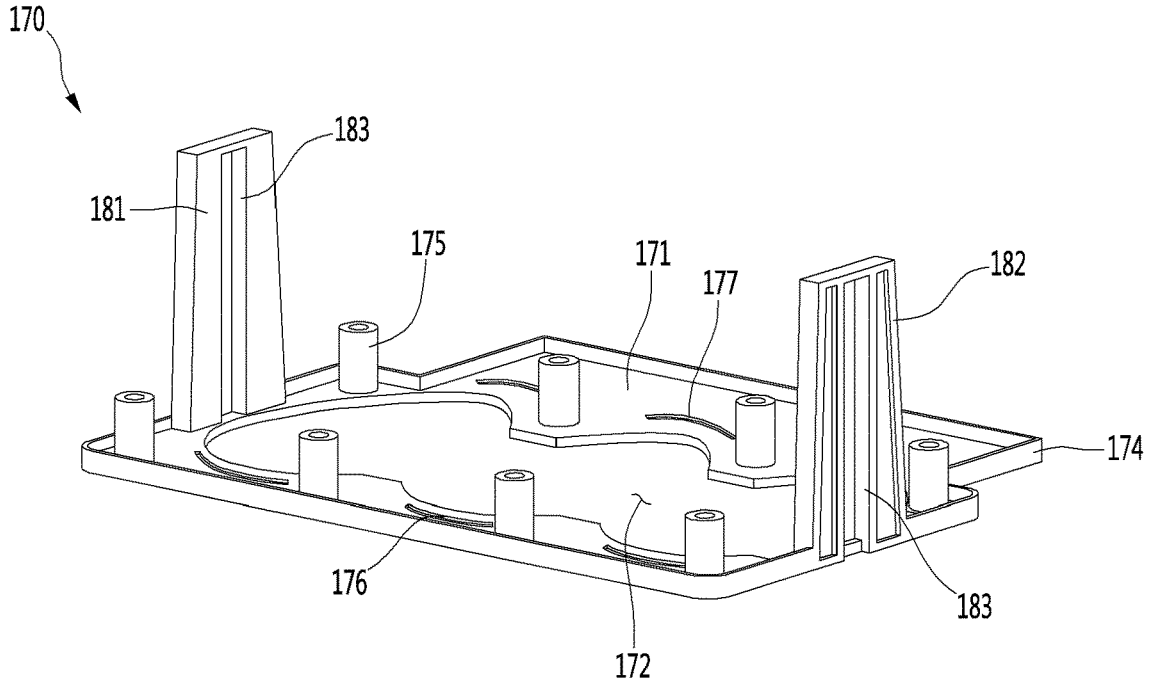
FIG. 11 is a top perspective view of an upper support according to one embodiment of the present disclosure.
Figure 12:
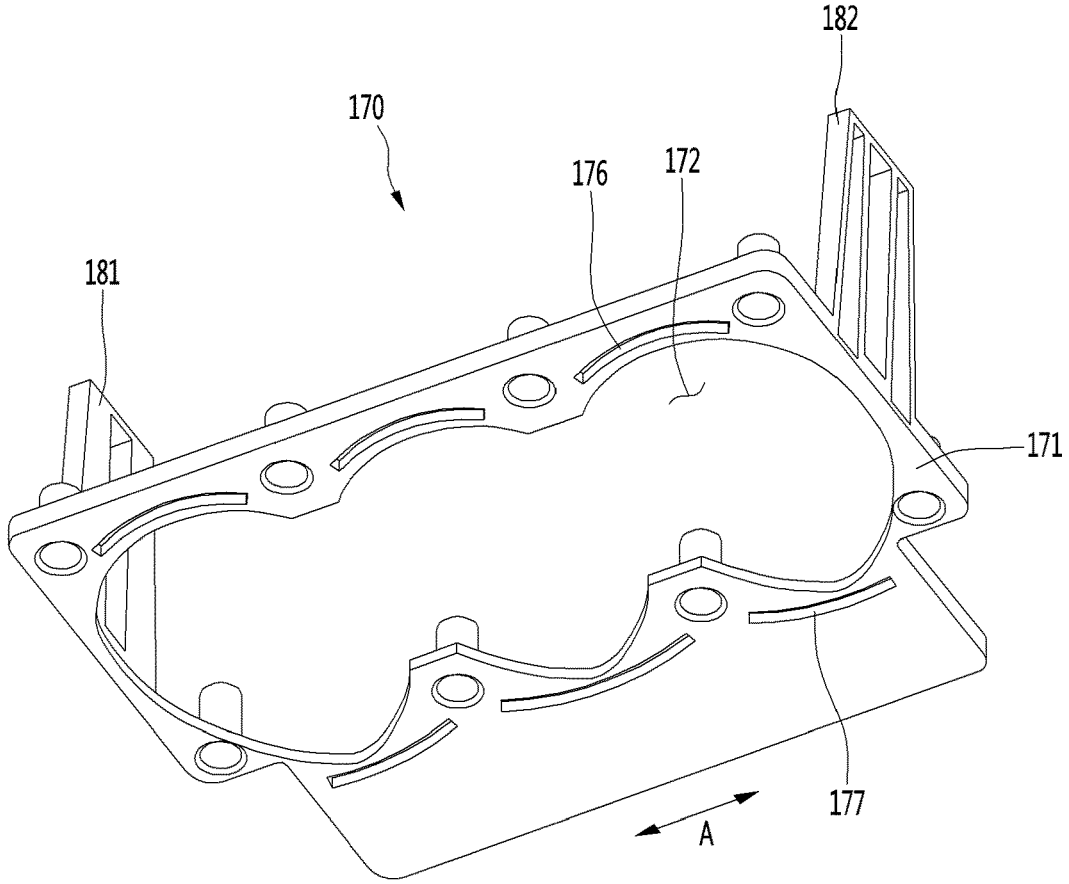
FIG. 12 is a bottom perspective view of an upper support according to one embodiment of the present disclosure.

FIG. 11 is a top perspective view of the upper support according to an embodiment, and FIG. 12 is a bottom perspective view of the upper support according to an embodiment.

Referring to FIGS. 11 and 12, the upper support 170 may include a support plate 171 contacting the upper tray 150.

For example, a top surface of the support plate 171 may contact the bottom surface 164*b* of the horizontal extension part 164 of the upper tray 150.

A plate opening 172 through which the upper tray body 151 passes may be defined in the support plate 171.

A circumferential wall 174 that is bent upward may be provided on an edge of the support plate 171. For example, the circumferential wall 174 may contact at least a portion of a circumference of a side surface of the horizontal extension part 164.

Also, a top surface of the circumferential wall 174 may contact a bottom surface of the upper plate 121.

The support plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The support plate 171 may further include a plurality of coupling bosses 175. The plurality of coupling bosses 175 may protrude upward from the top surface of the support plate 171.

Each of the coupling bosses 175 may pass through the through-hole 169 of the horizontal extension part 164 and be inserted into the sleeve 133 of the upper case 120.

In the state in which the coupling boss 175 is inserted into the sleeve 133, a top surface of the coupling boss 175 may be disposed at the same height as a top surface of the sleeve 133 or disposed at a height lower than that of the top surface of the sleeve 133.

A coupling member coupled to the coupling boss 175 may be, for example, a bolt (see reference symbol B1 of FIG. 3). The bolt B1 may include a body part and a head part having a diameter greater than that of the body part. The bolt B1 may be coupled to the coupling boss 175 from an upper side of the coupling boss 175.

While the body part of the bolt B1 is coupled to the coupling boss 175, when the head part contacts the top surface of the sleeve 133, and the head part contacts the top surface of the sleeve 133 and the top surface of the coupling boss 175, assembling of the upper assembly 110 may be completed.

The upper support 170 may further include a plurality of unit guides 181 and 182 for guiding the connection unit 350 connected to the upper ejector 300.

The plurality of unit guides 181 and 182 may be, for example, disposed to be spaced apart from each other in the direction of the arrow A with respect to FIG. 12.

The unit guides 181 and 182 may extend upward from the top surface of the support plate 171. Each of the unit guides 181 and 182 may be connected to the circumferential wall 174.

Each of the unit guides 181 and 182 may include a guide slot 183 vertically extends.

In a state in which both ends of the ejector body 310 of the upper ejector 300 pass through the guide slot 183, the connection unit 350 is connected to the ejector body 310.

Thus, when the rotation force is transmitted to the ejector body 310 by the connection unit 350 while the lower assembly 200 rotates, the ejector body 310 may vertically move along the guide slot 183.

<Upper Heater Coupling Structure>

Figure 13:
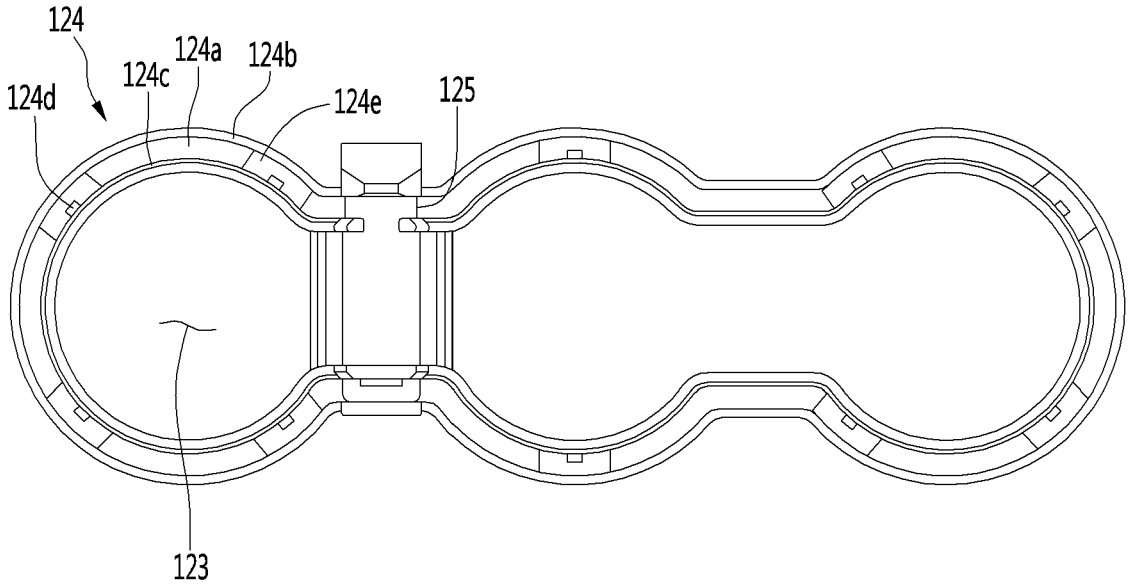
FIG. 13 is an enlarged view showing a heater coupling portion in the upper case of FIG. 6.
Figure 14:
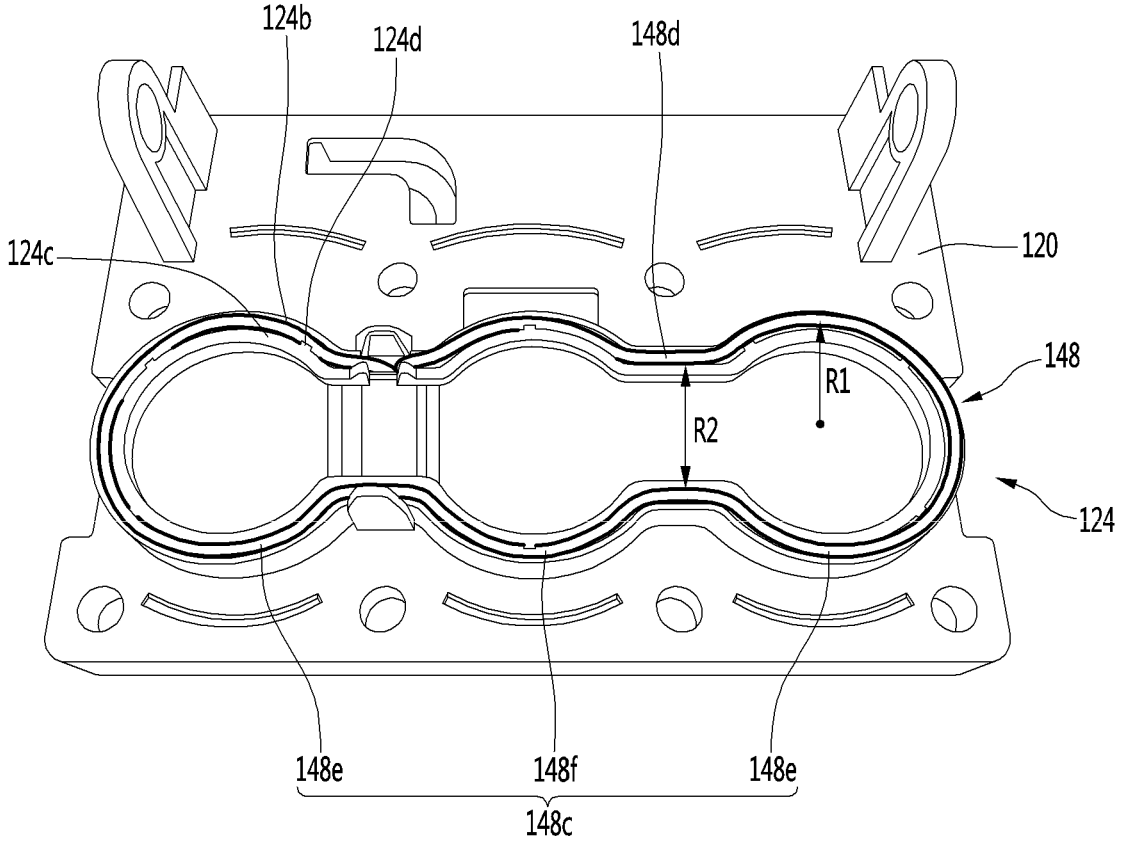
FIG. 14 is a view showing a state in which a heater is coupled to the upper case of FIG. 6.
Figure 15:
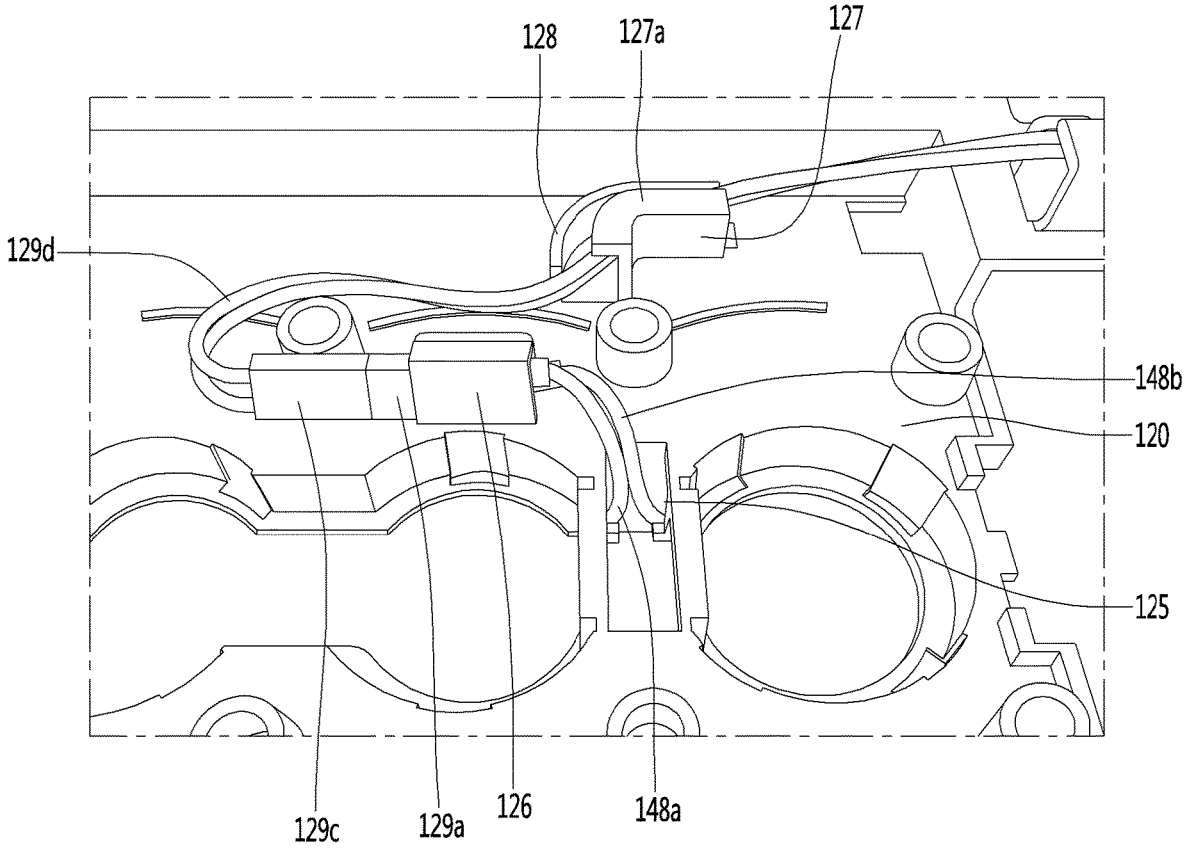
FIG. 15 is a view showing a layout of a wire connected to the heater in the upper case.

FIG. 13 is an enlarged view of the heater coupling part in the upper case of FIG. 6, FIG. 14 is a view illustrating a state in which a heater is coupled to the upper case of FIG. 6, and FIG. 15 is a view illustrating an arrangement of a wire connected to the heater in the upper case.

Referring to FIGS. 9, 13 to 15, the heater coupling part 124 may include a heater accommodation groove 124*a* accommodating the upper heater 148.

For example, the heater accommodation groove 124*a* may be defined by recessing a portion of a bottom surface of the recess 122 of the upper case 120 upward.

The heater accommodation groove 124*a* may extend along a circumference of the opening 123 of the upper case 120.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove 124*a*.

The upper heater 148 may be a DC heater receiving DC power. The upper heater 148 may be turned on to transfer ice.

When heat of the upper heater 148 is transferred to the upper tray 150, ice may be separated from a surface (inner face) of the upper tray 150.

If the upper tray 150 is made of a metal material, and the heat of the upper heater 148 has a high temperature, a portion of the ice, which is heated by the upper heater 148, may be adhered again to the surface of the upper tray after the upper heater 148 is turned off. As a result, the ice may be opaque.

That is, an opaque band having a shape corresponding to the upper heater may be formed around the ice.

However, in this embodiment, since the DC heater having low output is used, and the upper tray 150 is made of the silicone material, an amount of heat transferred to the upper tray 150 may be reduced, and thus, the upper tray itself may have low thermal conductivity.

Thus, the heat may not be concentrated into the local portion of the ice, and a small amount of heat may be slowly applied to prevent the opaque band from being formed around the ice because the ice is effectively separated from the upper tray.

The upper heater 148 may be disposed to surround the circumference of each of the plurality of upper chambers 152 so that the heat of the upper heater 148 is uniformly transferred to the plurality of upper chambers 152 of the upper tray 150.

Also, the upper heater 148 may contact the circumference of each of the chamber walls 153 respectively defining the plurality of upper chambers 152. Here, the upper heater 148 may be disposed at a position that is lower than that of the upper opening 154.

Since the heater accommodation groove 124*a* is recessed from the recess 122, the heater accommodation groove 124*a* may be defined by an outer wall 124*b* and an inner wall 124*c*.

The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*.

Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on at least one of the outer wall 124*b* and the inner wall 124*c* to prevent the upper heater 148 accommodated in the heater accommodation groove 124*a* from being separated from the heater accommodation groove 124*a*.

In FIG. 13, for example, a plurality of separation prevention protrusions 124*d* are provided on the inner wall 124*c*.

The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*.

As illustrated in FIG. 14, in the state in which the upper heater 148 is accommodated in the heater accommodation groove 124*a*, the upper heater 148 may be divided into an upper round portion 148*c* and a linear portion 148*d*.

That is, the heater accommodation groove 124*a* may include an upper round portion and an upper linear portion. Thus, the upper heater 148 may be divided into the upper round portion 148*c* and the upper linear portion 148*d* to correspond to the upper round portion and the linear portion of the heater accommodation groove 124*a*.

The upper round portion 148*c* may be a portion disposed along the circumference of the upper chamber 152 and also a portion that is bent to be rounded in a horizontal direction.

The upper round portion 184*c* may comprise a first upper round portion 148*e* corresponding to first and third 152*a*, 152*c* of both sides of an outermost section among a plurality of upper chambers 152.

The first upper round portion 148*e* may be connected by a pair of upper linear portions 148*d*. That is, the pair of upper linear portions 148*d* each may be connected to both ends of one first upper round portion 148*e*.

A length of the first rounded portion 148*e* is longer than lengths of each of the pair of upper linear portions 148*d*. The pair of upper linear portions 148*d* connected to both ends of the first upper round portion 148*e* may be disposed substantially in parallel.

A distance (R2) between the pair of upper linear portions 148*d* is smaller than double (2*R1) in a radius of curvature of the first upper round portion (148*e*).

As the distance (R2) between the pair of upper linear portions 148*d* gets longer, the pair of upper linear portions 148*d* moves away from the upper chamber 152, and accordingly, it takes a long time to transfer the heat of the pair of upper linear portions 148*d* to the upper chamber 152.

However, according to this embodiment, since the distance (R2) between the pair of upper linear portions 148*d* is smaller than double in a radius of curvature of the first upper round portion 148*e*, an interval between the pair of upper linear portions 148*d* and the upper chamber 152 may be reduced to rapidly transfer the heat of the upper linear portion 148*d* to the upper chamber 152.

The distance (R2) between the pair of upper linear portions 148*d* may be equal to or larger than a radius of curvature (R1) of the first upper round portion 148*e*.

As the distance (R2) between the pair of upper linear portions 148*d* is reduced, there is a large degree of bending in a boundary between the pair of upper linear portions 148*d* and the first upper round portion 148*e*, thereby providing a lot of concern for a disconnection, and also, heat between two upper chambers that are adjacent to each other may be unnecessary concentrated.

However, according to this embodiment, if the distance (R2) between the pair of upper linear portions 148*d* is equal to or larger than the radius of curvature (R1) of the first upper round portion 148*e*, the above-described problem can be prevented.

The upper round portion 148*c* may further comprise a second upper round portion 148*f* corresponding to the second upper chamber 152*b* disposed between first and third upper chambers 152*a*, 152*c* at both sides of an outermost section among the plurality of upper chambers 152.

As an example, a pair of second upper round portions 148*f* may be spaced apart from each other. This is because each of the pair of second upper round portions 148*f* has to be connected to the first upper round portion 148*e* by the upper linear part 148*d* of both sides.

A length of the second upper round portion 148*f* may be shorter than a length of the first upper round portion 148*e*. The upper linear portions 148*d* at both sides of the second upper round portion 148*f* may be connected.

The upper liner portion 148*d* may be a portion connecting the upper round portions 148*c* corresponding to the upper chambers 152 to each other.

Since the upper heater 148 is disposed at a position lower than that of the upper opening 154, a line connecting two points of the upper round portions, which are spaced apart from each other, to each other may pass through upper chamber 152.

Since the upper round portion 148*c* of the upper heater 148 may be separated from the heater accommodation groove 124*a*, the separation prevention protrusion 124*d* may be disposed to contact the upper round portion 148*c*.

A through-opening 124*e* may be defined in a bottom surface of the heater accommodation groove 124*a*. When the upper heater 148 is accommodated in the heater accommodation groove 124*a*, a portion of the upper heater 148 may be disposed in the through-opening 124*e*. For example, the through-opening 124*e* may be defined in a portion of the upper heater 148 facing the separation prevention protrusion 124*d*.

When the upper heater 148 is bent to be horizontally rounded, tension of the upper heater 148 may increase to cause disconnection, and also, the upper heater 148 may be separated from the heater accommodation groove 124*a*.

However, when the through-opening 124*e* is defined in the heater accommodation groove 124*a* like this embodiment, a portion of the upper heater 148 may be disposed in the through-opening 124*e* to reduce the tension of the upper heater 148, thereby preventing the heater accommodation groove 124*a* from being separated from the upper heater 148.

As illustrated in FIG. 15, in a state in which a power input terminal 148*a* and a power output terminal 148*b* of the upper heater 148 are disposed in parallel to each other, the upper heater 148 may pass through a heater through-hole 125 defined in the upper case 120.

Since the upper heater 148 is accommodated from a lower side of the upper case 120, the power input terminal 148*a* and the power output terminal 148*b* of the upper heater 148 may extend upward to pass through the heater through-hole 125.

The power input terminal 148*a* and the power output terminal 148*b* passing through the heater through-hole 125 may be connected to one first connector 129*a*.

Also, a second connector 129*c* to which two wires 129*d* connected to correspond to the power input terminal 148*a* and the power output terminal 148*b* are connected may be connected to the first connector 129*a*.

A first guide part 126 guiding the upper heater 148, the first connector 129*a*, the second connector 129*c*, and the wire 129*d* may be provided on the upper plate 121 of the upper case 120.

In FIG. 15, for example, a structure in which the first guide part 126 guides the first connector 129*a* is illustrated.

The first guide part 126 may extend upward from the top surface of the upper plate 121 and have an upper end that is bent in the horizontal direction.

Thus, the upper bent portion of the first guide part 126 may limit upward movement of the first connector 126.

The wire 129*d* may be led out to the outside of the upper case 120 after being bent in an approximately "U" shape to prevent interference with the surrounding structure.

Since the wire 129*d* is bent at least once, the upper case 120 may further include wire guides 127 and 128 for fixing a position of the wire 129*d*.

The wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage of the wire 129*d* to be bent.

That is, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

Figure 16:
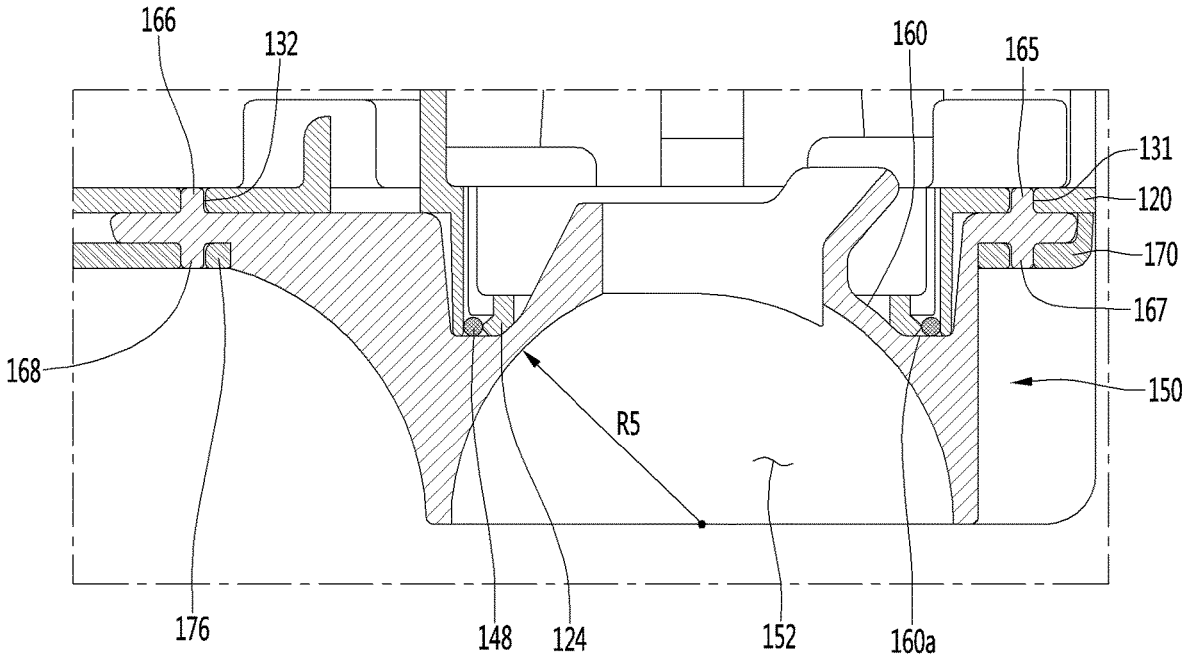
FIG. 16 is a sectional view showing a state in which the upper assembly has been assembled.

FIG. 16 is a cross-sectional view illustrating a state in which an upper assembly is assembled.

Referring to FIGS. 14 and 16, in the state in which the upper heater 148 is coupled to the heater coupling part 124 of the upper case 120, the upper case 120, the upper tray 150, and the upper support 170 may be coupled to each other.

The first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper support 170, and the second lower protrusion 168 of the upper tray 150 may be inserted into the second lower slot 177 of the upper support 170.

Thus, the coupling boss 175 of the upper support 170 may pass through the through-hole of the upper tray 150 and then be accommodated in the sleeve 133 of the upper case 120. In this state, the bolt B1 may be coupled to the coupling boss 175 from an upper side of the coupling boss 175.

In the state in which the bolt B1 is coupled to the coupling boss 175, the head part of the bolt B1 may be disposed at a position higher than that of the upper plate 121.

On the other hand, since the hinge supports 135 and 136 are disposed lower than the upper plate 121, while the lower assembly 200 rotates, the upper assembly 110 or the connection unit 350 may be prevented from interfering with the head part of the bolt B1.

While the upper assembly 110 is assembled, a plurality of unit guides 181 and 182 of the upper support 170 may protrude upward from the upper plate 121 through the through-opening (see reference numerals 139*a* and 139*b* of FIG. 6) defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling part 124 to which the upper heater 148 is coupled may be accommodated in the first accommodation part 160 of the upper tray 150.

In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the upper round portion 148*c* of the upper heater 148 may vertically overlap the upper chamber 152.

As an example, the radius of curvature (R1) of the upper round portion 148*c* is smaller than a radius of the upper chamber 152.

<Lower Case>

Figure 17:
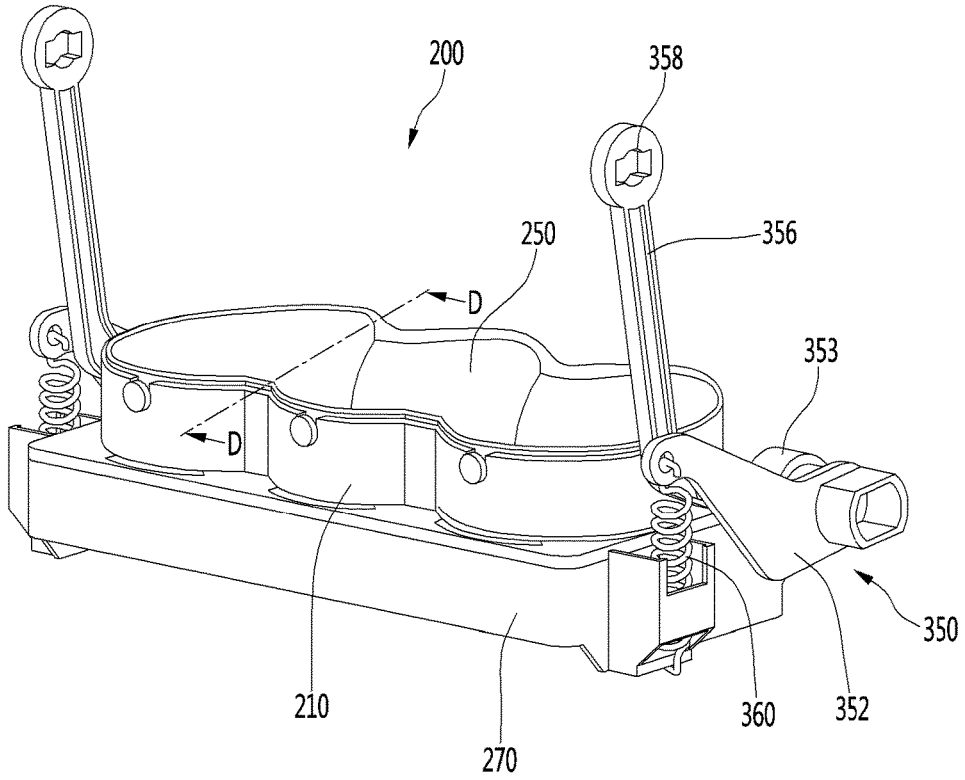
FIG. 17 is a perspective view of a lower assembly according to one embodiment of the present disclosure.
Figure 18:
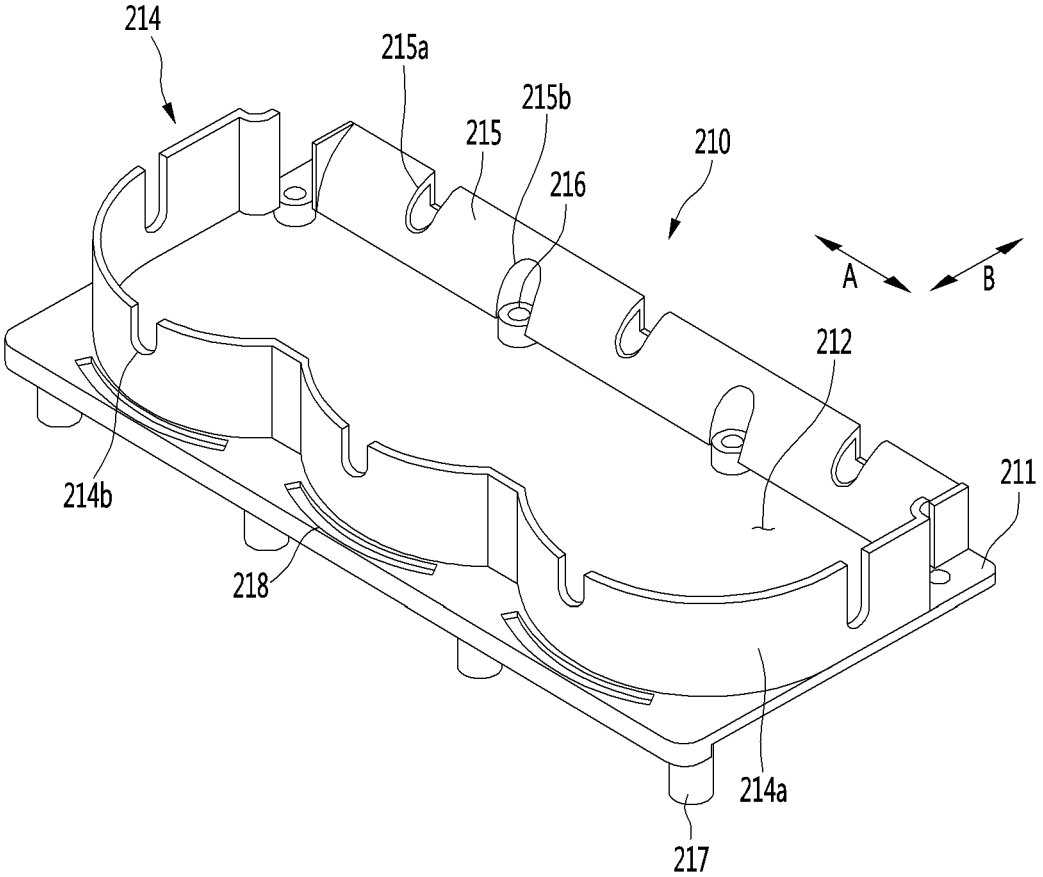
FIG. 18 is a top perspective view of a lower case according to one embodiment of the present disclosure.
Figure 19:
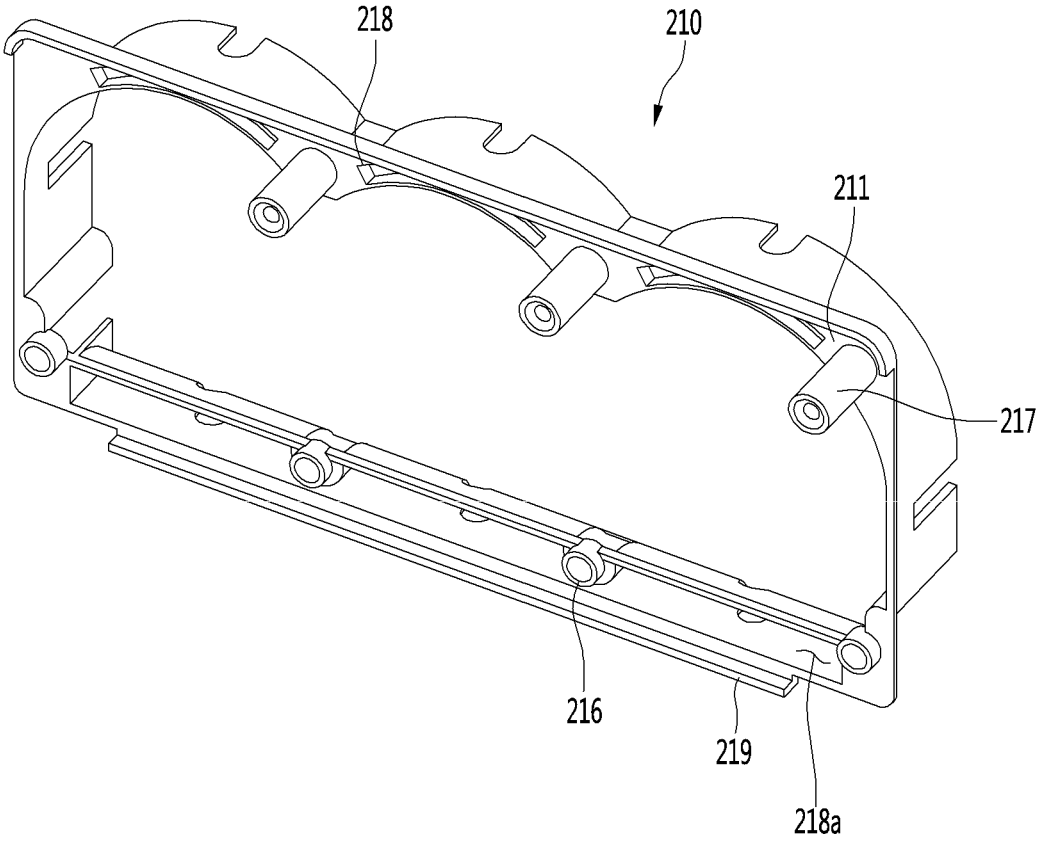
FIG. 19 is a bottom perspective view of a lower case according to one embodiment of the present disclosure.

FIG. 17 is a perspective view of a lower assembly according to an embodiment, FIG. 18 is a top perspective view of a lower case according to an embodiment, and FIG. 19 is a bottom perspective view of the lower case according to an embodiment.

Referring to FIGS. 17 to 19, the lower assembly 200 may include a lower tray 250. The lower tray 250 defines the ice chamber 121 together with the upper tray 150.

The lower assembly 200 may further include a lower support 270 that supports the lower tray 250. The lower support 270 and the lower tray 250 may rotate together while the lower tray 250 is seated on the lower support 270.

The lower assembly 200 may further include a lower case 210 for fixing a position of the lower tray 250.

The lower case 210 may surround the circumference of the lower tray 250, and the lower support 270 may support the lower tray 250.

The connection unit 350 may be coupled to the lower support 270.

The connection unit 350 may include a first link 352 that receives power of the driving unit 180 to allow the lower support 270 to rotate and a second link 356 connected to the lower support 270 to transmit rotation force of the lower support 270 to the upper ejector 300 when the lower support 270 rotates.

The first link 352 and the lower support 270 may be connected to each other by an elastic member 360. For example, the elastic member 360 may be a coil spring.

The elastic member 360 may have one end connected to the first link 362 and the other end connected to the lower support 270.

The elastic member 360 provide elastic force to the lower support 270 so that contact between the upper tray 150 and the lower tray 250 is maintained.

In this embodiment, the first link 352 and the second link 356 may be disposed on both sides of the lower support 270, respectively.

One of the two first links may be connected to the driving unit 180 to receive the rotation force from the driving unit 180.

The two first links 352 may be connected to each other by a connection shaft (see reference numeral 370 of FIG. 5).

A hole 358 through which the ejector body 310 of the upper ejector 300 passes may be defined in an upper end of the second link 356.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state in which the lower tray 250 is disposed below the lower plate 211, a portion of the lower tray 250 may protrude upward from the lower plate 211 through the opening 212.

The lower case 210 may further include a circumferential wall 214 surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to the lower tray 250.

The second coupling slit 215*a* may be defined by recessing an upper end of the curved wall 215 downward.

The lower case 210 may further include a first coupling boss 216 and a second coupling boss 217.

The first coupling boss 216 may protrude downward from the bottom surface of the lower plate 211. For example, the plurality of first coupling bosses 216 may protrude downward from the lower plate 211.

The plurality of first coupling bosses 216 may be arranged to be spaced apart from each other in the direction of the arrow A with respect to FIG. 17.

The second coupling boss 217 may protrude downward from the bottom surface of the lower plate 211. For example, the plurality of second coupling bosses 217 may protrude from the lower plate 211. The plurality of first coupling bosses 217 may be arranged to be spaced apart from each other in the direction of the arrow A with respect to FIG. 17.

The first coupling boss 216 and the second coupling boss 217 may be disposed to be spaced apart from each other in the direction of the arrow B.

In this embodiment, a length of the first coupling boss 216 and a length of the second coupling boss 217 may be different from each other. For example, the first coupling boss 216 may have a length less than that of the second coupling boss 217.

The first coupling member may be coupled to the first coupling boss 216 at an upper portion of the first coupling boss 216. On the other hand, the second coupling member may be coupled to the second coupling boss 217 at a lower portion of the second coupling boss 217.

A groove 215*b* for movement of the coupling member may be defined in the curved wall 215 to prevent the first coupling member from interfering with the curved wall 215 while the first coupling member is coupled to the first coupling boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 18. Each of the slots 218 may have a curved shape.

The lower case 210 may further include an accommodation groove 218*a* into which a portion of the lower tray 250 is inserted.

The accommodation groove 218*a* may be defined by recessing a portion of the lower tray 211 toward the curved wall 215.

The lower case 210 may further include an extension wall 219 contacting a portion of the circumference of the side surface of the lower plate 212 in the state of being coupled to the lower tray 250. The extension wall 219 may linearly extend in the direction of the arrow A.

<Lower Tray>

Figure 20:
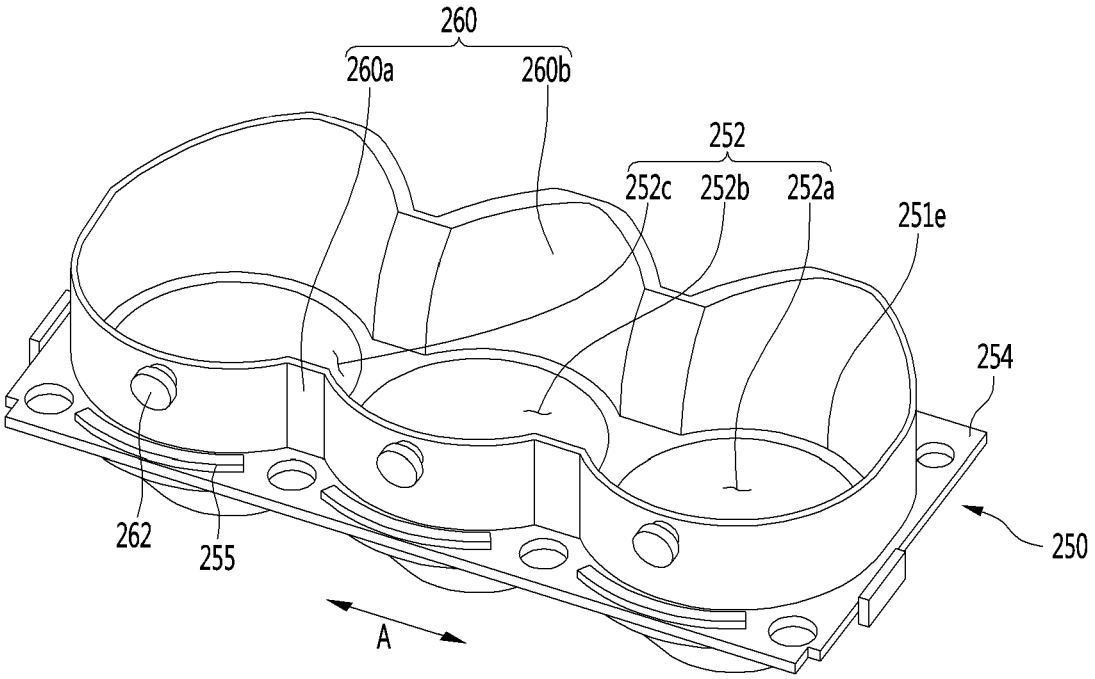
FIG. 20 is a top perspective view of a lower tray according to one embodiment of the present disclosure.
Figure 21:
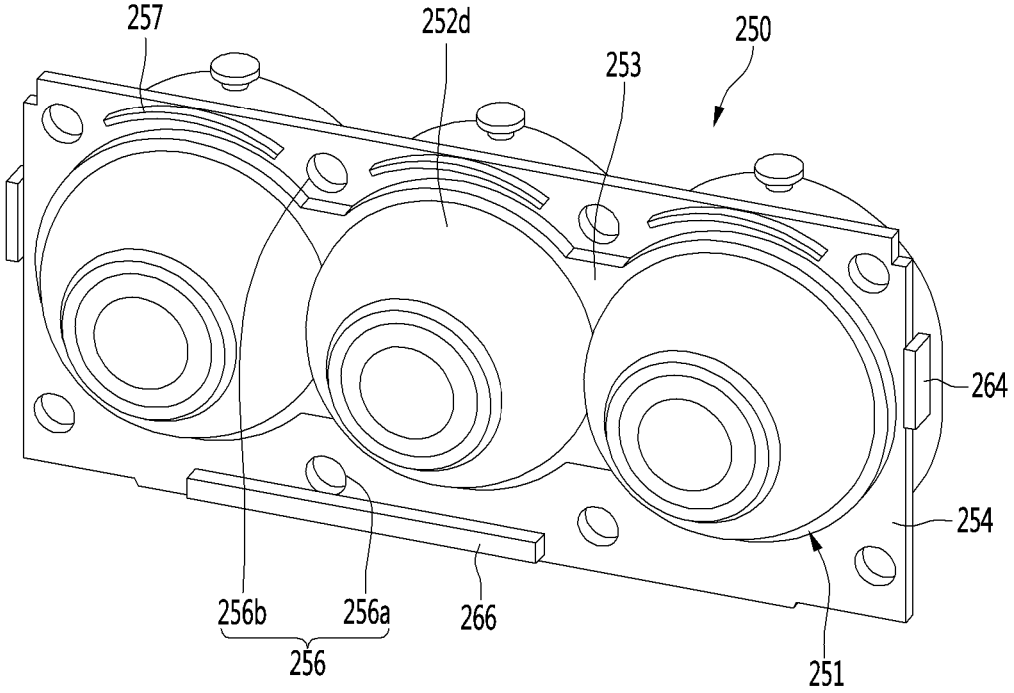
FIG. 21 and FIG. 22 are bottom perspective views of a lower tray according to one embodiment of the present disclosure.
Figure 22:
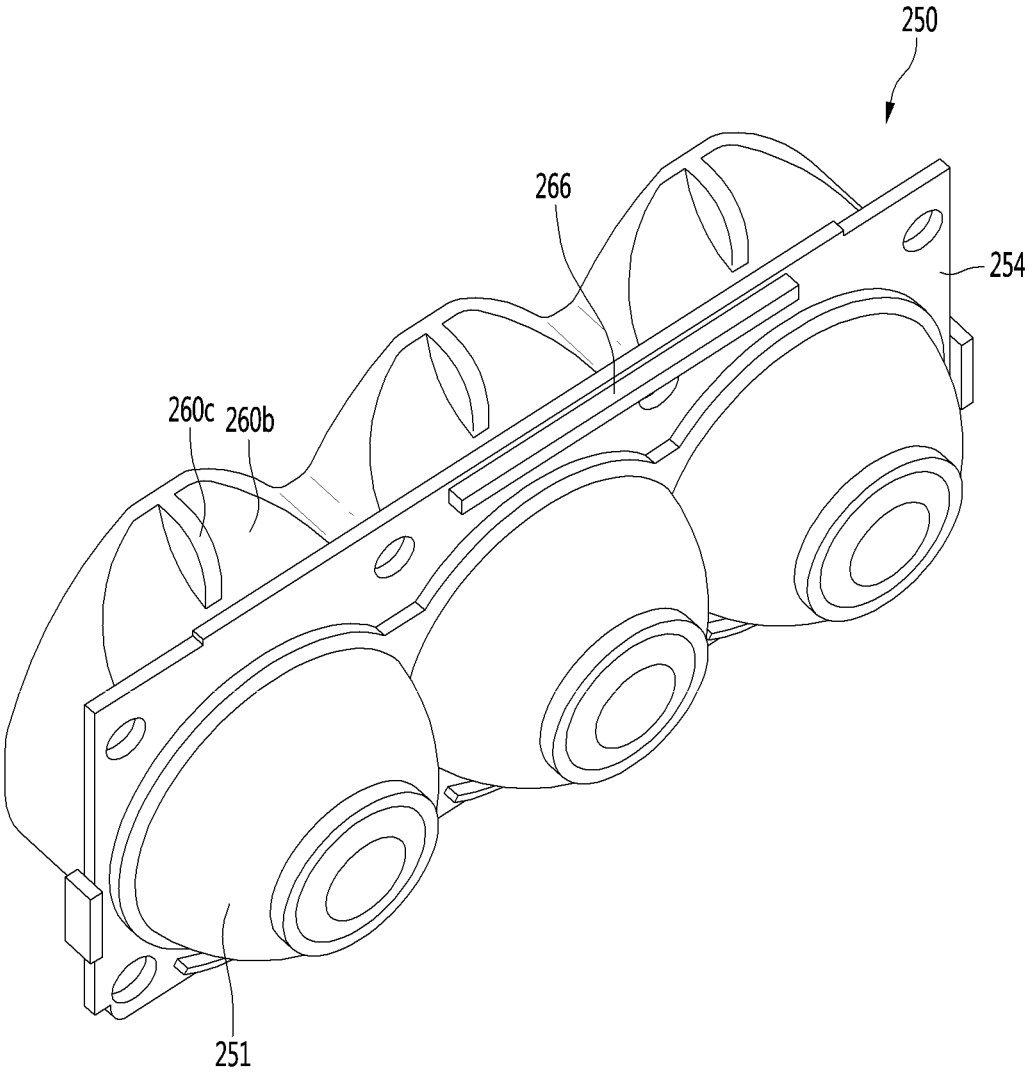
Figure 23:
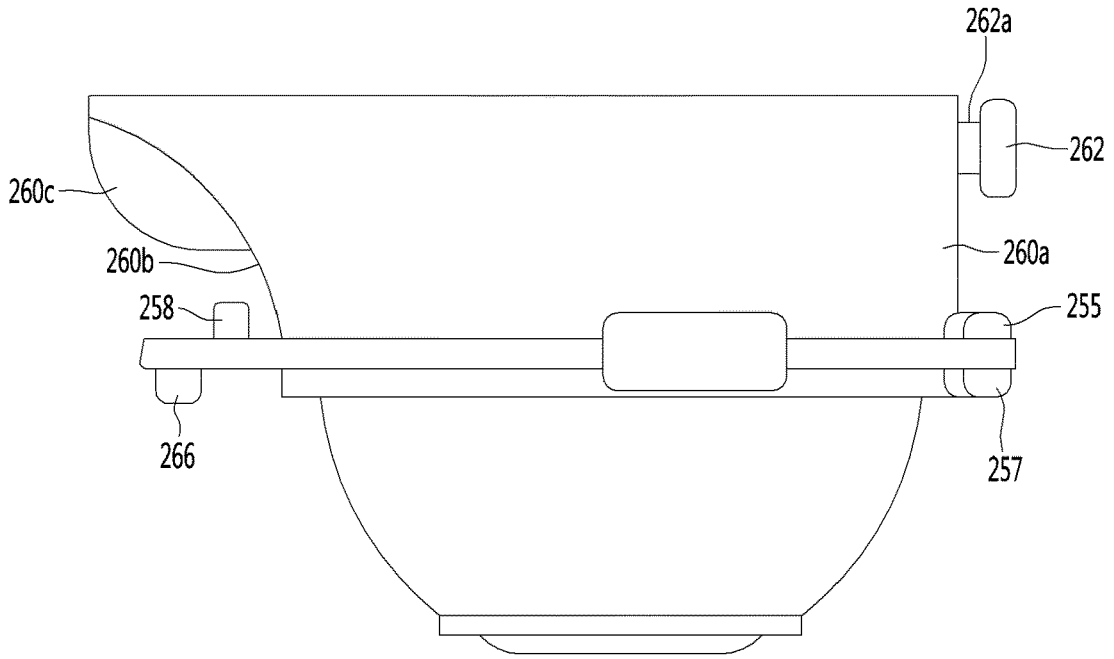
FIG. 23 is a side elevation view of a lower tray according to one embodiment of the present disclosure.

FIG. 20 is a top perspective view of the lower tray according to an embodiment, FIGS. 21 and 22 are bottom perspective views of the lower tray according to an embodiment, and FIG. 23 is a side view of the lower tray according to an embodiment.

Referring to FIGS. 20 to 23, the lower tray 250 may be made of a flexible material that is capable of being restored to its original shape after being deformed by an external force.

For example, the lower tray 250 may be made of a silicone material. Like this embodiment, when the lower tray 250 is made of a silicone material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicone material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may be define a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 20.

Accordingly, the lower chamber 252 may have a hemispherical shape or a shape similar to the hemispherical shape. That is, a lower portion of the spherical ice may be made by the lower chamber 252.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extended upward from an upper surface of the first extension part 253.

In this embodiment, since the first extension part 253 extends from the lower tray 250 and the circumferential wall 260 extends from the first extension part 253, a bottom surface of the upper tray body 151 may contact a top surface 251*e* of the lower tray body 251.

The circumferential wall 260 may surround the upper tray body 251 seated on the top surface 251*e* of the lower tray body 251.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260.

The second extension part 254 may be disposed higher than the first extension part 253. Thus, the first extension part 253 and the second extension part 254 may be stepped with respect to each other.

The second extension part 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension part 254 at a position adjacent to the first wall 260*a*.

Although not limited, a plurality of first upper protrusions 255 may be arranged to be spaced apart from each other in the direction of the arrow A with respect to FIG. 20. The first upper protrusion 255 may extend, for example, in a curved shape. That is, the first upper protrusion 255 is curved in a horizontal direction.

The second extension part 254 may include a first lower protrusion 257 inserted into a protrusion groove of the lower case 270, which will be described later. The first lower protrusion 257 may protrude downward from a bottom surface of the second extension part 254.

Although not limited, the plurality of first lower protrusions 257 may be arranged to be spaced apart from each other in the direction of arrow A.

That is, the first lower protrusion 257 is curved in a horizontal direction.

The first upper protrusion 255 and the first lower protrusion 257 may be disposed at opposite sides with respect to a vertical direction of the second extension part 254. At least a portion of the first upper protrusion 255 may vertically overlap the second lower protrusion 257.

A plurality of through-holes may be defined in the second extension part 254.

The plurality of through-holes 256 may include a first through-hole 256*a* through which the first coupling boss 216 of the lower case 210 passes and a second through-hole 256*b* through which the second coupling boss 217 of the lower case 210 passes.

For example, the plurality of through-holes 256*a* may be defined to be spaced apart from each other in the direction of the arrow A of FIG. 20.

Also, the plurality of second through-holes 256*b* may be disposed to be spaced apart from each other in the direction of the arrow A of FIG. 20.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension part 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension part 254 at a position adjacent to the second wall 260*b*.

Although not limited, the plurality of second upper protrusions 258 may be arranged to be spaced apart from each other in the direction of the arrow A of FIG. 20.

The second upper protrusion 258 may be accommodated in the accommodation groove 218*a* of the lower case 210. In the state in which the second upper protrusion 258 is accommodated in the accommodation groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck part 262*a* having a relatively less diameter when compared to those of other portions. The neck part 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*a* of the circumferential wall 260. The second coupling protrusion 262*c* is positioned lower than a top end of the circumferential wall 260.

The second coupling protrusion 260*c* may be inserted into a second coupling slit 215*a* defined in the circumferential wall 214 of the lower case 210.

The second extension part 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension part 254. For example, the second lower protrusion 266 may linearly extend.

A portion of the plurality of first through-holes 256*a* may be defined between the second lower protrusion 266 and the lower chamber 252.

The second lower protrusion 266 may be accommodated in a guide groove defined in the lower support 270, which will be described later.

The second extension part 254 may further a side restriction part 264. The side restriction part 264 restricts horizontal movement of the lower tray 250 in the state in which the lower tray 250 is coupled to the lower case 210 and the lower support 270.

The side restriction part 264 laterally protrudes from the second extension part 254 and has a vertical length greater than a thickness of the second extension part 254. For example, one portion of the side restriction part 264 may be disposed higher than the top surface of the second extension part 254, and the other portion of the side restriction part 264 may be disposed lower than the bottom surface of the second extension part 254.

Thus, the one portion of the side restriction part 264 may contact a side surface of the lower case 210, and the other portion may contact a side surface of the lower support 270. In one example, the lower tray body 251 may has a heater contact portion 251*a* which the lower heater 296 contacts. In one example, the heater contact portion 251*a* may be formed on each of the chamber walls 252*d*. The heater contact portion 251*a* may protrude from the respective chamber wall 252*d*. In one example, the heater contact portion 251*a* may be formed in a circular ring shape.

<Lower Support>

Figure 24:
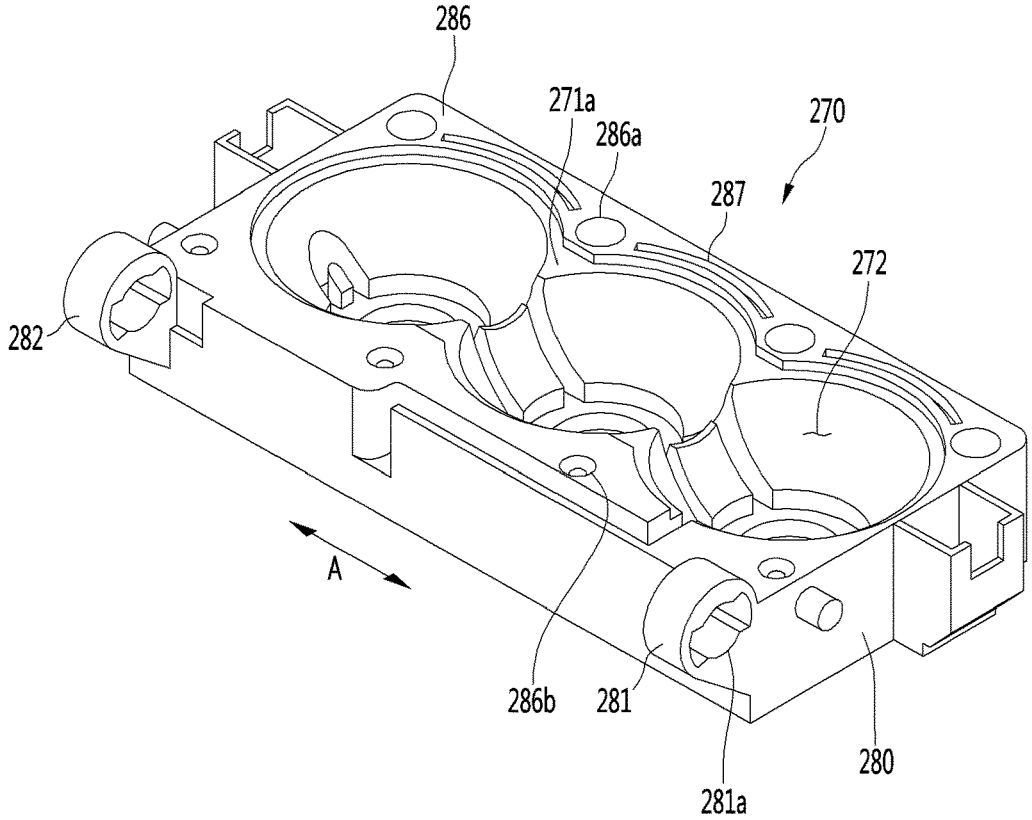
FIG. 24 is a top perspective view of a lower support according to one embodiment of the present disclosure.
Figure 25:
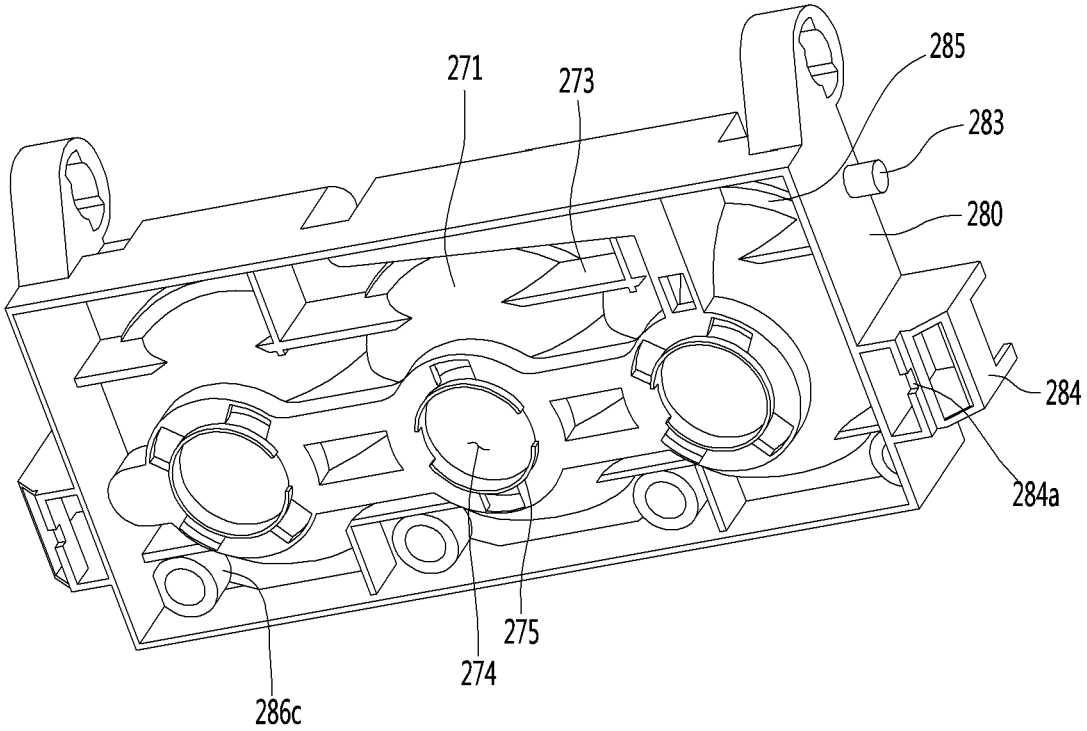
FIG. 25 is a bottom perspective view of a lower support according to one embodiment of the present disclosure.
Figure 26:
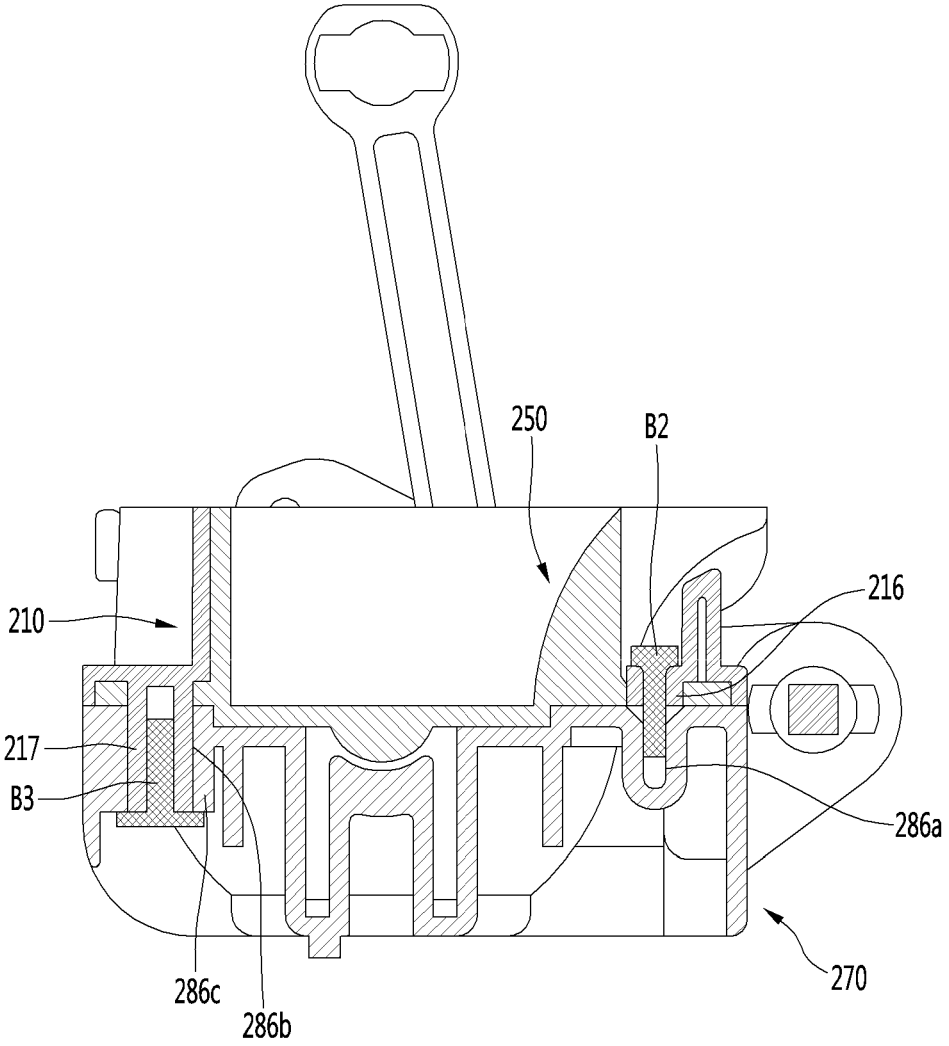
FIG. 26 is a cross-sectional view taken along line D-D of FIG. 17 for showing a state that a lower assembly is assembled.

FIG. 24 is a top perspective view of the lower support according to an embodiment, FIG. 25 is a bottom perspective view of the lower support according to an embodiment, and FIG. 26 is a cross-sectional view taken along line D-D of FIG. 17 for showing a state that a lower assembly is assembled.

Referring to FIGS. 24 to 26, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

A reinforcement rib 275 reinforcing strength may be disposed along a circumference of the lower opening 274.

Also, the adjacent two accommodation part 272 of the three accommodation parts 272 may be connected to each other by a connection rib 273. The connection rib 273 may reinforce strength of the chamber wells 252*d*.

The lower support 270 may further include a first extension wall 285 horizontally extending from an upper end of the support body 271.

The lower support 270 may further include a second extension wall 286 that is formed to be stepped with respect to the first extension wall 285 on an edge of the first extension wall 285.

A top surface of the second extension wall 286 may be disposed higher than the first extension wall 285.

The first extension part 253 of the lower tray 250 may be seated on a top surface 271*a* of the support body 271, and the second extension part 285 may surround side surface of the first extension part 253 of the lower tray 250. Here, the second extension wall 286 may contact the side surface of the first extension part 253 of the lower tray 250.

The lower support 270 may further include a first protrusion groove 287 accommodating the first lower protrusion 257 of the lower tray 250.

The first protrusion groove 287 may extend in a curved shape. The first protrusion groove 287 may be defined, for example, in a second extension wall 286.

The lower support 270 may further include a first coupling groove 286*a* to which a first coupling member B2 passing through the first coupling boss 216 of the upper case 210 is coupled.

The first coupling groove 286*a* may be provided, for example, in the second extension wall 286.

The plurality of first coupling grooves 286*a* may be disposed to be spaced apart from each other in the direction of the arrow A in the second extension wall 286. A portion of the plurality of first coupling grooves 286*a* may be defined between the adjacent two first protrusion grooves 287.

The lower support 270 may further include a boss through-hole 286*b* through which the second coupling boss 217 of the upper case 210 passes.

The boss through-hole 286*b* may be provided, for example, in the second extension wall 286. A sleeve 286*c* surrounding the second coupling boss 217 passing through the boss through-hole 286*b* may be disposed on the second extension wall 286. The sleeve 286*c* may have a cylindrical shape with an opened lower portion.

The first coupling member B2 may be coupled to the first coupling groove 286*a* after passing through the first coupling boss 216 from an upper side of the lower case 210.

The second coupling member B3 may be coupled to the second coupling boss 217 from a lower side of the lower support 270.

The sleeve 286*c* may have a lower end that is disposed at the same height as a lower end of the second coupling boss 217 or disposed at a height lower than that of the lower end of the second coupling boss 217.

Thus, while the second coupling member B3 is coupled, the head part of the second coupling member B3 may contact bottom surfaces of the second coupling boss 217 and the sleeve 286*c* or may contact a bottom surface of the sleeve 286*c*.

The lower support 270 may further include an outer wall 280 disposed to surround the lower tray body 251 in a state of being spaced outward from the outside of the lower tray body 251.

The outer wall 280 may, for example, extend downward along an edge of the second extension wall 286.

The lower support 270 may further include a plurality of hinge bodies 281 and 282 respectively connected to hinge supports 135 and 136 of the upper case 210.

The plurality of hinge bodies 281 and 282 may be disposed to be spaced apart from each other in a direction of an arrow A of FIG. 24. Each of the hinge bodies 281 and 282 may further include a second hinge hole 281*a*.

The shaft connection part 353 of the first link 352 may pass through the second hinge hole 281. The connection shaft 370 may be connected to the shaft connection part 353.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

Also, the lower support 270 may further include an elastic member coupling part 284 to which the elastic member 360 is coupled. The elastic member coupling part 284 may define a space in which a portion of the elastic member 360 is accommodated. Since the elastic member 360 is accommodated in the elastic member coupling part 284 to prevent the elastic member 360 from interfering with the surrounding structure.

Also, the elastic member coupling part 284 may include a hook part 284*a* on which a lower end of the elastic member 370 is hooked.

<Coupling Structure of Lower Heater>

Figure 27:
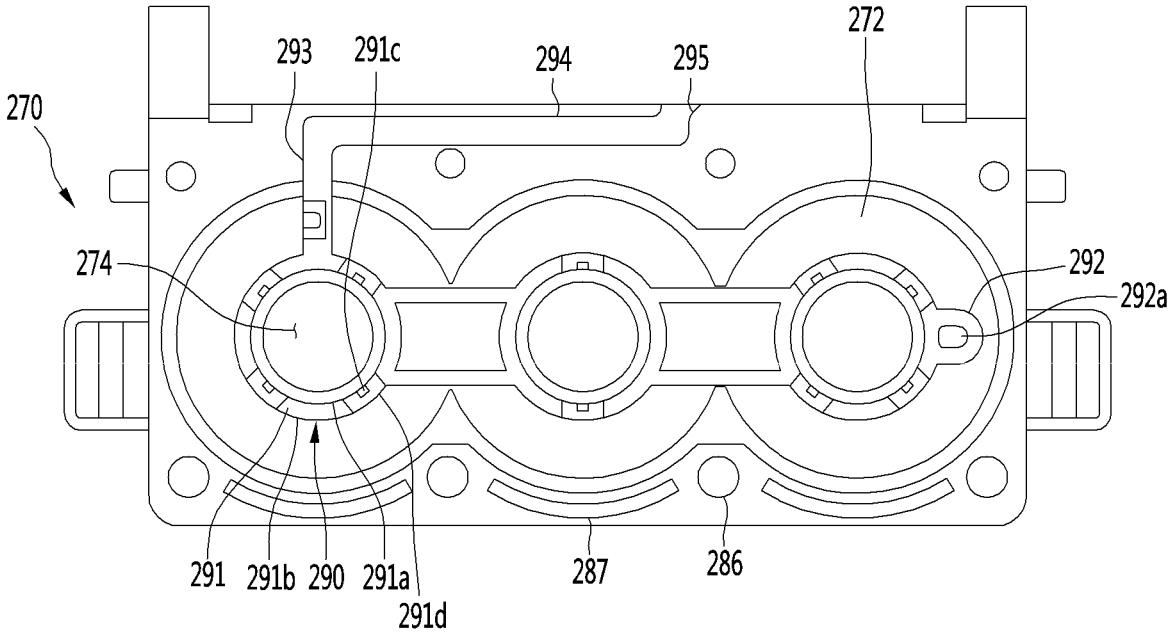
FIG. 27 is a plan view of a lower support according to one embodiment of the present disclosure.
Figure 28:
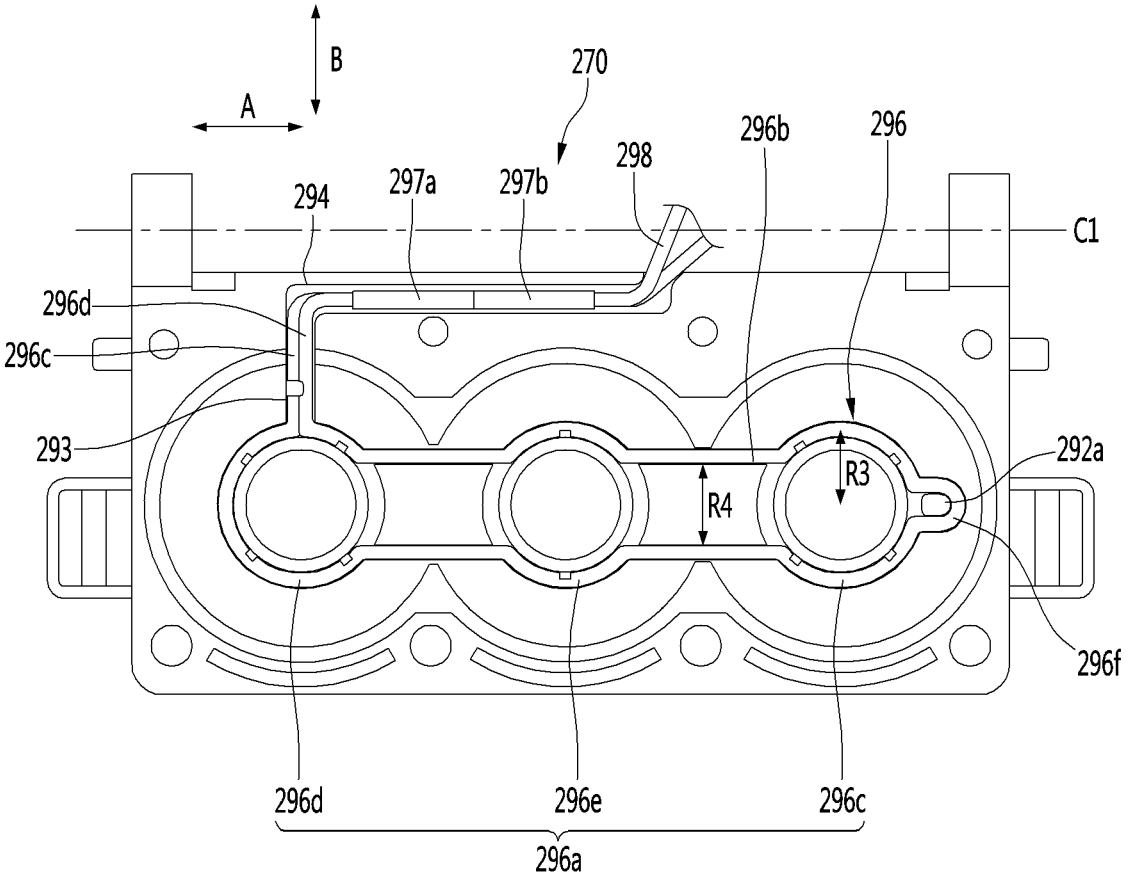
FIG. 28 is a perspective view showing a state in which a lower heater is coupled to a lower support of FIG. 27.
Figure 29:
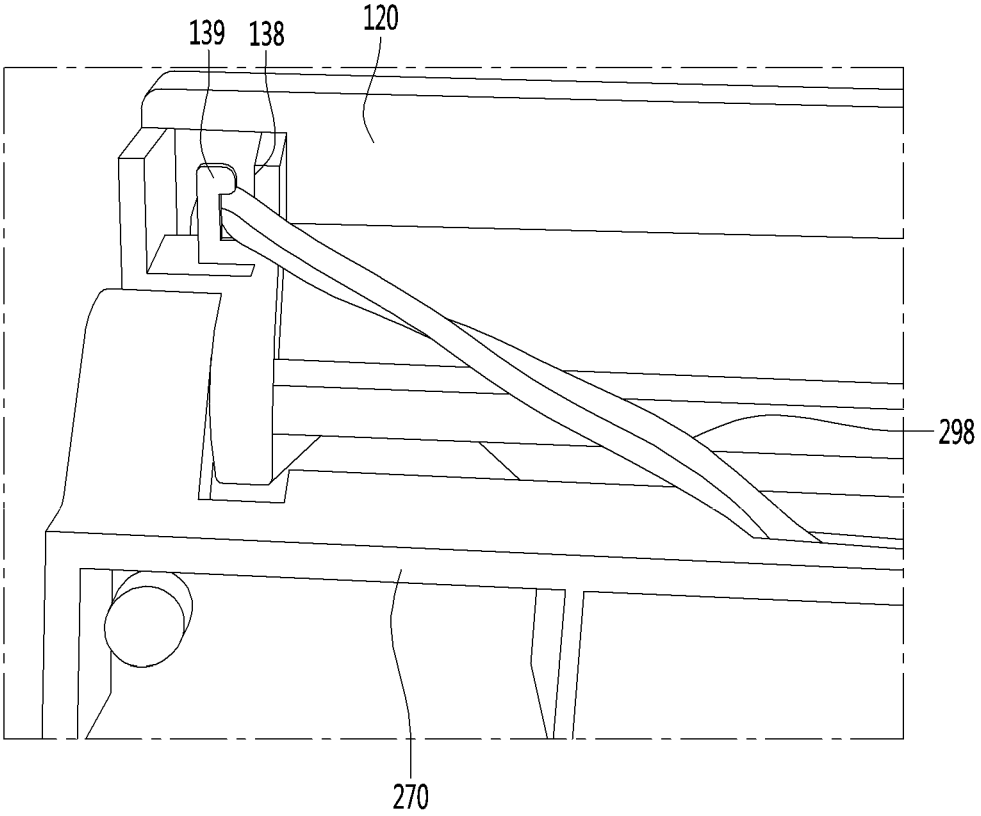
FIG. 29 is a view showing a state in which a lower assembly is coupled to an upper assembly and, at the same time, a wire connected to a lower heater penetrates an upper case.
Figure 30:
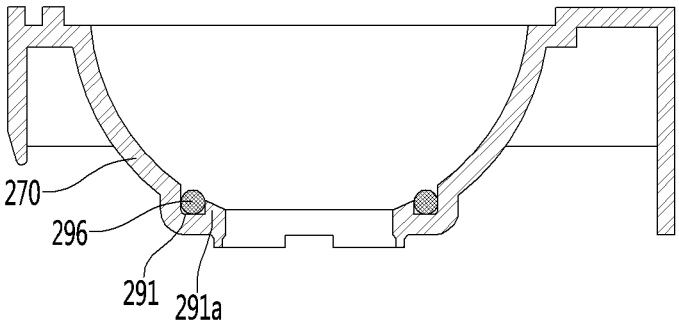
FIG. 30 is a sectional view showing a state in which a lower heater is installed on a lower support.

FIG. 27 is a plan view of the lower support according to an embodiment, FIG. 28 is a perspective view illustrating a state in which a lower heater is coupled to the lower support of FIG. 27, and FIG. 29 is a view illustrating a state in which the wire connected to the lower heater passes through the upper case in a state in which the lower assembly is coupled to the upper assembly. FIG. 30 is a cross-sectional view showing a state in which the lower heater is installed on the lower support.

Referring to FIGS. 27 to 30, the ice maker 100 according to this embodiment may further include a lower heater 296 for applying heat to the lower tray 250 during the ice making process.

The lower heater 297 may provide the heat to the lower chamber 252 during the ice making process so that ice within the ice chamber 111 is frozen from an upper side.

Also, since lower heater 296 generates heat in the ice making process, bubbles within the ice chamber 111 may move downward during the ice making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may be located between the lower tray 250 and the lower support 270.

The lower heater 296 may be installed on the lower support 270. Also, the lower heater 296 may contact the lower tray 250 to provide heat to the lower chamber 252.

For example, the lower heater 296 may contact the lower tray body 251. Also, the lower heater 296 may be disposed to surround the three chamber walls 252*d* of the lower tray body 251.

The lower support 270 may further include a heater coupling part 290 to which the lower heater 296 is coupled. The heater coupling part 290 may include a heater accommodation groove 291 that is recessed downward from the chamber accommodation part 272 of the lower tray body 251.

Since the heater accommodation groove 291 is recessed, the heater coupling part 290 may include an inner wall 291*a* and an outer wall 291*b*.

The inner wall 291*a* may have, for example, a ring shape, and the outer wall 291*b* may be disposed to surround the inner wall 291*a*.

When the lower heater 296 is accommodated in the heater accommodation groove 291, the lower heater 296 may surround at least a portion of the inner wall 291*a*.

The lower opening 274 may be defined in a region defined by the inner wall 291*a*. Thus, when the chamber wall 252*d* of the lower tray 250 is accommodated in the chamber accommodation part 272, the chamber wall 252*d* may contact a top surface of the inner wall 291*a*. The top surface of the inner wall 291*a* may be a rounded surface corresponding to the chamber wall 252*d* having the hemispherical shape.

The lower heater may have a diameter greater than a recessed depth of the heater accommodation groove 291 so that a portion of the lower heater 296 protrudes to the outside of the heater accommodation groove 291 in the state in which the lower heater 296 is accommodated in the heater accommodation groove 291.

A separation prevention protrusion 291*c* may be provided on one of the outer wall 291*b* and the inner wall 291*a* to prevent the lower heater 296 accommodated in the heater accommodation groove 291 from being separated from the heater accommodation groove 291.

In FIG. 26, the separation prevention protrusions 291*c* is provided on the inner wall 291*a*.

Since the inner wall 291*a* has a diameter less than that of the chamber accommodation part 272, the lower heater 296 may move along a surface of the chamber accommodation part 272 and then be accommodated in the heater accommodation groove 291 in a process of assembling the lower heater 296.

That is, the lower heater 296 is accommodated in the heater accommodation groove 291 from an upper side of the outer wall 291*a* toward the inner wall 291*a*. Thus, the separation prevention protrusion 291*c* may be disposed on the inner wall 291*a* to prevent the lower heater 296 from interfering with the separation prevention protrusion 291*c* while the lower heater 296 is accommodated in the heater accommodation groove 291.

The separation prevention protrusion 291*c* may protrude from an upper end of the inner wall 291*a* toward the outer wall 291*b*.

A protruding length of the separation prevention protrusion 291*c* may be about ½ of a distance between the outer wall 291*b* and the inner wall 291*a*.

As illustrated in FIG. 28, in the state in which the lower heater 296 is accommodated in the heater accommodation groove 291, the lower heater 296 may be divided into a lower round portion 296*a* and a lower linear portion 296*b*.

The lower round portion 296*a* may be a portion disposed along the circumference of the lower chamber 252 and also a portion that is bent to be rounded in a horizontal direction.

The lower liner portion 296*b* may be a portion connecting the lower round portions 296*a* corresponding to the lower chambers 252 to each other.

The lower round portion 296*a* may comprise first lower round portions 296*c*, 296*d* corresponding to first and third upper chambers 252*a*, 252*c* of both sides of an outermost section among a plurality of lower chambers 252.

The first lower round portions 296*c*, 296*d* may be connected by a pair of lower linear portions 296*b*. That is, the pair of lower linear portions 296*b* each may be connected to both ends of first lower round portions 296*c*, 296*d*.

Lengths of the first lower round portions 296*c*, 296*d* are longer than each of the pair of lower linear portions 296*b*.

The pair of lower linear portions 296*b* connected to both ends of the first lower round portions 296*c*, 296*d* may be disposed substantially in parallel.

A distance (R4) between the pair of lower linear portions 296*b* is smaller than double (2*R3) in a radius of curvature of the first lower round portions 296*c*, 296*d*.

As the distance (R2) between the pair of lower linear portions 296*b* is elongated, lengths of each of the pair of lower linear portions 296*b* get long, whereas lengths of the first lower round portions 296*c*, 296*d* are reduced, and thus a length of the lower heater 296 is reduced when viewing the lower heater 296 as a whole.

When the length of the lower heater 296 is reduced, there is a small amount of heat transmitted to the lower chamber 252 by the lower heater 296.

In addition, when the distance (R4) of the pair of lower linear portion 296*b* is elongated, a distance between the lower linear portion 296*b* and the lower chamber 252 is increased, thereby enhancing a time when the heat of the lower linear portion 296*b* reaches the lower chamber 252.

However, according to this embodiment, since the distance (R4) between the pair of lower linear portion 296*b* is smaller than double in the radius of curvature in the first lower round portions 296*c*, 2296*d*, an interval between the pair of lower linear portion 296*b* and the lower chamber 252 may be reduced to rapidly transfer the heat of the lower linear portion 296*b* to the lower chamber 252.

The distance (R4) between the pair of lower linear portion 296*b* may be equal to or larger than a radius of curvature (R3) of the first lower round portions 296*c*, 296*d*.

As the distance (R4) between the pair of lower linear portions 296*d* is reduced, there is a large degree of bending in a boundary between the pair of lower linear portions 296*b* and the first lower round portions 296*c*, 296*d*, thereby providing a lot of concern for the disconnection, and also, heat between two upper chambers that are adjacent to each other may be unnecessary concentrated.

However, according to this embodiment, if the distance (R4) between the pair of lower linear portions 296*d* is equal to or larger than the radius of curvature (R3) of the first lower round portions 296*c*, 296*d*, the above-described problem can be prevented.

The lower round portion 296*a* may further comprise a second lower round portion 296*e* corresponding to the second upper chamber 252*b*.

As an example, a pair of second lower round portions 296*e* may be spaced apart from each other. This is because each of the pair of second lower round portions 296*e* has to be connected to the first lower round portions 296*c*, 296*d* by the lower linear part 296*b* of both sides.

A length of the second lower round portion 296*e* may be shorter than a length of the first lower round portions 296*c*, 296*d*.

Since the lower round portion 296*a* of the lower heater 296 may be separated from the heater accommodation groove 291, the separation prevention protrusion 291*c* may be disposed to contact the lower round portion 296*a*.

A through-opening 291*d* may be defined in a bottom surface of the heater accommodation groove 291. When the lower heater 296 is accommodated in the heater accommodation groove 291, a portion of the lower heater 296 may be disposed in the through-opening 291*d*. For example, the through-opening 291*d* may be defined in a portion of the lower heater 296 facing the separation prevention protrusion 291*c*.

When the lower heater 296 is bent to be horizontally rounded, tension of the lower heater 296 may increase to cause disconnection, and also, the lower heater 296 may be separated from the heater accommodation groove 291.

However, when the through-opening 291*d* is defined in the heater accommodation groove 291 like this embodiment, a portion of the lower heater 296 may be disposed in the through-opening 291*d* to reduce the tension of the lower heater 296, thereby preventing the heater accommodation groove 291 from being separated from the lower heater 296.

The lower support 270 may include a first guide groove 293 guiding a power input terminal 296*c* and a power output terminal of the lower heater 296 accommodated in the heater accommodation groove 291 and a second guide groove 294 extending in a direction crossing the first guide groove 293.

For example, the first guide groove 293 may extend in a direction of an arrow B in the heater accommodation part 291.

The second guide groove 294 may extend from an end of the first guide groove 293 in a direction of an arrow A. In this embodiment, the direction of the arrow A may be a direction that is parallel to the extension direction of a rotational central axis C1 of the lower assembly.

Referring to FIG. 28, the first guide groove 293 may extend from one of the left and right chamber accommodation parts except for the intermediate chamber accommodation part of the three chamber accommodation parts.

For example, in FIG. 28, the first guide groove 293 extends from the chamber accommodation part, which is disposed at the left side, of the three chamber accommodation parts. That is, a part extending from the first lower round portion 296*d* on the left may be accommodated in the first guide groove 293.

As illustrated in FIG. 28, in a state in which the power input terminal 296*c* and the power output terminal 296*d* of the lower heater 296 are disposed in parallel to each other, the lower heater 296 may be accommodated in the first guide groove 293.

The power input terminal 296*c* and the power output terminal 296*d* of the lower heater 296 may be connected to one first connector 297*a*.

A second connector 297*b* to which two wires 298 connected to correspond to the power input terminal 296*c* and the power output terminal 296*d* are connected may be connected to the first connector 297*a*.

In this embodiment, in the state in which the first connector 297*a* and the second connector 297*b* are connected to each other, the first connector 297*a* and the second connector 297*b* are accommodated in the second guide groove 294.

The wire 298 connected to the second connector 297*b* is led out from the end of the second guide groove 294 to the outside of the lower support 270 through an lead-out slot 295 defined in the lower support 270.

According to this embodiment, since the first connector 297*a* and the second connector 297*b* are accommodated in the second guide groove 294, the first connector 297*a* and the second connector 297*b* are not exposed to the outside when the lower assembly 200 is completely assembled.

As described above, the first connector 297*a* and the second connector 297*b* may not be exposed to the outside to prevent the first connector 297*a* and the second connector 297*b* from interfering with the surrounding structure while the lower assembly 200 rotates and prevent the first connector 297*a* and the second connector 297*b* from being separated.

Since the first connector 297*a* and the second connector 297*b* are accommodated in the second guide groove 294, one portion of the wire 298 may be disposed in the second guide groove 294, and the other portion may be disposed outside the lower support 270 by the lead-out slot 295.

Here, since the second guide groove 294 extends in a direction parallel to the rotational central axis C1 of the lower assembly 200, one portion of the wire 298 may extend in the direction parallel to the rotational central axis C1.

The other part of the wire 298 may extend from the outside of the lower support 270 in a direction crossing the rotational central axis C1.

According to the arrangement of the wires 298, tensile force may not merely act on the wires 298, but torsion force may act on the wires 298 during the rotation of the lower assembly 200.

When compared that the tensile force acts on the wire 298, if the torsion acts on the wire 298, possibility of disconnection of the wire 298 may be very little.

According to this embodiment, while the lower assembly 200 rotates, the lower heater 296 may be maintained at a fixed position, and twisting force may act on the wire 298 to prevent the lower heater 296 from being damaged and disconnected.

The power input terminal 296*c* and the power output terminal 296*d* of the lower heater 296 are disposed in the first guide groove 293. Here, since heat is also generated in the power input terminal 296*c* and the power output terminal 296*d*, heat provided to the left chamber accommodation part to which the first guide groove 293 extends may be greater than that provided to other chamber accommodation parts.

In this case, if intensities of the heat provided to each chamber accommodating part are different, transparency of the made spherical ice after the ice making process and the ice separating process may be changed for each ice.

Thus, a detour accommodation groove 292 may be further provided in the chamber accommodation part (for example, the right chamber accommodation part), which is disposed farthest from the first guide groove 292, of the three chamber accommodation parts to minimize a difference in transparency for each ice.

For example, the detour accommodation groove 292 may extend outward from the heater accommodation groove 291 and then be bent so as to be disposed in a shape that is connected to the heater accommodation groove 291.

When a portion 296*f* of the lower heater 296 is additionally accommodated in the detour accommodation groove 292, a contact area between the chamber wall accommodated in the right chamber accommodation part 272 and the lower heater 296 may increase.

Thus, a protrusion 292*a* for fixing a position of the lower heater accommodated in the detour accommodation groove 292 may be additionally provided in the right chamber accommodation part 272.

As an example, a portion 296*f* of the first lower round portion 296*c* disposed to the right may be disposed in the detour accommodation groove 292.

Referring to FIG. 29, in the state in which the lower assembly 200 is coupled to the upper case 120 of the upper assembly 110, the wire 298 led out to the outside of the lower support 270 may pass through a wire through-slot 138 defined in the upper case 120 to extend upward from the upper case 120.

A restriction guide 139 for restricting the movement of the wire 298 passing through the wire through-slot 138 may be provided in the wire through-slot 138. The restriction guide 139 may have a shape that is bent several times, and the wire 298 may be disposed in a region defined by the restriction guide 139.

Figure 31:
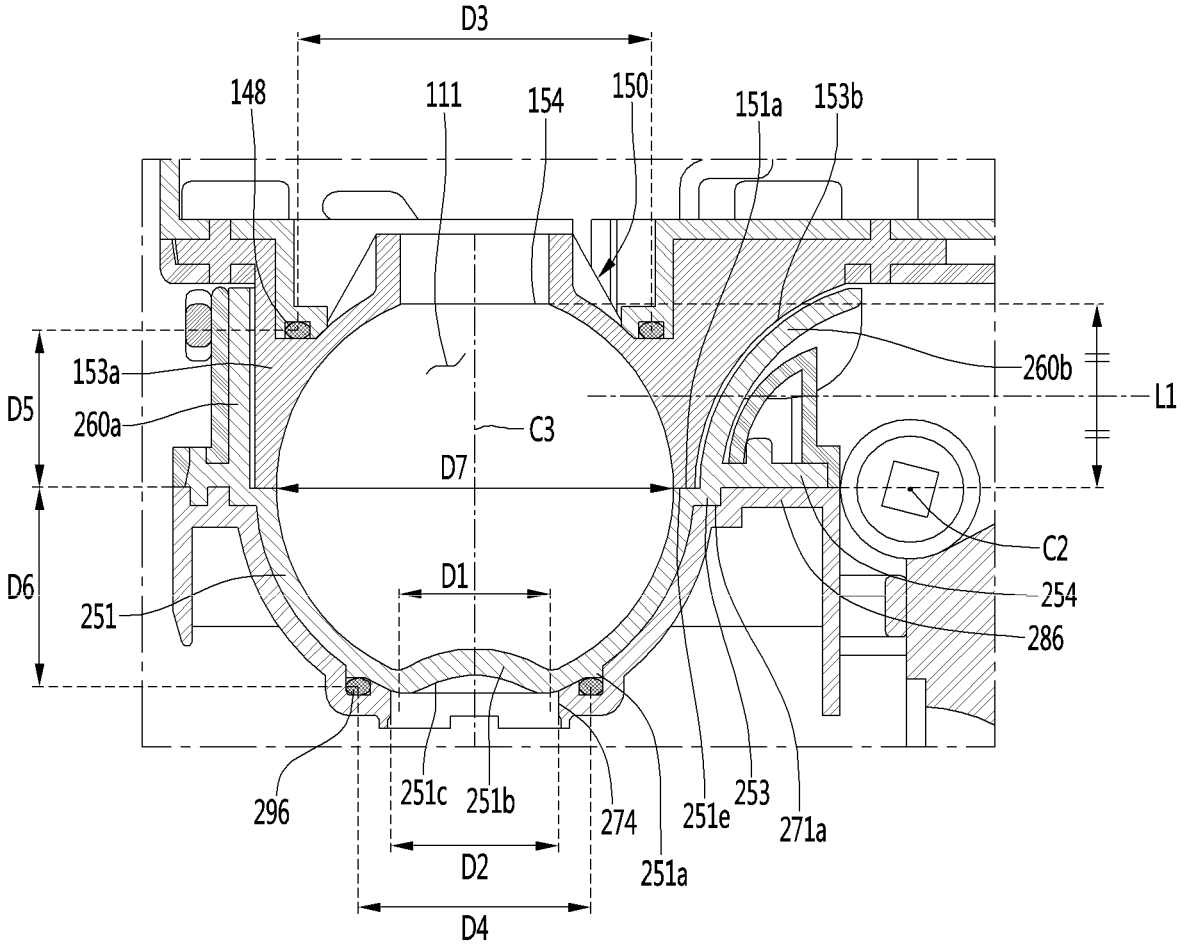
FIG. 31 is a cross-sectional view taken along line A-A of FIG. 3.
Figure 32:
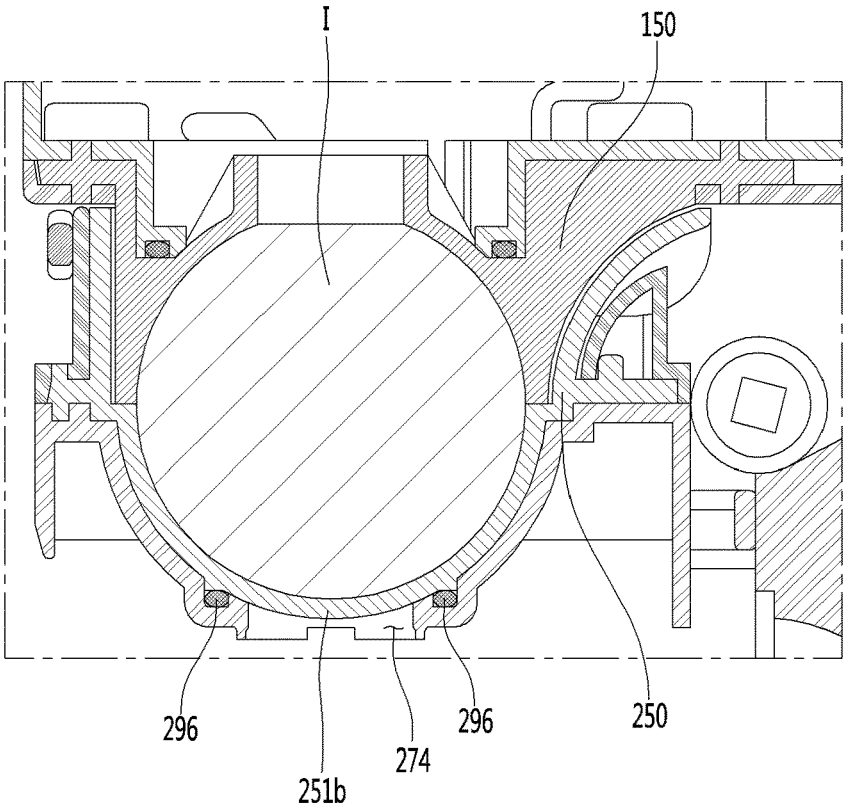
FIG. 32 is a view showing a state in which ice generation is completed in FIG. 31.

FIG. 31 is a cross-sectional view taken along line A-A of FIG. 3, and FIG. 32 is a view illustrating a state in which ice is completely made in FIG. 30.

In FIG. 31, a state in which the upper tray and the lower tray contact each other is illustrated.

Referring to FIG. 31, the upper tray 150 and the lower tray 250 vertically contact each other to complete the ice chamber 111.

The bottom surface 151*a* of the upper tray body 151 contacts the top surface 251*e* of the lower tray body 251.

Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151.

Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surface may not occur to prevent ice having a thin band shape along a circumference of the spherical ice from being made after the ice making is completed.

The first extension part 253 of the lower tray 250 is seated on the top surface 271*a* of the support body 271 of the lower support 270. Also, the second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the first wall 260*a* of the lower tray 250, and the curved wall 153*b* of the upper tray body 151 may be disposed to face the second wall 260*b* of the lower tray 250.

An outer face of the chamber wall 153 of the upper tray body 151 is spaced apart from an inner face of the circumferential wall 260 of the lower tray 250. That is, a space may be defined between the outer face of the chamber wall 153 of the upper tray body 151 and the inner face of the circumferential wall 260 of the lower tray 250.

Water supplied through the water supply part 180 is accommodated in the ice chamber 111. When a relatively large amount of water than a volume of the ice chamber 111 is supplied, water that is not accommodated in the ice chamber 111 may flow into the space between the outer face of the chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

A heater contact part 251*a* for allowing the contact area with the lower heater 296 to increase may be further provided on the lower tray body 251.

The heater contact portion 251*a* may protrude from the bottom surface of the lower tray body 251. In one example, the heater contact portion 251*a* may be formed in a ring shape and disposed on the bottom surface of the lower tray body 251. The bottom surface of the heater contact portion 251*a* may be planar.

The lower tray body 251 may further include a convex portion 251*b* in which a portion of the lower portion of the lower tray body 251 is convex upward.

A recess 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower support 270.

The lower opening 274 may be defined just below the lower chamber 252. That is, the lower opening 274 may be defined just below the convex portion 251*b*.

The convex portion 251*b* may have a diameter D less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 is not formed into a spherical form before the ice is generated. After the generation of the ice is completed, the convex portion 251*b* of the lower tray body 251 is deformed toward the lower opening 274, such that the spherical ice may be generated.

In the present embodiment, the diameter D1 of the convex portion 251*b* is smaller than the diameter D2 of the lower opening 274, such that the convex portion 251*b* may be deformed and positioned inside the lower opening 274.

In FIG. 31, the line passing vertically through the center of the ice chamber 111 may be referred to as the vertical center line C3. In one example, the vertical center line C3 may pass through the upper opening 154 and lower opening 274.

Further, the line passing through the contact surface of the bottom surface 151*a* of the upper tray 151 and the top surface 251*e* of the lower tray 250 in the ice chamber 111 may be defined as a horizontal center line based on the height of the ice chamber 111.

A distance (D3) between two points disposed in opposite sides based on the vertical central line (C3) in the upper round portion 148*c* of the upper heater 148 may be smaller than a diameter (D7) of the ice chamber 111.

A distance (D3) between two points disposed in the opposite sides based on the vertical central line (C3) in the upper round portion 148*c* of the upper heater 148 may be greater than a distance (D4) between two points disposed in the opposite sides based on the vertical central line (C3) in the lower round portion 296*a* of the upper heater 296.

In other words, a radius of curvature (R1) of the upper round portion 148*c* of the upper heater 148 is greater than a radius of curvature (R3) of the lower round portion 296*a* of the lower heater 296.

The lower heater 296 has to be disposed close to a lowermost side of the lower tray 250 to freeze the ice latest under the upper chamber 252, and accordingly, bubbles may be gathered at a lowermost side of the lower chamber 252.

Meanwhile, a distance between the upper heater 148 and the horizontal central line of the ice chamber 111 may be less than a distance between the horizontal central line and the upper opening 154. Accordingly, the heat of the upper heater 148 may be rapidly transferred not only to the upper chamber 152 but also to a boundary between the upper tray 150 and the lower tray 250.

Therefore, in this embodiment, a distance (D5) from the horizontal central line to the upper heater 148 is smaller than a distance (D6) from the horizontal central line to the lower heater 296.

A distance from the vertical central line (C3) to at least a portion of the upper heater 148 is longer than a distance from the vertical central line (C3) to at least a portion of the lower heater 296.

The upper heater 148 may be disposed in the same height as the height of a bisector (L1) of bisecting a distance between the upper opening 154 and the horizontal central line or may be higher than the bisector (L1).

As an example, FIG. 31 illustrates that the upper heater 148 is higher than the bisector (L1).

Based on the height of the upper chamber 152, the upper heater 148 may be disposed between the bisector (L1) and the upper opening 154, as an example.

At least a portion of the lower heater 296 may be disposed to vertically overlap the lower ice chamber 252. The lower round portion 296*c* of the at least lower heater 296 may be disposed to vertically overlap with lower ice chamber 252.

The lower heater 296 may be spaced apart from the vertical central line (C3) of the ice chamber 111.

As an example, the lower round portion 296*a* of the lower heater 296 may be disposed to surround the lower opening 274. Therefore, an interference between the lower heater 296 and the lower ejector 400 may be prevented in a process that the lower ejector 400 penetrates the lower opening 274.

In an ice making position, at least a portion of the upper heater 296 may be disposed closer to the vertical central line (C3) than the upper heater 148.

Hereinafter, an ice making process by the ice maker according to one embodiment of the present invention will be described.

Figure 33:
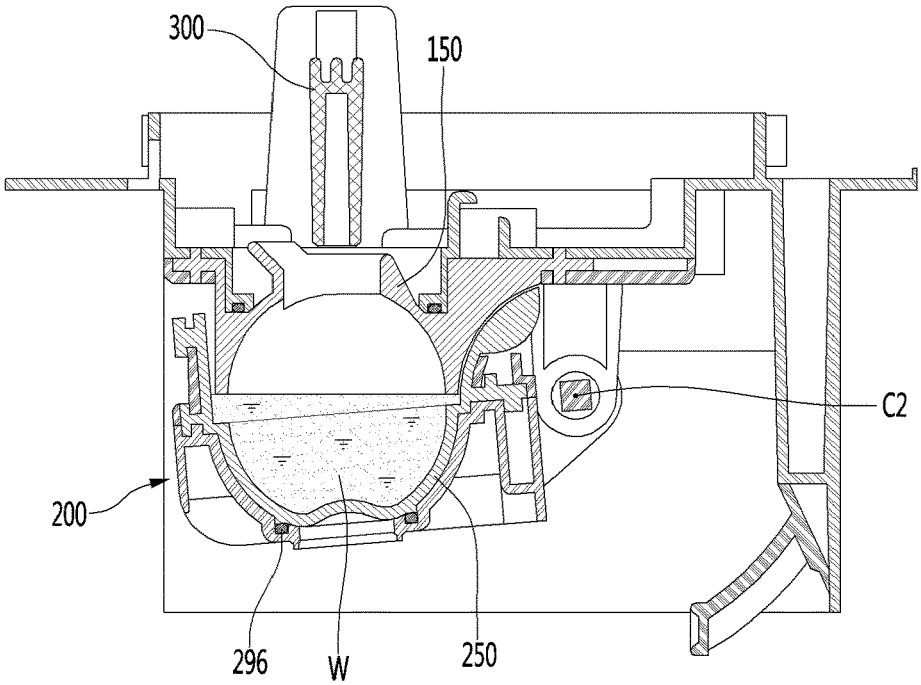
FIG. 33 is a cross-sectional view taken along line B-B of FIG. 3 in a water supplied state.
Figure 34:
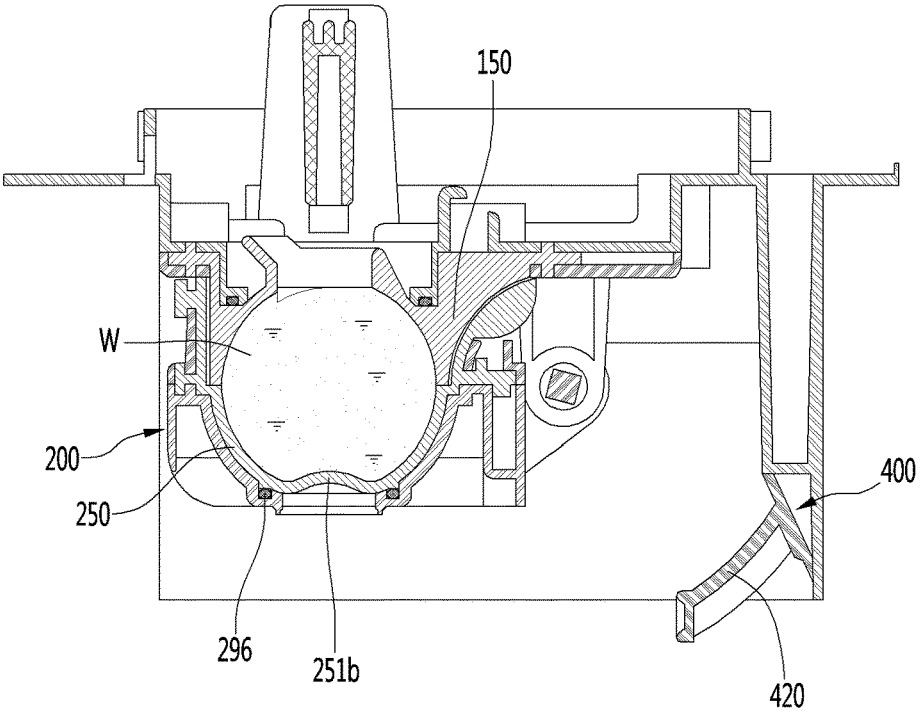
FIG. 34 is a cross-sectional view taken along line B-B of FIG. 3 in the ice-making state.

FIG. 33 is a cross-sectional view taken along line B-B of FIG. 3 in a water supply state, and FIG. 34 is a cross-sectional view taken along line B-B of FIG. 3 in an ice making state.

Figure 35:
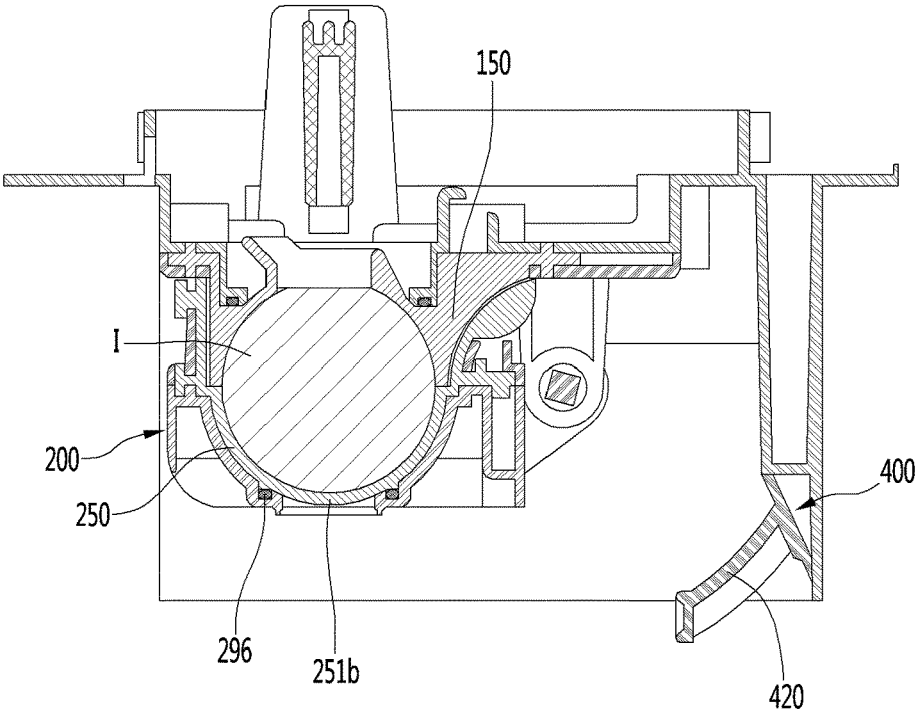
FIG. 35 is a cross-sectional view taken along line B-B of FIG. 3 in the ice-making completed state.
Figure 36:
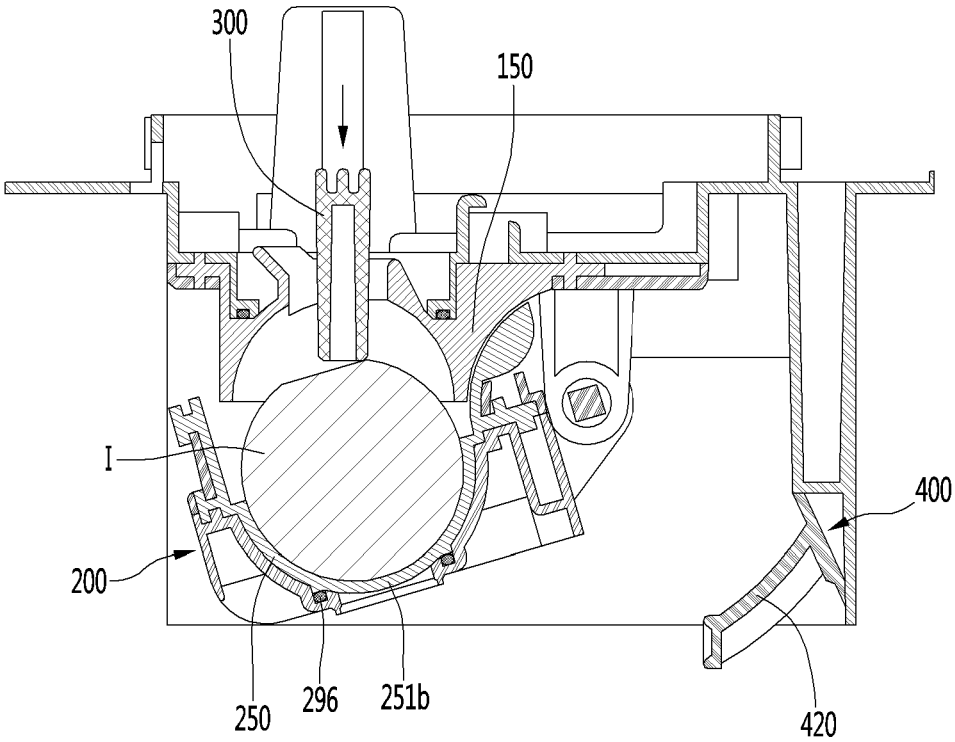
FIG. 36 is a cross-sectional view taken along line B-B of FIG. 3 in an initial state of ice separation.
Figure 37:
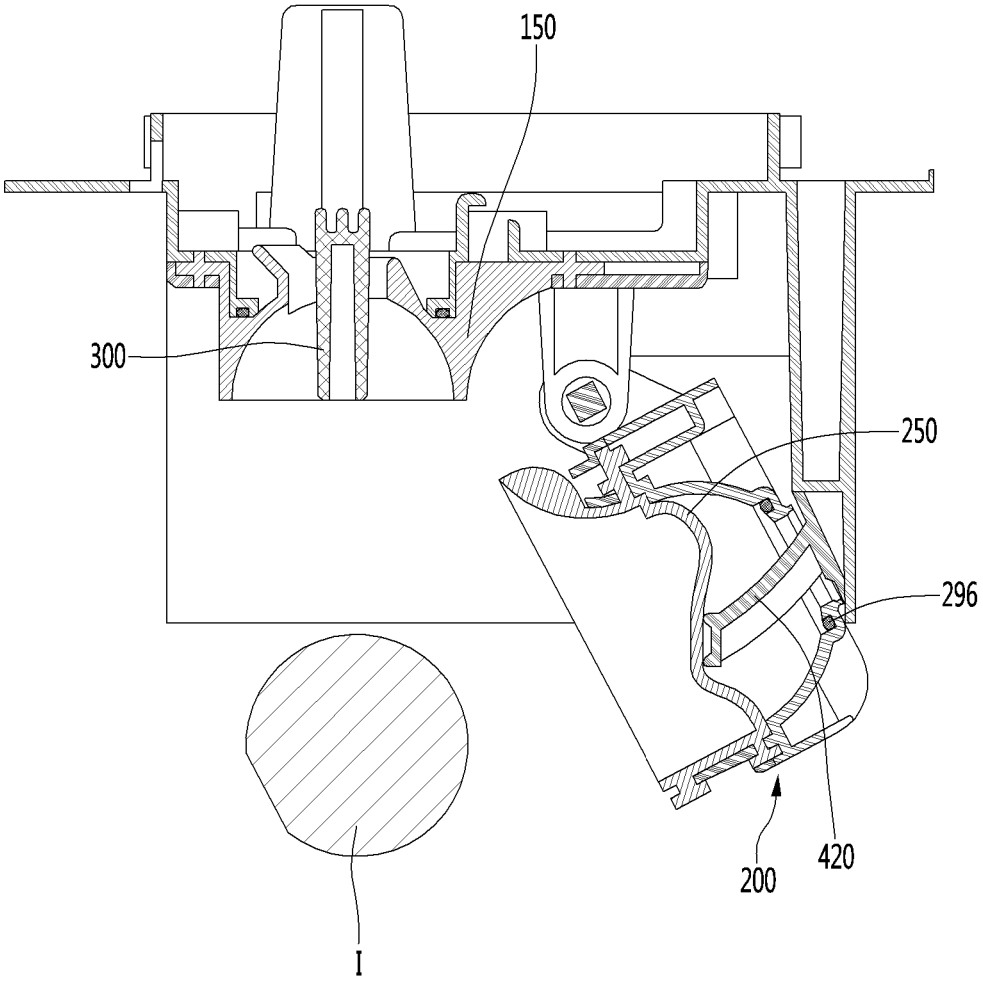
FIG. 37 is a cross-sectional view taken along line B-B of FIG. 3 in an ice-separation completed state.

FIG. 35 is a cross-sectional view taken along line B-B of FIG. 3 in a state in the ice-making completed state, FIG. 36 is a cross-sectional view taken along line B-B of FIG. 3 in an initial state of ice separation, and FIG. 37 is a cross-sectional view taken along line B-B of FIG. 3 in an ice separation completed state.

Referring to FIGS. 33 to 37, first, the lower assembly 200 rotates to a water supply position.

The top surface 251*e* of the lower tray 250 is spaced apart from the bottom surface 151*e* of the upper tray 150 at the water supply position of the lower assembly 200.

Although not limited, the bottom surface 151*e* of the upper tray 150 may be disposed at a height that is equal or similar to a rotational center C2 of the lower assembly 200.

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply position of the lower assembly 200 may be about 8 degrees.

In this state, the water is guided by the water supply part 190 and supplied to the ice chamber 111.

In this connection, the water is supplied to the ice chamber 111 through one upper opening of the plurality of upper openings 154 of the upper tray 150.

In the state in which the supply of the water is completed, a portion of the supplied water may be fully filled into the lower chamber 252, and the other portion of the supplied water may be fully filled into the space between the upper tray 150 and the lower tray 250.

For example, the upper chamber 151 may have the same volume as that of the space between the upper tray 150 and the lower tray 250. Thus, the water between the upper tray 150 and the lower tray 250 may be fully filled in the upper tray 150. In another example, the volume of the upper chamber 152 may be larger than the volume of the space between the upper tray 150 and the lower tray 250.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

In the state in which the supply of the water is completed, as illustrated in FIG. 34, the lower assembly 200 rotates reversely. When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are closely attached to each other, the water may be fully filled in the upper chamber 152.

In the state in which the top surface 251*e* of the lower tray 250 and the bottom surface 151*e* of the upper tray 150 are closely attached to each other, a position of the lower assembly 200 may be called an ice making position.

In the state in which the lower assembly 200 moves to the ice making position, ice making is started.

Since pressing force of water during ice making is less than the force for deforming the convex portion 251*b* of the lower tray 250, the convex portion 251*b* may not be deformed to maintain its original shape.

When the ice making is started, the lower heater 296 is turned on. When the lower heater 296 is turned on, heat of the lower heater 296 is transferred to the lower tray 250.

Thus, when the ice making is performed in the state where the lower heater 296 is turned on, ice may be made from the upper side in the ice chamber 111.

That is, water in a portion adjacent to the upper opening 154 in the ice chamber 111 is first frozen. Since ice is made from the upper side in the ice chamber 111, the bubbles in the ice chamber 111 may move downward.

Since the ice chamber 111 is formed in a sphere shape, the horizontal cross-sectional area may vary based on a height of the ice chamber 111.

Thus, the output of the lower heater 296 may vary depending on the height at which ice is produced in the ice chamber 111.

The horizontal cross-sectional area increases as it goes downwardly. Then, the horizontal cross-sectional area becomes maximum at the boundary between the upper tray 150 and the lower tray 250 and decreases as it goes downwardly again.

In the process where ice is generated from a top to a bottom in the ice chamber 111, the ice comes into contact with the top surface of the convex portion 251*b* of the lower tray 250.

In this state, when the ice is continuously made, the block part 251*b* may be pressed and deformed as shown in FIG. 34, and the spherical ice may be made when the ice making is completed.

A control unit (not shown) may determine whether the ice making is completed based on the temperature sensed by the temperature sensor 500.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

In addition, as the heat of the upper heater 148 is transferred to the boundary between the upper tray 150 and the lower tray 250, the upper tray 150 and the lower tray 25 can be separated from each other.

After the upper heater 148 has been activated for a set time duration, the upper heater 148 may be turned off and then the drive unit 180 may be operated to rotate the lower assembly 200 in a forward direction.

As illustrated in FIG. 36, when the lower assembly 200 rotates forward, the lower tray 250 may be spaced apart from the upper tray 150.

Also, the rotation force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the upper opening 154.

In the ice separating process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 200 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is closely attached to the upper tray 150.

In this state, while the lower assembly 200 rotates, the upper ejecting pin 320 passing through the upper opening 154 may press the ice closely attached to the upper tray 150 to separate the ice from the upper tray 150. The ice separated from the upper tray 150 may be supported again by the lower tray 250.

When the ice rotates together with the lower assembly 200 in the state in which the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, when the lower tray 250 is pressed by the lower ejector 400 as shown in FIG. 37, the ice may be separated from the lower tray 250.

Particularly, while the lower assembly 200 rotates, the lower tray 250 may contact the lower ejecting pin 420.

When the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray 250 may be restored to its original form. That is, the deformed convex portion 251*b* may be restored to its original form.

In the reverse rotation process of the lower assembly 200, the rotational force is transmitted to the upper ejector 300 by the connecting unit 350, such that the upper ejector 300 is raised, and thus, the upper ejecting pin 320 is removed from the upper chamber 152.

When the lower assembly 200 reaches the water supply position, the drive unit 180 is stopped, and then water supply starts again.

According to the proposed embodiment, since the upper heater is disposed closer to the horizontal central line of the ice chamber than the upper opening, not only may the heat of the upper heater be rapidly transferred to the upper chamber, but also the heat may be rapidly transferred to a boundary between the upper tray and the lower tray.

When the heat of the upper chamber is transferred to the boundary between the upper tray and the lower tray, the lower tray may be easily separated from the upper tray in the ice separation process.

In addition, according to this embodiment, as the upper heater includes the upper round portion to surround the upper chamber, the heat of the upper heater may be rapidly provided to the upper chamber.

In addition, since the upper round portion of the upper heater is disposed to vertically overlap the ice chamber, the heat of the upper round portion of the upper heater may be rapidly transferred to the ice chamber.

In addition, since the upper heater for ice separation is disposed to surround each of a plurality of upper chambers, the heat may be uniformly transferred to the plurality of upper chambers.

In addition, since the heater coupling part is accommodated in the accommodation part formed in the upper tray and contacts a bottom of the accommodation part in a state that the upper heater is coupled to the heater coupling part of the upper case, the heat of the upper heater can be concentrated in the upper tray.

In addition, the upper heater is accommodated in the accommodation groove in a state that the upper heater is curved in the horizontal direction and the separation prevention protrusion is provided in the heater coupling part, the heater may be stably maintained in a state that the heater is coupling to the heater coupling part.

In addition, in the ice making process, as the upper heater is operated to transfer the heat of the lower heater to a lower side (the lower chamber) of the ice chamber, the ice is frozen from an upper side in the ice chamber, bubbles in water are gathered under the ice chamber. Therefore, there is an advantage that the ice can be made transparent as a whole.

In addition, since the lower heater is disposed in a position spaced apart from the vertical central line of the ice chamber, the lower heater may be prevented from interfering with the lower ejector in the ice separation process.

In addition, according to this embodiment, as the lower heater includes the lower round portion to surround the lower chamber, the heat of the upper heater may be transferred well to the lower chamber.

In addition, since the lower heater is disposed to surround each of circumferences of the plurality of lower chambers, the heat may be uniformly transferred to the plurality of lower chambers.

Hereinafter, another embodiment of the present invention will be described. At this time, the same constituents as the previous embodiment use the same reference numerals.

Figure 38:
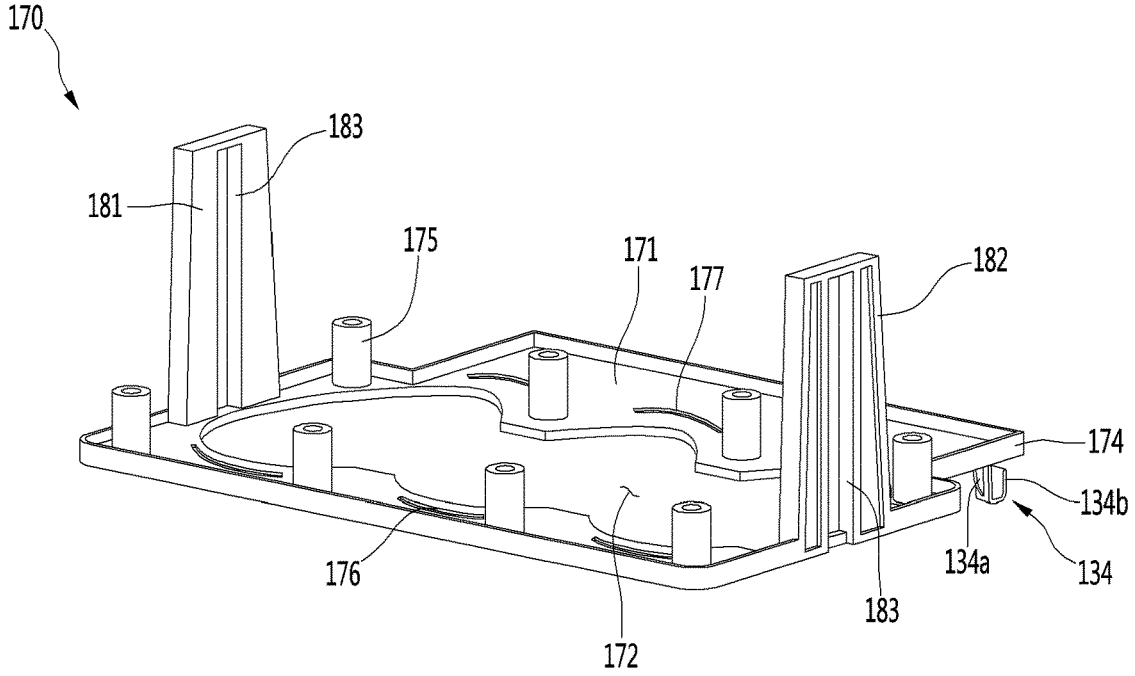
FIG. 38 is an upper perspective view of an upper support according to another embodiment of the present invention.
Figure 39:
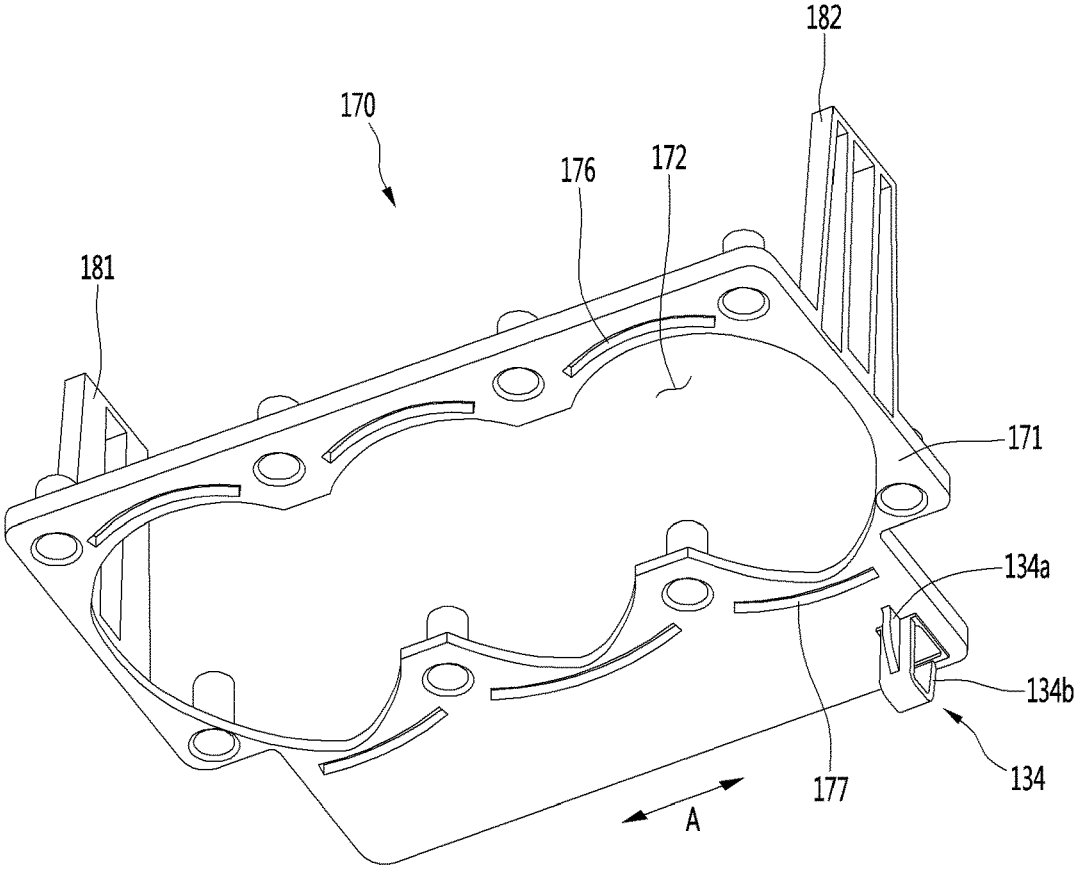
FIG. 39 is a lower perspective view of the upper support according to another embodiment of the present invention.

FIG. 38 is an upper perspective view of an upper support according to another embodiment of the present invention, and FIG. 39 is a lower perspective view of the upper support according to another embodiment of the present invention.

With reference to FIGS. 38 and 39, the upper support 170 of this embodiment may further comprise a wire guiding hook 134 extending from one side to a lower side of the support plate 171 and preventing a flow of a wire 298 that will be described later.

If the flow of the wire 298 is prevented by the wire guiding hook 134, this may prevent the problem that the wire 298 disturbs a rotation of the lower assembly 200, or the wire 298 is disconnected by a rotational operation of the upper assembly 200.

As an example, the support plate 171 may horizontally extend in a direction of a plurality of second lower slots 177, and the wire guiding hook 134 may be installed in one side of an extending part of the support plate 171.

In addition, the wire guiding hook 134 may be installed not to disturb the rotation of the lower assembly 200 when the upper assembly 110 and the lower assembly 200 are assembled.

The wire guiding hook 134 may comprise a curving part 134*b* curved one or more times and a support part 134*a* for supporting the curving part 134*b*.

Specifically, the curving part 134*b* may be in a hooked shape curved outside of the support plate 171, and in an example, the curving part 134*b* may be curved two times after extending from a lower side of the support plate 171 and then be formed back toward the support plate 171.

As an example, the curving part 134*b* may comprise a first part extending to the lower side of the support plate 171, a second part curved and extending in the horizontal direction from the first part, and a third part curved again in the second part and extending toward the support plate 171.

In addition, the second part may extend from the first part to an opposite direction of the plate opening 172.

In addition, as an interval between the first part and the third part moves away from the support plate 171, the interval may be narrow.

As the third part of the curving part 134*b* is spaced apart from the support plate 171, the wire 298 may pass through the spaced part, and the third part may have an enough length such that the wire 298 does not protrude through the spaced part.

In addition, the wire 298 passing through the spaced apart may be supported by the second part of the curving 134*b*.

The support part 134*a* may be formed to connect the curving part 134*b* and the support plate 171 while supporting the curving part 134*b* to improve strength and durability of the curving part 134*b*.

As an example, the support part 134*a* may extend vertically from the first part of the curving part 134*b* to the plate opening 172 and may be connected to the support plate 171.

In detail, the support part 134*a* may be configured such that a part contacting the support plate 171 is formed more widely, and as the support part 134*a* extends to the lower side of the support plate 171, it gets narrower.

As another example, the support 134*a* may be provided in pairs having the same shape, each of which is connected to the first part of the curving part 134*b*, and may protrude toward the plate opening 172.

Meanwhile, the wire guiding hook 134 may comprise an opening (see 134*c* of FIG. 44) formed to correspond to a size of the curving part 134*b*.

The opening (see 134*c* of FIG. 44) may be formed in the support plate 171 in a position where the wire guiding hook 134 is installed.

For example, the opening (see 134*c* of FIG. 44) may be formed in a square shape in the support plate 171, and the support 134*a* may be installed at one side of the opening.

As the wire guiding hook 134 is installed only in one side of the support plate 171, the opening (see 134*c* of FIG. 44) may serve as preventing a phenomenon of biasing a center of gravity.

Figure 40:
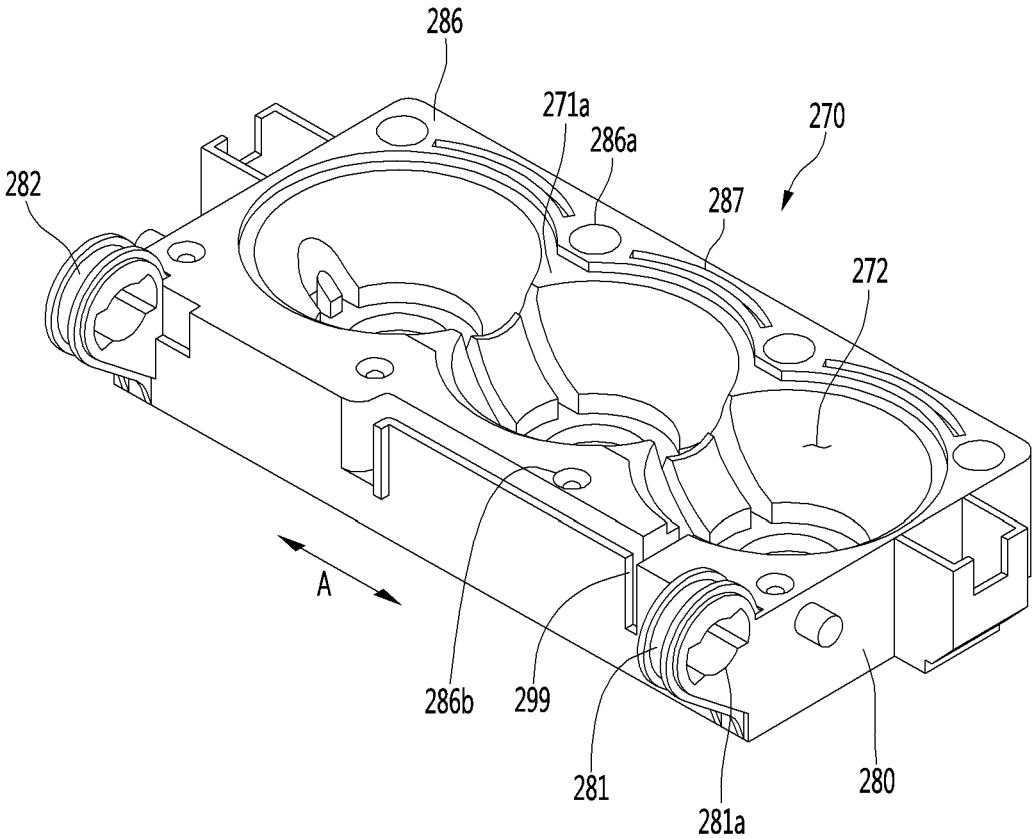
FIG. 40 is an upper perspective view of a lower support according to another embodiment of the present invention.
Figure 41:
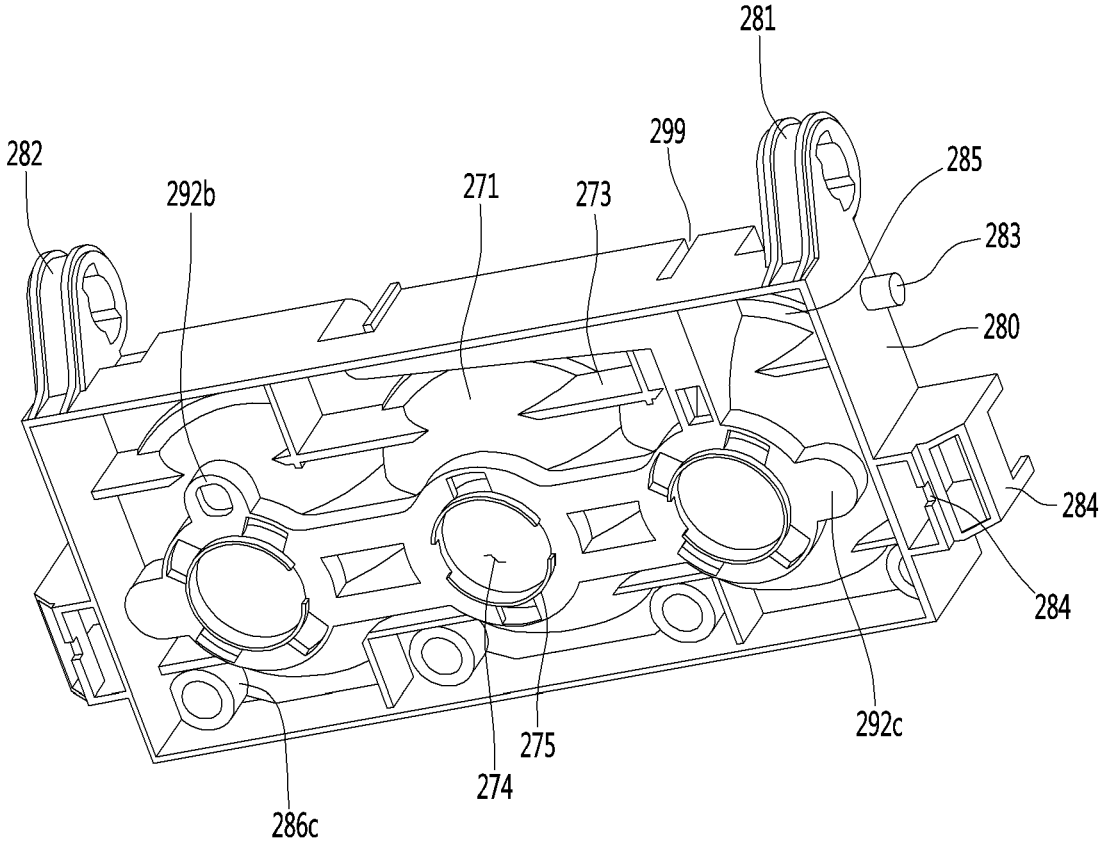
FIG. 41 is a lower perspective view of the lower support according to another embodiment of the present invention.
Figure 42:
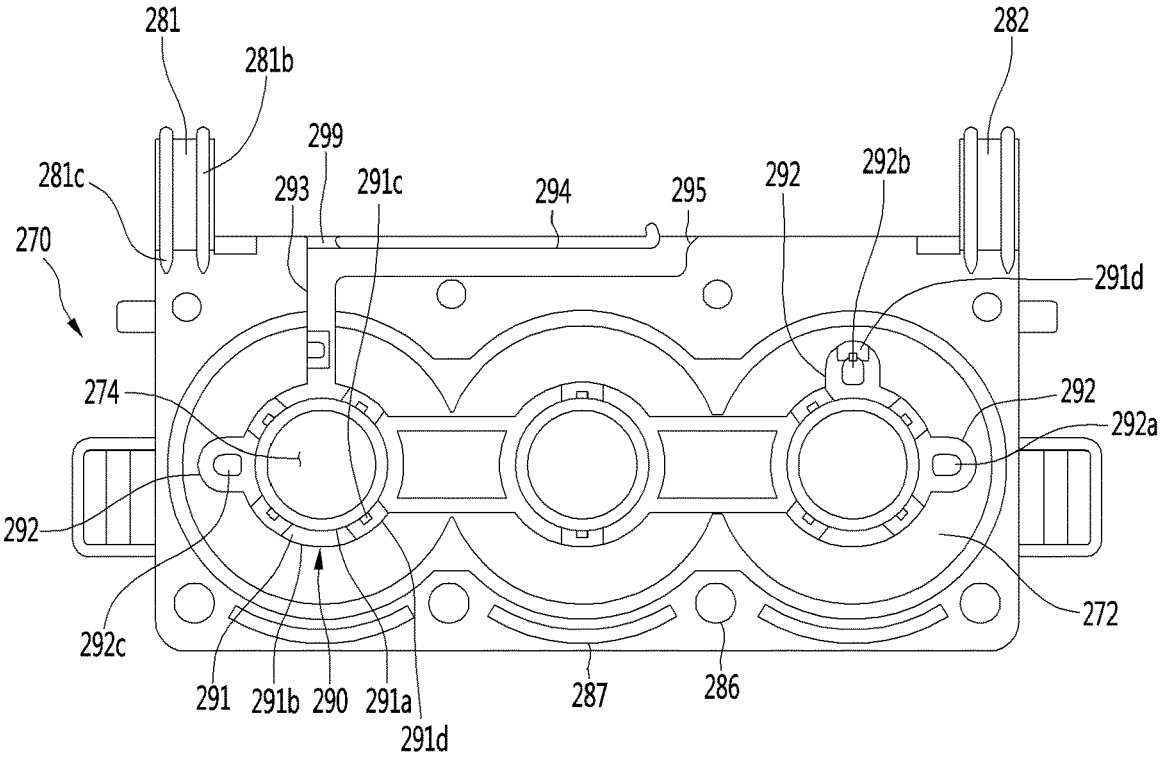
FIG. 42 is a top plan view of the lower support according to another embodiment of the present invention.

FIG. 40 is an upper perspective view of a lower support according to another embodiment of the present invention, and FIG. 41 is a lower perspective view of the lower support according to another embodiment of the present invention. FIG. 42 is a top plan view of the lower support according to another embodiment of the present invention.

Figure 43:
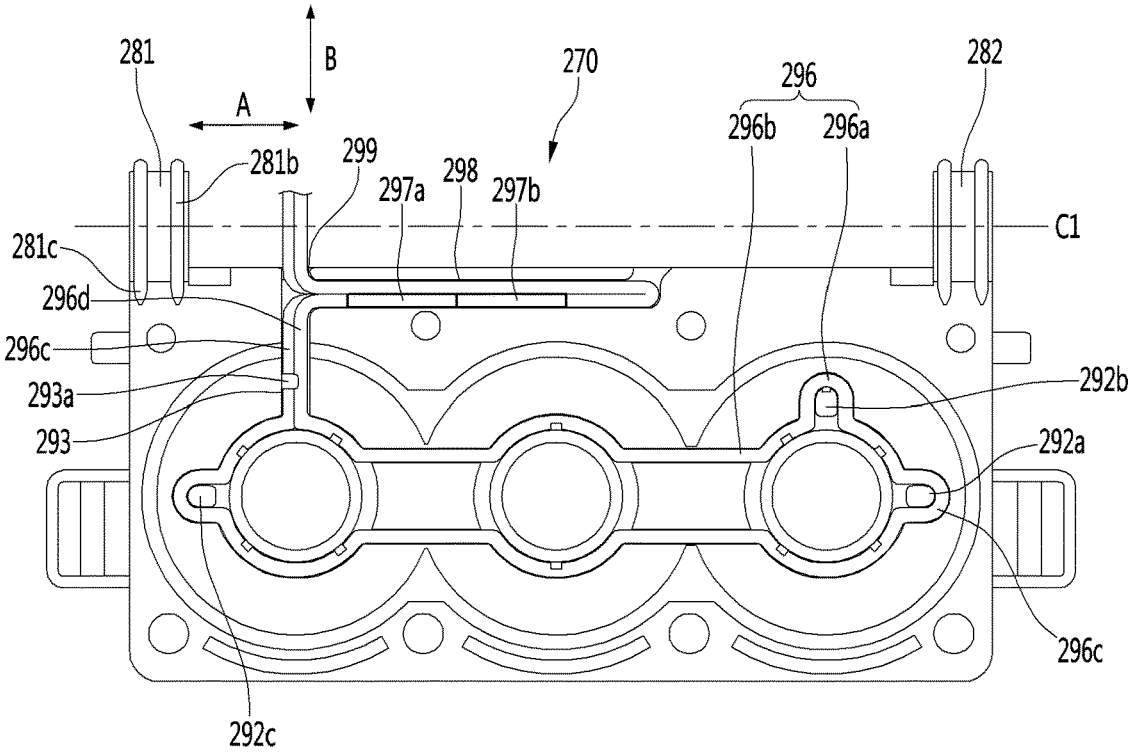
FIG. 43 is a perspective view that the lower heater is coupled to the lower support of FIG. 42.
Figure 44:
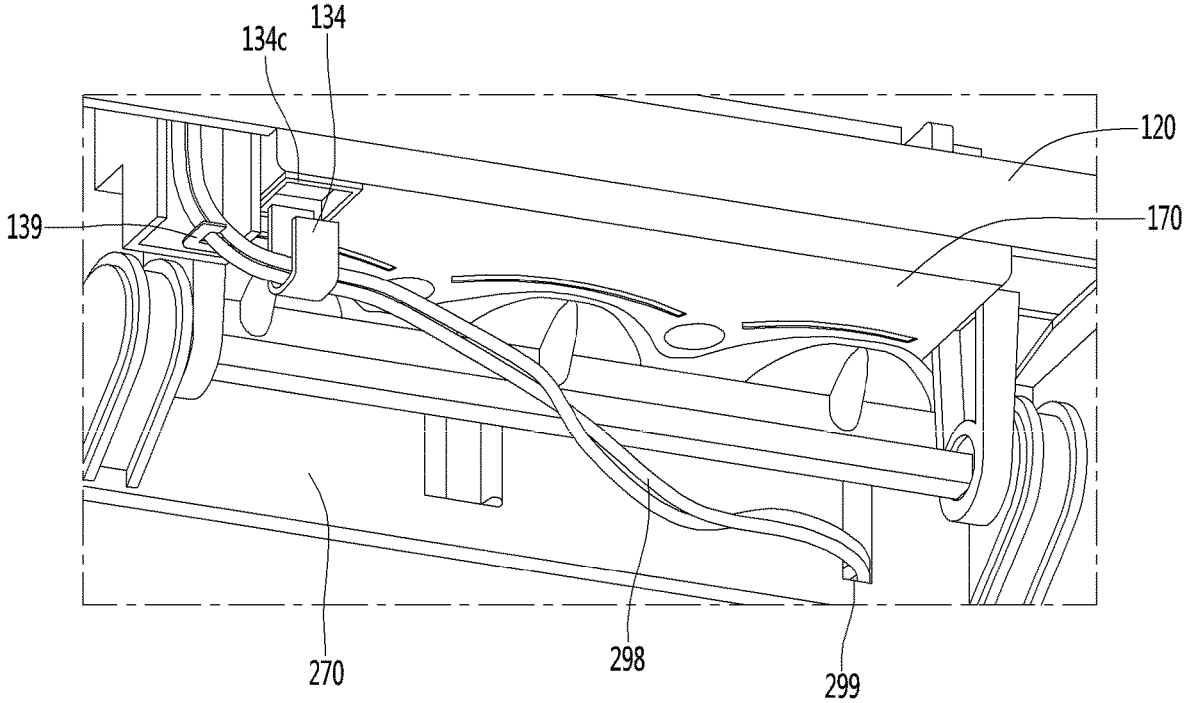
FIG. 44 is a view showing a state in which a wire connected to the lower heater penetrates an upper case in a state that a lower assembly is coupled to an upper assembly.
Figure 45:
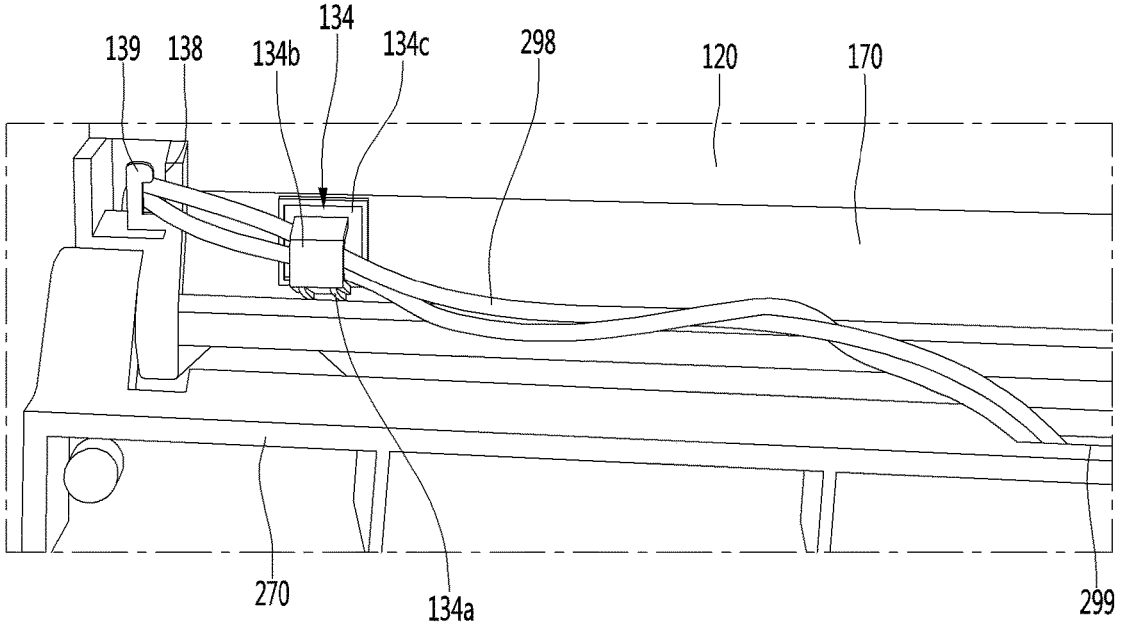
FIG. 45 is a bottom view showing a state in which a wire connected to the lower heater penetrates an upper case in a state that a lower assembly is coupled to an upper assembly.

FIG. 43 is a perspective view that the lower heater is coupled to the lower support of FIG. 42, FIG. 44 is a view showing a state in which a wire connected to the lower heater penetrates an upper case in a state that a lower assembly is coupled to an upper assembly, and FIG. 45 is a bottom view showing a state in which a wire connected to the lower heater penetrates an upper case in a state that a lower assembly is coupled to an upper assembly.

With referring to FIGS. 40 to 45, the lower support 270 of this embodiment may comprise a plurality of hinge bodies 281, 282 for connecting each of hinge supports 135, 136 of the upper case 210.

The plurality of hinge bodies 281, 282 may comprise a plurality of hinge body ribs 281*b* for improving a deformation rate by increasing stiffness.

As an example, the hinge body ribs 281*b* may be formed to surround a circumference of the hinge body 281 by facing both sides of the hinge body 281.

A hinge body protrusion 281*c* may be provided in a part where the hinge body ribs 284*b* contact a top surface of the lower support 270.

In detail, the hinge body ribs 281*b* may protrude outwards along a circumference from the hinge body 281, and may extend to a bottom end of the lower support 170.

The hinge body protrusion 281*c* may extend into the lower support 270 from an end of the hinge body rib 281*b*.

In addition, as the hinge body protrusion 281*c* is to reduce deformation of the hinge bodies 281, 282, the hinge bodies 281, 282 may be curvilinearly connected without bending with the top surface of the lower support 270.

The lower support 270 may comprise a first guide groove 293 for guiding a power input terminal 296*c* and a power output terminal 296*d* of the lower heater 296 accommodated in the heater accommodation groove 291, and a second guide groove 294 extending in a direction of crossing the first guide groove 293.

As an example, the first guide groove 293 may extend from the heater accommodation groove 291 to an arrow B.

The second guide groove 294 may extend from an end of the first guide groove 293 to an arrow A. In this embodiment, the arrow A is a direction alongside an extension direction of a rotational central axis (C1) of the lower assembly 200.

In addition, the second guide groove 294 may comprise slots 295, 299 of which both ends are connected to the outside of the lower support 270.

In detail, a withdrawing slot 299 for withdrawing the wire 268 may be formed in one end of the second guide groove 294.

A central slot 295 may be formed in the other end of the second guide groove 294. The central slot 295 may be formed adjacent to a center of the lower support 270.

The wire 298 is curved after extending toward the central slot 295 in the second guide groove 294, extends towards the withdrawing slot 299, and finally passes through the withdrawing slot 299. Since the wire 298 is disposed in a curved stated in the second guide groove 295, at least portion of the curving part may be disposed in the central slot 295 in order to avoid the disconnection in the curving part.

The lower heater 291 accommodated inside or a separation prevention protrusion 293*a* for preventing the wire 298 from being separated may be provided in at least one of the first guide groove 293 and the second guide groove 294.

A chamber accommodation part (for example, a right chamber accommodation part) disposed farthest from the first guide groove 293 among the three chamber accommodation parts may further comprise a detour accommodation groove 292.

As an example, after the detour accommodation groove 292 is curved by extending outwards from the heater accommodation groove 291, the detour accommodation groove 292 may be connected back to the heater accommodation groove 291.

When the lower heater 291 is additionally accommodated in the detour accommodation groove 292, a contact area of a chamber wall accommodated in the chamber accommodation part 272 on the right and the lower heater 296 may be increased.

Therefore, as an example, the chamber accommodation part 272 on the right may further comprise a protrusion 292*a* for fixing a position of the lower heater accommodated in the detour accommodation groove 292.

In addition, in the chamber accommodation part 272 on the right, a plurality of detour accommodation grooves 292 may be provided, and a penetration opening 291*d* may be formed to correspond to a protrusion 292*b* in order to reduce a tension of the lower heater 296 and prevent the lower heater 296 from being separated from the heater accommodation groove 291.

In detail, the chamber accommodation part 272 on the right may comprise the detour accommodation groove 292 on the right based on FIG. 26, and further comprise a detour accommodation groove 292 in a direction of facing the hinge body 281.

In addition, the detour accommodation groove 292 formed in the direction of facing the hinge body 281 may further comprise a penetration opening 291*d* formed to disconnect the protrusion 292*b* and the lower heater 296 or prevent the heater accommodation groove 291 from being separated.

As another example, a chamber accommodation part 272 on the left may further comprise a protrusion 292*c* for fixing a position of the lower heater accommodated in the detour accommodation groove 292. At this time, the detour accommodation groove 292 may be disposed symmetrical to the detour accommodation groove 292 provided in the chamber accommodation part 272 on the right.

With reference to FIGS. 44 and 45, in a state that the lower assembly 200 is coupled to the upper case 120 of the upper assembly 110, the wire 298 withdrawn outside of the lower support 270 through the withdrawing slot 299 formed in one side of the lower support 270 may pass through the wire penetration slot 138 formed in the upper case 120 to extend to the top of the upper case 120.

In detail, the wire 298 penetrating the withdrawing slot 299 is disposed in an upper side of the wire guiding hook 134 to prevent the flow of the wire 298, which allows an interference not to occur in rotating the lower assembly.

A limiting guide 139 for limiting a movement of the wire 298 penetrating the wire penetration slot 138 may be provided in the wire penetration slot 138. The limiting guide 139 may be curved several times, and the wire 298 may be disposed in the wire 298 in an area in which the limiting guide 139 is formed.

By the provided embodiment, the tension of the wire may be reduced by extending a length of the wire connected to the heater, and the wire may be prevented from being disconnected.

In addition, even if the length of the wire is extended by adding the wire guiding hook, the possibility to disconnect the wire by the rotation of the lower assembly may be prevented, and the rotation of the lower assembly may not interfere by the wire.

In addition, the lower assembly may be smoothly rotated by reinforcing a strength of a rotational axis of the lower case.

What is claimed is:

1. An ice maker comprising:

a tray body made of a flexible material, the tray body comprising a plurality of chamber walls configured to define a plurality of ice chambers arranged along a central line extending in a first direction and passing through centers of the plurality of ice chambers;

a first heater disposed at the plurality of chamber walls, the first heater being configured to provide heat to the plurality of ice chambers during an ice-making process; and a second heater that surrounds the plurality of chamber walls and is spaced apart from the first heater, the second heater being configured to provide heat to the plurality of ice chambers during an ice-separation process after the ice-making process, wherein a first radial distance from one of the centers to the first heater is less than a second radial distance from the one of the centers to the second heater, and wherein the first heater is configured to, based on heating the plurality of ice chambers during the ice-making process, cause bubbles in water received in the plurality of ice chambers to be collected at a portion of each of the plurality of ice chambers.

2. The ice maker of claim 1, wherein the first heater contacts an outer circumferential surface of each of the plurality of chamber walls.

3. The ice maker of claim 2, wherein the portion where bubbles are collected corresponds to a portion with which the first heater is in contact.

4. The ice maker of claim 1, wherein the second heater is spaced apart from an outer circumferential surface of the plurality of chamber walls.

5. The ice maker of claim 1, further comprising an accommodation part disposed in a shape that surrounds the chamber wall, and wherein the second heater is contact the accommodation part.

6. The ice maker of claim 1, wherein a first shortest distance between the first heater and an inner surface of the chamber wall is less than a second shortest distance between the second heater and the inner surface of the chamber wall.

7. The ice maker of claim 1, further comprises a case that contacts and supports the tray body, wherein at least a portion of the case is disposed in a space between the second heater and an outer circumferential surface of the plurality of chamber walls.

8. The ice maker of claim 7, wherein the case comprises a heater coupling part configured to couple the second heater, wherein the heater coupling part comprises an outer wall and an inner wall defining a heater accommodation groove for accommodating the second heater, and at least a portion of the inner wall is disposed in the space between the second heater and the outer circumferential surface of the plurality of chamber walls.

9. The ice maker of claim 7, further comprising an ejector configured to, based on the second heater being turned on, move to the plurality of ice chambers to thereby separate ice from the plurality of ice chambers.

10. The ice maker of claim 9, wherein the case defines an opening configured to receive at least a portion of the ejector during the ice-separation process.

11. The ice maker of claim 1, wherein the plurality of chamber walls comprise:

a plurality of first chamber walls configured to define first parts of the plurality of ice chambers; and a plurality of second chamber walls configured to define second parts of the plurality of ice chambers, each of the second chamber walls being configured to:

during the ice-making process, contact a corresponding one of the plurality of first chamber walls to thereby close one of the plurality of ice chambers, and during the ice-separation process, detach from the corresponding one of the plurality of first chamber walls to thereby open the one of the plurality of ice chambers.

12. The ice maker of claim 1, wherein the tray body comprises:

a first tray body configured to define first parts of the plurality of ice chambers; and a second tray body configured to define second parts of the plurality of ice chambers, the second tray body being configured to:

during the ice-making process, contact the first tray body to thereby close the plurality of ice chambers, and during the ice-separation process, detach from the first tray body to thereby open the plurality of ice chambers.

13. The ice maker of claim 1, further comprising a controller configured to control the first heater and the second heater.

14. The ice maker of claim 1, wherein the first heater is configured to operate while at least some water remains in the plurality of ice chambers during the ice-making process, and wherein the second heater is configured to operate based on completion of the ice-making process.

15. An ice maker comprising:

a tray body made of a flexible material, the tray body comprising a plurality of chamber walls configured to define a plurality of ice chambers arranged along a central line extending in a first direction and passing through centers of the plurality of ice chambers;

a first heater that is disposed at and contacts an outer circumferential surface of the plurality of chamber walls, the first heater being configured to supply heat to the plurality of ice chambers during an ice-making process; and a second heater that surrounds the plurality of chamber walls and is spaced apart from the first heater, the second heater being configured to supply heat to the plurality of ice chambers during an ice-separation process after the ice-making process, wherein each of the plurality of chamber walls defines an opening configured to expose one of the plurality of ice chambers to cold air, wherein the first heater is located farther from the opening than the second heater, and wherein the first heater is configured to, based on heating the plurality of ice chambers during the ice-making process, cause bubbles in water received in the plurality of ice chambers to be collected at a portion of each of the plurality of ice chambers.

16. The ice maker of claim 15, wherein the opening has an inner end connected to an inner circumferential surface of the one of the plurality of ice chambers, and wherein the first heater is spaced apart from the inner end of the opening in a second direction orthogonal to the first direction, and wherein the first heater is located farther from the opening than the second heater in the second direction.

17. The ice maker of claim 16, wherein the second heater is disposed on a bisector line that extends in the first direction and evenly divides a distance between the inner end of the opening and the first central line.

18. The ice maker of claim 16, wherein the second heater is disposed at a position between the inner end and a bisector line, the bisector line extending in the first direction and evenly dividing a distance between the inner end of the opening and the first central line.

19. The ice maker of claim 18, wherein the second heater is located closer to the inner end of the opening than to the bisector line in the second direction.

20. A refrigerator comprising:

a cabinet defining a storage space; and an ice maker disposed in the storage space, wherein the ice maker comprises:

a tray body made of a flexible material, the tray body comprising a plurality of chamber walls configured to define a plurality of ice chambers arranged along a central line extending in a first direction and passing through centers of the plurality of ice chambers;

a first heater disposed at the plurality of chamber walls, the first heater being configured to supply heat to the plurality of ice chambers during an ice-making process; and a second heater that surrounds the plurality of chamber walls and is spaced apart from the first heater, the second heater being configured to supply heat to the plurality of ice chambers during an ice-separation process after the ice-making process, wherein a first radial distance from one of the centers to the first heater is less than a second radial distance from the one of the centers to the second heater, and wherein the first heater is configured to, based on heating the plurality of ice chambers during the ice-making process, cause bubbles in water received in the plurality of ice chambers to be collected at a portion of each of the plurality of ice chambers.

21. The refrigerator of claim 20, wherein the first heater contacts an outer circumferential surface of each of the plurality of chamber walls.

22. The refrigerator of claim 21, wherein the portion where bubbles are collected corresponds to a portion with which the first heater is in contact.

23. The refrigerator of claim 20, wherein the second heater is spaced apart from an outer circumferential surface of the plurality of chamber walls.

24. The refrigerator of claim 20, further comprises a case that contacts and supports the tray body, wherein at least a portion of the case is disposed in a space between the second heater and an outer circumferential surface of the plurality of chamber walls.

25. The refrigerator of claim 24, wherein the case comprises a heater coupling part configured to couple the second heater, wherein the heater coupling part comprises an outer wall and an inner wall defining a heater accommodation groove for accommodating the second heater, and at least a portion of the inner wall is disposed in the space between the second heater and the outer circumferential surface of the plurality of chamber walls.

* * * * *